US008098225B2

(12) United States Patent
Murakami et al.

(10) Patent No.: US 8,098,225 B2
(45) Date of Patent: Jan. 17, 2012

(54) DISPLAY DEVICE DRIVING CIRCUIT AND DISPLAY DEVICE INCLUDING SAME

(75) Inventors: Yuhichiroh Murakami, Matsusaka (JP); Hajime Washio, Headington (GB)

(73) Assignee: Sharp Kabushiki Kaisha, Osaka (JP)

( * ) Notice: Subject to any disclaimer, the term of this patent is extended or adjusted under 35 U.S.C. 154(b) by 997 days.

(21) Appl. No.: 11/665,206

(22) PCT Filed: May 10, 2005

(86) PCT No.: PCT/JP2005/018446

§ 371 (c)(1),
(2), (4) Date: Feb. 25, 2008

(87) PCT Pub. No.: WO2006/040977

PCT Pub. Date: Apr. 20, 2006

(65) Prior Publication Data

US 2008/0158129 A1 Jul. 3, 2008

(30) Foreign Application Priority Data

Oct. 14, 2004 (JP) ..... 2004-300597
Sep. 6, 2005 (JP) ..... 2005-258550

(51) Int. Cl.
*G09G 3/36* (2006.01)

(52) U.S. Cl. ..... 345/100

(58) Field of Classification Search ..... 345/98–100
See application file for complete search history.

(56) References Cited

U.S. PATENT DOCUMENTS

| | | | |
|---|---|---|---|
| 5,686,936 | A | 11/1997 | Maekawa et al. |
| 5,818,412 | A | 10/1998 | Maekawa |
| 6,377,104 | B2 | 4/2002 | Cairns et al. |
| 6,724,361 | B1 | 4/2004 | Washio et al. |
| 2003/0174115 | A1 | 9/2003 | Washio et al. |
| 2003/0234761 | A1 | 12/2003 | Washio et al. |
| 2004/0174334 | A1 | 9/2004 | Washio et al. |
| 2005/0179635 | A1 | 8/2005 | Murakami et al. |

FOREIGN PATENT DOCUMENTS

| | | |
|---|---|---|
| JP | 05-216441 | 8/1993 |
| JP | 07-295520 | 11/1995 |
| JP | 11-218738 | 8/1999 |
| JP | 2000-206491 | 7/2000 |
| JP | 2000-339985 | 12/2000 |
| JP | 2001-135093 | 5/2001 |
| JP | 2001-307495 | 11/2001 |
| JP | 2001-356728 | 12/2001 |
| JP | 2004-054235 | 2/2004 |
| JP | 2005-258424 | 9/2005 |

*Primary Examiner* — Bipin Shalwala
*Assistant Examiner* — Steven Holton
(74) *Attorney, Agent, or Firm* — Harness, Dickey & Pierce, P.L.C.

(57) ABSTRACT

In an embodiment, a sampling signal to each data signal line is generated by using an output signal outputted from each flip-flop, and a precharge signal by which the data signal line to which the sampling signal is to be outputted is precharged is generated by using an output signal outputted from an output terminal of the flip-flop. Further, by providing a NOR circuit, an active period of the precharge signal and an active period of the sampling signal are prevented from overlapping each other. With this, in an embodiment of a display device driving circuit, including a precharge circuit, which causes a precharge power supply to precharge signal supply lines, the number of shift registers and the size of a circuit can be reduced.

8 Claims, 32 Drawing Sheets

SCKB
SCK
CK
CKB
CINB
QB
PO
RB
SR1
SR2
SR3
SR4
SRn+1
SRn+2
QB1
QB2
QB3
QB4
QBn
QBn+1
QBn+2
SSPB'
LS
SSPB
31a
31b
31c
PO1
PO2
PO3
PO4
POn
DELAY CIRCUIT
Pd1
Pd2
Pd3
Pd4
Pdn
DO1
DO2
DO3
DO4
DOn
BUFFER
Pb1
Pb2
Pb3
Pb4
Pbn
NOR1
NOR2
NOR3
NOR4
NORn
NOUT1
NOUT2
NOUT3
NOUT4
NOUTn
Sb1
Sb2
Sb3
Sb4
Sbn
SMP1
SMP2
SMP3
SMP4
SMPn
PSMP1
PSMP2
PSMP3
PSMP4
PSMPn
SAMPLING SECTION

DISPLAY DEVICE DRIVING CIRCUIT AND DISPLAY DEVICE INCLUDING SAME

TECHNICAL FIELD

The present invention relates to (i) a driving circuit for supplying a write signal to signal supply lines of a display device after having precharged the signal supply lines and (ii) a display device including the driving circuit.

BACKGROUND ART

In driving a liquid crystal panel of a dot-sequential active-matrix liquid crystal display device by alternating current, before a video signal is supplied to pixels via data signal lines, each of the data signal lines is precharged. With this, each of the pixels is stably charged so as to have a desired quantity of electric charge. In this case, because the total wiring capacitance of the data signal lines is high, an attempt to precharge all the data signal lines at once requires a precharge power supply having high driving capability. This problem can be solved by a technique for precharging each unit of a small number of data signal lines.

For example, Japanese Unexamined Patent Application No. 295520/1995 (Tokukaihei 7-295520; published on Nov. 10, 1995) discloses an arrangement. According to this arrangement, when a video signal is outputted to a data signal line, a switch of another data signal line is turned on with the use of a signal for sampling the video signal outputted from a shift register of a data signal line driver, so that precharge is performed by using power supplied from a precharge power supply.

According to Tokukaihei 7-295520, in order to output the video signal to the data signal lines in a dot-sequential manner, each of the data signal lines is provided with a switch, such as a MOSFET as well as a TFT, which has a capacitive control terminal (e.g., a gate), and the switch is switched between conductive and nonconductive states by controlling the charging voltage of the control terminal. The switch is switched in a dot-sequential manner by a control signal (e.g., a gate signal) that is shifted, in a horizontal direction, and outputted by a shift register generally including a plurality of flip-flops. Further, each of the data signal lines is further provided with a similar switch that is so switched between conductive and nonconductive states in a dot-sequential manner as to perform precharge.

According to the arrangement of Tokukaihei 7-295520, a circuit for performing precharge is provided in the data signal line driver. This makes it possible to reduce the amount of space that a precharge circuit occupies, e.g., to ensure that a liquid crystal display device has a sufficient amount of space for a frame.

However, according to the data signal line driver of Tokukaihei 7-295520, a signal for switching on and off a sampling switch for sampling the video signal is used also as a signal for switching on and off a precharge switch of another data signal line. This causes such a problem that display quality deteriorates, for example, due to a decrease in display uniformity.

That is, precharge to be performed by alternating current is performed so that the respective potentials of each data signal line and a pixel capacitor are so greatly changed as to be reversed in polarity with respect to those obtained when the previous video signal was sampled. Therefore, on this occasion, the switching of the switch is accompanied by a high impulse-like charging current. Since the switch has a capacitive control circuit, a relatively high frequency component of the high charging current may be transmitted to a control signal circuit of the switch via a capacitor of the control terminal, thereby oscillating the potential of the control signal circuit and further oscillating, via a control terminal of a video signal writing switch, a video signal that is to be supplied to a data signal line. Such oscillations of the video signal causes display quality to deteriorate, for example, due to a decrease in display uniformity.

In order to solve such a problem, Japanese Unexamined Patent Application No. 54235/2004 (Tokukai 2004-54235; published on Feb. 19, 2004), filed previously by the applicant of the present invention, which has already been published as a Japanese Unexamined Patent Application discloses an arrangement in which an output circuit for outputting a signal for switching on and off a sampling switch or an output circuit for outputting a signal for switching on and off a precharge circuit is used. According to this arrangement, a high current, accompanying precharge, which flows through a data signal line can be prevented from oscillating, via a capacitive control terminal of a precharge switch, the potential of a video signal that is to be written in a data signal line in which writing is currently performed.

An example of how a data signal line driver disclosed in Tokukai 2004-54235 is arranged will be described below with reference to FIGS. 30 and 31.

As shown in FIG. 30, the data signal line driver 131 includes a shift register 131*a* and a sampling section 131*b*. Moreover, the shift register 131*a* includes a plurality of set-reset flip-flops srff1, srff2, . . . and switch circuits asw1, asw2, . . . respectively corresponding to the set-reset flip-flops srff1, srff2, . . . .

The flip-flops srff1, srff2, srff3, . . . output output signals dq1, q1, q2, . . . , respectively. Among these output signals, the output signals q1, q2, . . . outputted by the second and subsequent flip-flops srff2, srff3, . . . are inputted to switches v_asw1, v_asw2, . . . via buffers Buf1, Buf2, . . . provided in the sampling section 131*b*, respectively. Each of the switches v_asw1, v_asw2, . . . of the sampling section 3B is a switch having a capacitive control terminal (e.g., a gate), and the switches v_asw1, v_asw2, . . . become conductive upon receiving the output signals q1, q2, . . . , respectively. When the switches v_asw1, v_asw2, . . . become conductive, the switches v_asw1, v_asw2, . . . output, to data signal lines sl1, sl2, . . . , the potential of an analog video signal VIDEO inputted in common to the switches v_asw1, v_asw2, . . . , respectively. That is, each of the output signals q1, q2, . . . serves as a timing pulse by which the video signal VIDEO is sampled.

Further, the output signals dq1, q1, q2, . . . are inputted as control signals to the switch circuits asw1, asw2, asw3, . . . , respectively. When the switch circuits asw1, asw2, . . . become conductive, the odd-numbered ones of the switch circuits asw1, asw2, . . . load and outputs a clock signal sck, and the even-numbered ones of the switch circuits asw1, asw2, . . . load and output a clock signal sckb. The clock signal sckb is an inversion signal of the clock signal sck.

Moreover, the switch circuits asw1, asw2, . . . output output signals dsr1, sr1, sr2, . . . , respectively. These output signals each serve as a set signal that is to be sent to the next flip-flop srff and as a reset signal that is to be sent to the previous flip-flop srff, and here serve as input signals that are to be respectively sent to switches p_asw2, p_asw3, . . . . Further, the first flip-flop srff1 receives a start pulse ssp as a set signal, and the start pulse ssp serves also as an input signal that is to be sent to a switch p_asw1.

As with the switches v_asw1, v_asw2, . . . , each of theses switches p_asw1, p_asw2, . . . of the sampling section 131 is a switch having a capacitive control terminal. The switches p_asw1, p_asw2, . . . become conductive upon receiving the start pulse ssp and the output signal dsr1, sr1, sr2, . . . , respectively. When the switches p_asw1, p_asw2, . . . become conductive, the switches p_asw1, p_asw2, . . . output, to the data signal lines sl1, sl2, . . . , a precharging potential PVID inputted in common to the switches p_asw1, p_asw2, . . . , respectively. That is, each of the start pulse ssp and the output signal dsr1, sr1, sr2, . . . serves as a control signal by which precharge is performed.

Provided so as to be orthogonal to the data signal lines sl1, sl2, . . . are scanning signal lines g11, g12, . . . . Moreover, at points of intersection between the data signal lines sl and the scanning data signal lines gl, pixels Pix1_1, Pix1_2, . . . are provided in a matrix manner, respectively.

FIG. 31 is a timing chart concerning the data signal line driver 131 arranged as described above. When the start pulse ssp is inputted, the start pulse ssp is also inputted to the switch p_asw1, so that the data signal line sl1 is precharged. On this occasion, the switch v_asw1 is nonconductive. Therefore, the precharging potential PVID and the video signal VIDEO do not collide with each other on the data signal line sl1.

Further, upon receiving the start pulse ssp, the flip-flop srff1 outputs the output signal dq1. Upon receiving the output signal dq1, the switching circuit asw1 becomes conductive, loads the clock signal sck, and outputs the output signal dsr1. The output signal dsr1 serves as a set signal. The set signal is inputted to the flip-flop srff2, so that the flip-flop srff2 outputs the output signal q1.

Upon receiving the output signal q1, the switch asw2 becomes conductive, loads the clock signal sckb, and outputs the output signal sr1. Further, the output signal q1 serves as a timing pulse. The timing pulse is inputted to the switch v_asw1 via the buffer Buf1, so that the switch v_asw1 becomes conductive. With this, the data signal line sl1 is supplied with the video signal VIDEO. On this occasion, the start pulse ssp has already become low, so that the switch p_asw1 is nonconductive. Therefore, the precharging potential PVID and the video signal VIDEO do not collide with each other on the data signal line sl1.

Further, since the output signal dsr1 causes the switch p_asw2 to be conductive, the data signal line sl2 is precharged at the same time as the video signal VIDEO is outputted to the data signal line sl1.

Thus, sampling is performed in a dot-sequential manner by sequentially repeating an operation of supplying the video signal VIDEO to a data signal line sln after the data signal line sln has been precharged and precharging a data signal line sl(n+1) while supplying the video signal VIDEO to the data signal line sln.

Further, Japanese Unexamined Patent Application No. 218738/1999 (Tokukaihei 11-218738; published on Aug. 10, 1999) describes a technique for writing a precharge signal in data lines in a line-sequential manner in an electro-optic device, including a bidirectional shift register, which carries out a reversing display. According to the technique described in this document, an output stage located two stages before an output stage for outputting a sampling circuit driving signal outputs a precharge circuit driving signal, and a precharge signal switching circuit selects, in accordance with the shift direction of the bidirectional shift register, an output stage for outputting a precharge circuit driving signal.

Note that Japanese Unexamined Patent Application No. 135093/2001 (Tokukai 2001-135093; published on May 18, 2001), filed previously by the applicant of the present invention, which has already been published as a Japanese Unexamined Patent Application discloses an arrangement in which a switch circuit loads a clock signal in response to an output sent from a set-reset flip-flop constituting each stage of a shift register and in which the clock signal serves as a set signal that is to be sent to the next set-reset flip-flop. Further, Japanese Unexamined Patent Application No. 307495/2001 (Tokukai 2001-307495; published on Nov. 2, 2001) and Japanese Unexamined Patent Application No. 339985/2000 (Tokukai 2000-339985; published on Dec. 8, 2000), filed previously by the applicant of the present invention, which have already been published as a Japanese Unexamined Patent Application disclose an arrangement in which a clock signal is loaded in response to an output sent from a set-reset flip-flop constituting each stage of a shift register and in which the clock signal is level-shifted so as to serve as a set signal that is to be sent to the next set-reset flip-flop.

However, according to the respective techniques of Tokukaihei 7-295520 and Tokukai 2004-54235, before a video signal is outputted to a data signal line, precharge is performed by using a signal outputted by an output stage located right in front of an output stage for outputting the video signal to the data signal line.

This makes it necessary to add a precharge output stage (dummy stage, dummy circuit) right in front of the shift register in order to precharge a first data signal line or first and second data signal lines, thereby increasing the amount of space that the driving circuit occupies. For example, according to the arrangement in which an output stage is precharged by using an output stage located two stages before the output stage, it is necessary to provide two dummy stages.

Furthermore, in addition to the increase in the amount of space that a dummy stage occupies, there is an increase in the amount of space in which wires are provided. This causes an increase in the amount of space for a frame surrounding a display area. Therefore, the respective techniques of Tokukaihei 7-295520 and Tokukai 2004-54235 are not suitable for a display device, such as a display device to be provided in a portable phone or the like, which is required to be small and to have, for the purpose of miniaturization, a small amount of space for a frame surrounding a display area.

Further, according to the technique of Tokukaihei 11-218738, it is necessary to provide a precharge signal switching circuit for selecting, in accordance with the shift direction of a bidirectional shift register, an output stage for outputting a precharge circuit driving signal. The precharge signal switching circuit receives a precharge circuit driving signal sent from an output stage located two stages before the precharge signal switching circuit along each shift direction, and receives a precharge circuit driving signal sent from an output stage located two stages after the precharge signal switching circuit along each shift direction. This causes an increase in the amount of space that the precharge signal switching circuit occupies and an increase in the amount of space in which wires are provided, thereby causing an increase in the size of the driving circuit.

Thus, the conventional display device driving circuit has such a problem that the amount of space that the driving circuit occupies and the amount of space in which wires are provided are increased for the purpose of performing precharge. Note that none of Tokukai 2001-135093, Tokukai 2001-307495, and Tokukai 2000-339985 discloses or suggests anything about precharge.

DISCLOSURE OF INVENTION

The present invention has been made in view of the foregoing problems, and it is an object of the present invention to reduce the amount of space for a display device driving circuit including a precharge circuit and to provide a display device, including the driving circuit, which has a wide display area.

In order to solve the foregoing problems, a display device driving circuit of the present invention is a display device driving circuit, including: a write circuit, including first switches respectively corresponding to a plurality of signal supply lines provided in a display device, which writes a write signal in each of the signal supply lines when a first switch corresponding to the signal supply line is conductive; a shift register, including a plurality of pulse generating means for generating timing pulses for causing the first switches to be conductive, which sequentially outputs the timing pulses to the signal supply lines, respectively; and a precharge circuit, including second switches respectively corresponding to the signal supply lines, which precharges each of the signal supply lines when a second switch corresponding to the signal supply line is conductive, each of the pulse generating means receiving a timing pulse outputted from previous pulse generating means, in a period between (i) a point of time where the timing pulse is changed to an active level at which a first switch corresponding to the previous pulse generating means is made conductive and (ii) a point of time where the each of the pulse generating means outputs a timing pulse that is at an active level, the each of the timing pulse generating means outputting a precharge pulse for causing a second switch to be conductive, which second switch corresponds to a signal supply line in which the write signal is to be written in accordance with the timing pulse outputted by the each of the timing pulse generating means, and for thereby causing the signal supply line to be precharged.

According to the foregoing arrangement, each of the pulse generating means outputs a precharge pulse for causing a second switch to be conductive, which second switch corresponds to a signal supply lines in which the write signal is to be written in accordance with a timing pulse outputted by the pulse generating means, and for thereby causing the signal supply line to be precharged. This makes it unnecessary to provide a dummy circuit, needed conventionally, for outputting a precharge pulse for causing a signal supply line to be precharged, in which signal supply line the write signal is to be written in accordance with (i) a timing pulse outputted by the first pulse generating means or (ii) timing pulses respectively outputted by the first and second pulse generating means. This makes it possible to reduce the amount of space a display device driving circuit including a precharge circuit occupies and the amount of space, surrounding the driving circuit, in which wires are provided.

Further, in order to solve the foregoing problems, a display device of the present invention is a display device, including: a plurality of pixels; data signal lines, provided so as to correspond to the pixels, which serves as a plurality of signal supply lines; scanning signal lines, provided so as to correspond to the pixels, which serve as a plurality of signal supply lines; a data signal line driver for writing, in the data signal lines and the pixel, a video signal serving as a write signal; and a scanning signal line driver for writing, in the scanning signal lines, a scanning signal serving as a write signal, so as to select a pixel in which the video signal is to be written, the display device including the display device driving circuit as the data signal line driver.

According to the foregoing arrangement, the size of a display device driving circuit can be reduced. Therefore, a display device having a wide display area can be realized by reducing the amount of space that a frame occupies in a display section, i.e., the amount of space that a non-display region occupies in a display section.

BEST MODE FOR CARRYING OUT THE INVENTION

Embodiment 1

Figure 1:
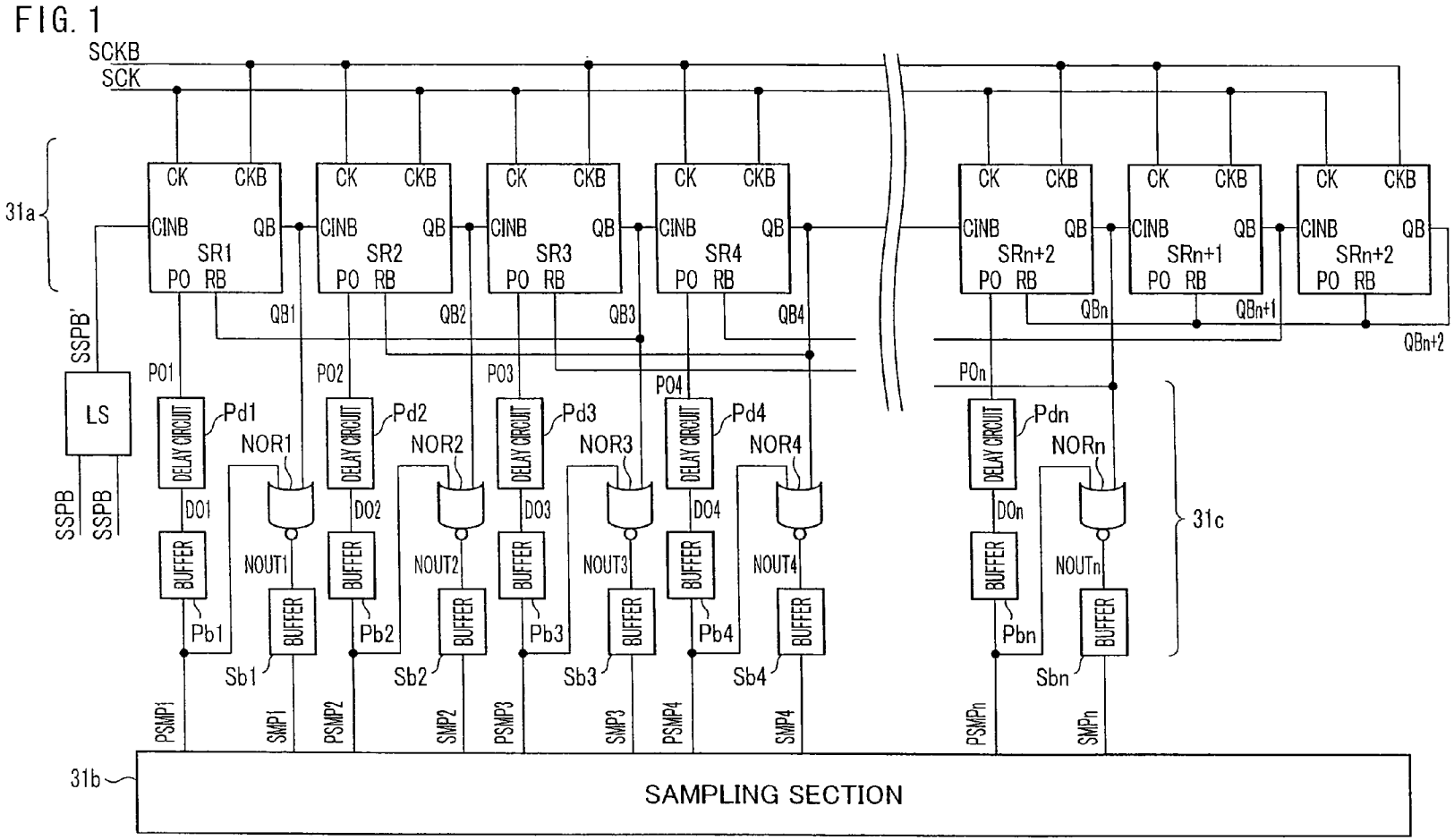
FIG. 1 is a block diagram showing a structure of a data signal line driver according to an embodiment of the present invention.
Figure 2:
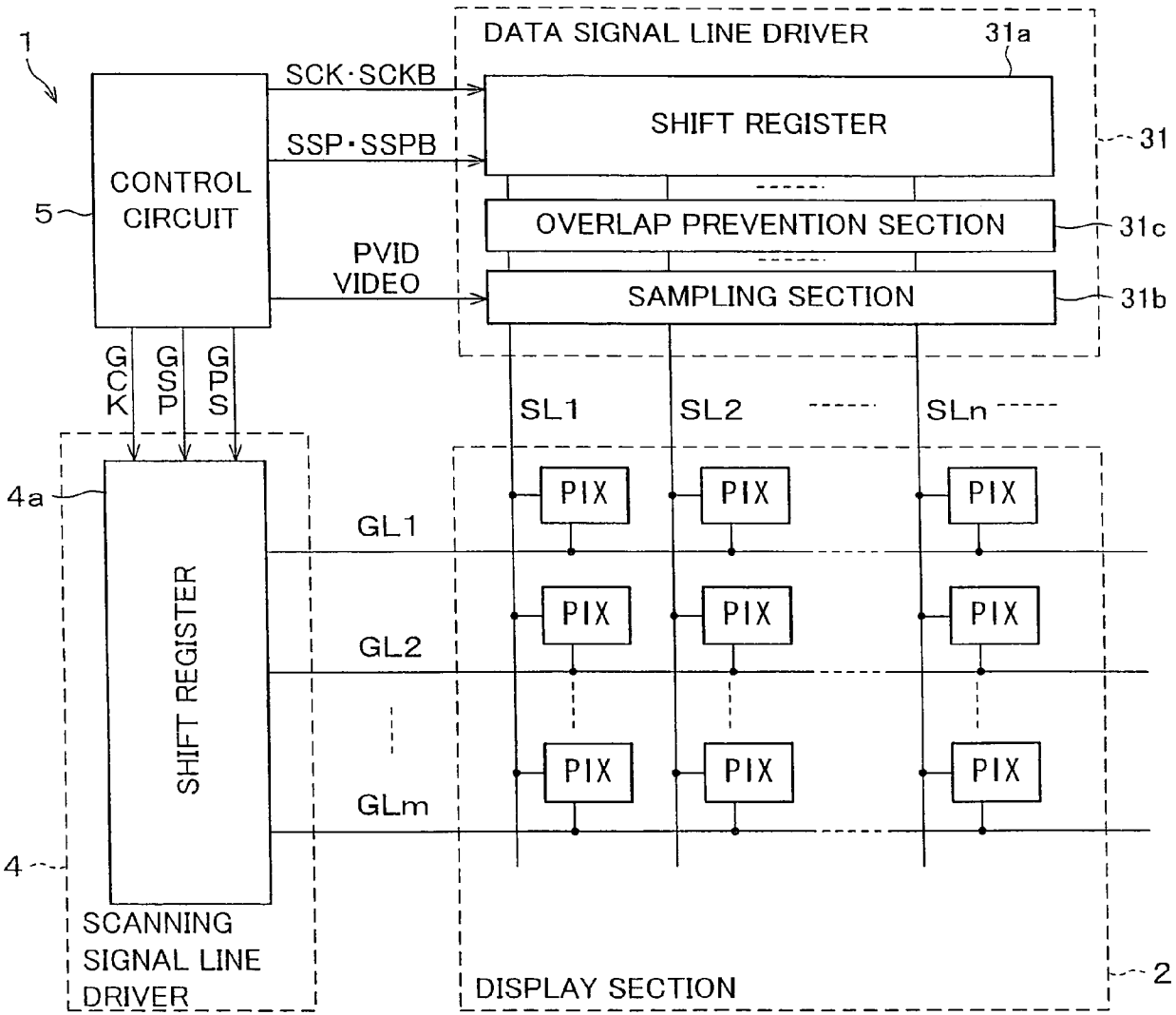
FIG. 2 is a block diagram showing a structure of a display device including the data signal line drive according to the embodiment of the present invention.

An embodiment of the present invention is described with reference to the drawings. FIG. 1 is a block diagram showing a structure of a data signal line driver 31, which is a display device driving circuit according to the present embodiment. As shown in FIG. 2, the data signal line driver 31 is a data signal line driver for driving data signal lines SL1, SL2, . . . of a liquid crystal display device (display device) 1.

(Liquid Crystal Display Device 1)

The liquid crystal display device 1 is an active-matrix liquid crystal display device in which pixels are driven in a dot-sequential manner and by alternating current. The liquid crystal display device 1 includes a display section 2 having pixels PIX arrayed in a matrix manner, a data signal line driver 31 and a scanning signal line driver 4 both driving each of the pixels PIX, a control circuit 5, data signal lines SL1, SL2, . . . , and scanning signal lines GL1, GL2, . . . . Moreover, the control circuit 5 generates a video signal VIDEO, indicating a display state of each of the pixels PIX, in accordance with which an image is displayed.

The pixels PIX are respectively provided in regions, arrayed in a matrix manner, which are separated from one another by m scanning signal lines GL1 to GLm and n data signal lines SL1 to SLn orthogonal to one another. Moreover, the data signal line driver 31 and the scanning signal line driver 4 sequentially writes the video signal VIDEO, inputted from the control circuit 5, in the pixels PIX via the data signal lines SL1 to SLn and the scanning signal lines GL1 to GLm. With this, an image is displayed.

Figure 3:
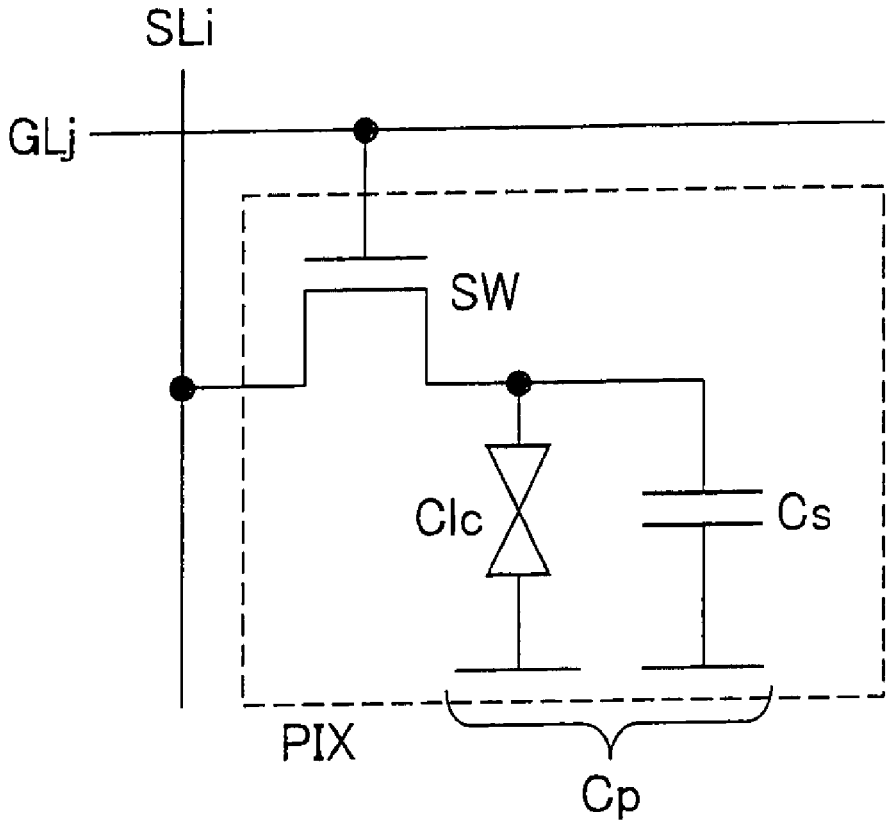
FIG. 3 is a block diagram showing a structure of a pixel of the display device shown in FIG. 2.

FIG. 3 shows a structure of a pixel PIX provided in a region zoned by a jth scanning signal line GLj and an ith data signal line SLi. Note that each of the pixels PIX is arranged in the same manner.

As shown in FIG. 3, the pixel PIX includes a switching transistor (field-effect transistor) SW and a pixel capacitor Cp. The pixel capacitor Cp includes a liquid crystal capacitor Clc and a supplementary capacitor Cs that is to be added as needed.

The switching transistor SW has a gate connected to the scanning signal line GL, a source connected to the data signal line SL, and a drain connected to the pixel capacitor Cp (the liquid crystal capacitor Clc and the supplementary capacitor Cs). Note that the other electrode of the pixel capacitor Cp is connected to a common electrode line shared by all the pixels PIX.

Therefore, when the scanning signal line GL is selected, the switching transistor SW becomes conductive, so that a voltage applied to the data signal line SL is applied to the pixel capacitor Cp. On the other hand, when the select period of the scanning signal ends, the switching transistor SW is turned off. While the switching transistor SW is off, the pixel capacitor Cp continues to retain the voltage applied thereto when the switching transistor SW was turned off. Here, the transmittance or reflectance of a liquid crystal varies depending on a voltage applied to the liquid crystal capacitor Clc. Therefore, a display state of the pixel PIX can be changed in accordance with the video signal VIDEO by selecting the scanning signal line GL and by applying, to the data signal line SL, a voltage corresponding to the video signal VIDEO.

The control circuit 5 generates a clock signal SCK, an inversion signal (inversion clock signal) SCKB of the clock signal SCK, a start pulse SSP, an inversion signal SSPB of the start pulse SSP, and a video signal VIDEO, and outputs the signals to the data signal line driver 31. Further, the control section 5 supplies a precharging potential PVID to the data signal line driver 31. Furthermore, the control section 5 generates a clock signal GCK, a start pulse GSP, and a signal GPS, and outputs the signals to the scanning signal line driver 4.

The data signal line driver 31 includes a shift register 31*a*, a sampling section 31*b*, an overlap prevention section 31*c*, and a level shifter LS.

Here, the data signal line driver 31 receives, in a time-sharing manner, the video signal VIDEO serving as an image signal that is to be sent to each of the pixels PIX. Moreover, at a timing that is based on the clock signals SCK and SCKB each serving as a timing signal and on a signal SSPB' obtained by converting the start pulse SSP into a desired voltage with the use of the level shifter LS, the data signal line driver 31 extracts, from the video signal VIDEO, image data that is to be sent to each of the pixels PIX. Specifically, the shift register 31*a* sequentially shifts the start pulse SSPB' in synchronization with an on-timing of the clock signal SCK, thereby generating output signals S1 to Sn whose timings are different from one another by a half cycle of the clock signal SCK; and the sampling section 31*b* samples the video signal VIDEO at the timings respectively indicated by the output signals S1 to Sn, and then outputs the video signal VIDEO to each of the data signal lines SL1 to SLn.

The scanning signal line driver 4 includes a shift register 4*a*. The shift register 4*a* receives the clock signal GCK, the start pulse GSP, and the signal GPS. Moreover, the shift register 4*a* sequentially shifts the start pulse GSP in synchronization with the clock signal GCK, thereby outputting scanning signals, whose timings are different from one another by a predetermined interval, to the scanning signal lines GL1 to GLm in a line-sequential manner. With this, the video signal VIDEO is written in each of the pixels PIX, so that an image is displayed.

The display section 2 and the peripheral circuit including the data signal line driver 31 and the gate driver 4 are monolithically formed on one substrate so that manufacturing labor, wiring capacitance, and wiring resistance are reduced. Further, for the purpose of integrating more pixels PIX and increasing the amount of space for display, the display section 2, the data signal line driver 31, and the scanning signal line driver 4 are constituted by a polycrystalline silicon thin-film transistor formed on a glass substrate. Furthermore, the polycrystalline thin-film transistor is manufactured at a processing temperature of not higher than 600° C. so that even when a normal glass substrate (a glass substrate whose strain point is not higher than 600° C.) is used, the glass substrate is not warped or bent due to a process carried out at not lower than the strain point.

(Data Signal Line Driver 31)

As shown in FIG. 1, the data signal line driver 31 includes the shift register 31*a*, the sampling section 31*b*, the overlap prevention section 31*c*, and the level shifter LS.

(Shift Register 31*a*)

The shift register 31*a* includes a plurality of set-reset flip-flops (pulse generating means) SR (SR1, SR2, . . . , SRn+2). Further, each of the flip-flops SR includes a CK terminal and a CKB terminal to which clock signals are inputted, a CINB terminal to which a set signal is inputted, an RB terminal to which a reset signal is inputted, a PO terminal from which a precharge signal (precharge pulse) PO (PO1, PO2, . . . , POn) is outputted, and a QB terminal from which a sampling signal (timing pulse) QB (QB1, QB2, . . . , QBn) is outputted.

The CK terminals of the odd-numbered flip-flops SR1, SR3, . . . receive the clock signal SCK, and the CKB terminals of the odd-numbered flip-flops SR1, SR3, . . . receive the inversion clock signal (clock signal) SCKB. Further, the CK terminals of the even-numbered flip-flops SR2, SR4, . . . receive the inversion clock signal (clock signal) SCKB, and the CKB terminals of the even-numbered flip-flops SR2, SR4, . . . receive the clock signal SCK.

Further, the CINB terminal of the first flip-flop SR1 receives, as a set signal, the output signal SSPB' of the level shifter LS. The CINB terminals of the second and subsequent flip-flops SR2, SR3, . . . , SRn+2 receive the sampling signals (timing pulses) QB1, QB2, . . . , QBn+1 outputted from the previous flip-flops, respectively.

Further, the RB terminals of the first to nth flip-flops SR1, SR2, . . . , SRn receive, as reset signals, the output signals QB3, QB4, . . . , QBn+2 from the flip-flops located two stages after the first to nth flip-flops SR1, SR2, . . . , SRn, respectively. Further, the RB terminal of the n+1th flip-flop SRn+1 receives the output signal QBn+2 of the n+2th flip-flop SRn+2, and the RB terminal of the n+2th flip-flop SRn+2 receives the output signal QBn+2 of the n+2th flip-flop SRn+2.

Further, the PO terminals of the first to nth flip-flops SR1, SR2, . . . , SRn are connected to delay circuits Pd (Pd1, Pd2, . . . , Pdn), provided in the overlap prevention section 31*c*, which correspond to the first to nth flip-flops SR1, SR2, . . . , SRn, respectively. The PO terminals output the precharge signals (precharge pulses) PO, respectively.

(Flip-Flop SR)

Figure 4:
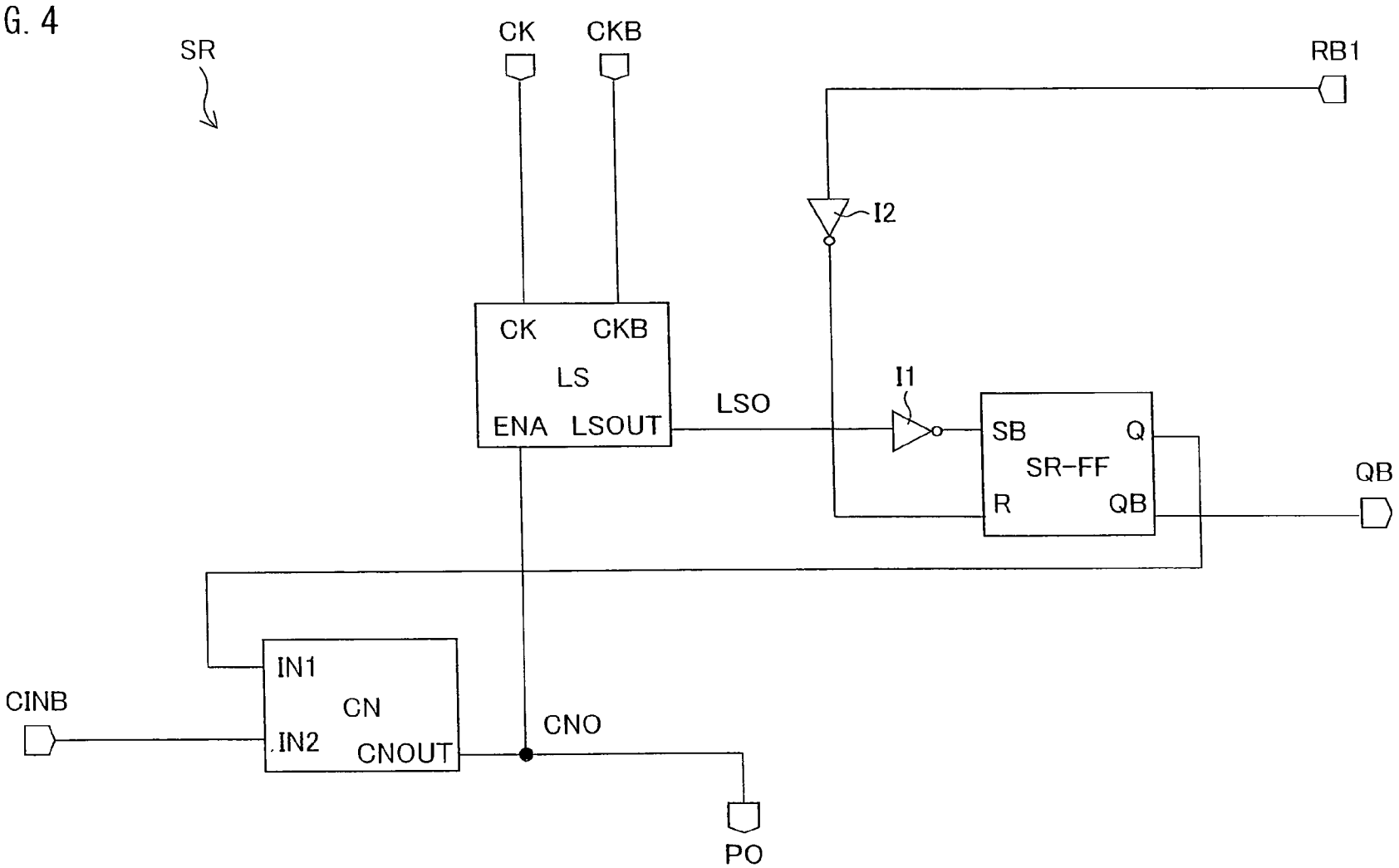
FIG. 4 is a block diagram showing a structure of a flip-flop provided in the data signal line driver according to the embodiment of the present invention.

FIG. 4 is a block diagram showing a structure of each of the flip-flops SR. As shown in FIG. 4, the flip-flop SR includes a level shifter control circuit CN, a level shifter LS1, a set-reset flip-flop SR-FF, an inverter I1, and an inverter I2.

(Level Shifter Control Circuit CN)

Figure 5:
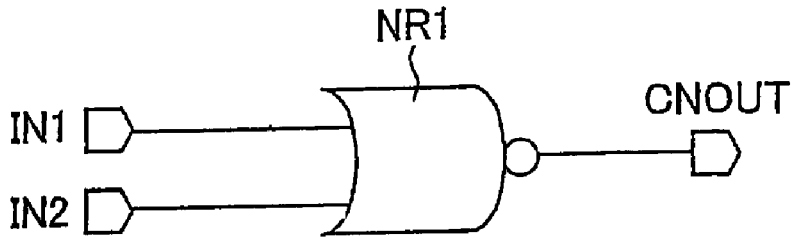
FIG. 5 is a block diagram showing a structure of a level shifter control circuit provided in the data signal line driver according to the embodiment of the present invention.

FIG. 5 is a block diagram showing s structure of the level shifter control circuit CN. As shown in FIG. 5, the level shifter control circuit CN includes a NOR circuit NR1 having two input terminals IN1 and IN2 and an output terminal CNOUT. The input terminal IN1 receives an output signal Q from the flip-flop SR-FF. The input terminal IN2 receives an input signal sent to the CINB terminal of the flip-flop SR. Moreover, the output terminal CNOUT outputs an output signal CNO to an ENA terminal of the level shifter LS1 and the PO terminal of the flip-flop SR.

(Level Shifter LS1)

Figure 6:
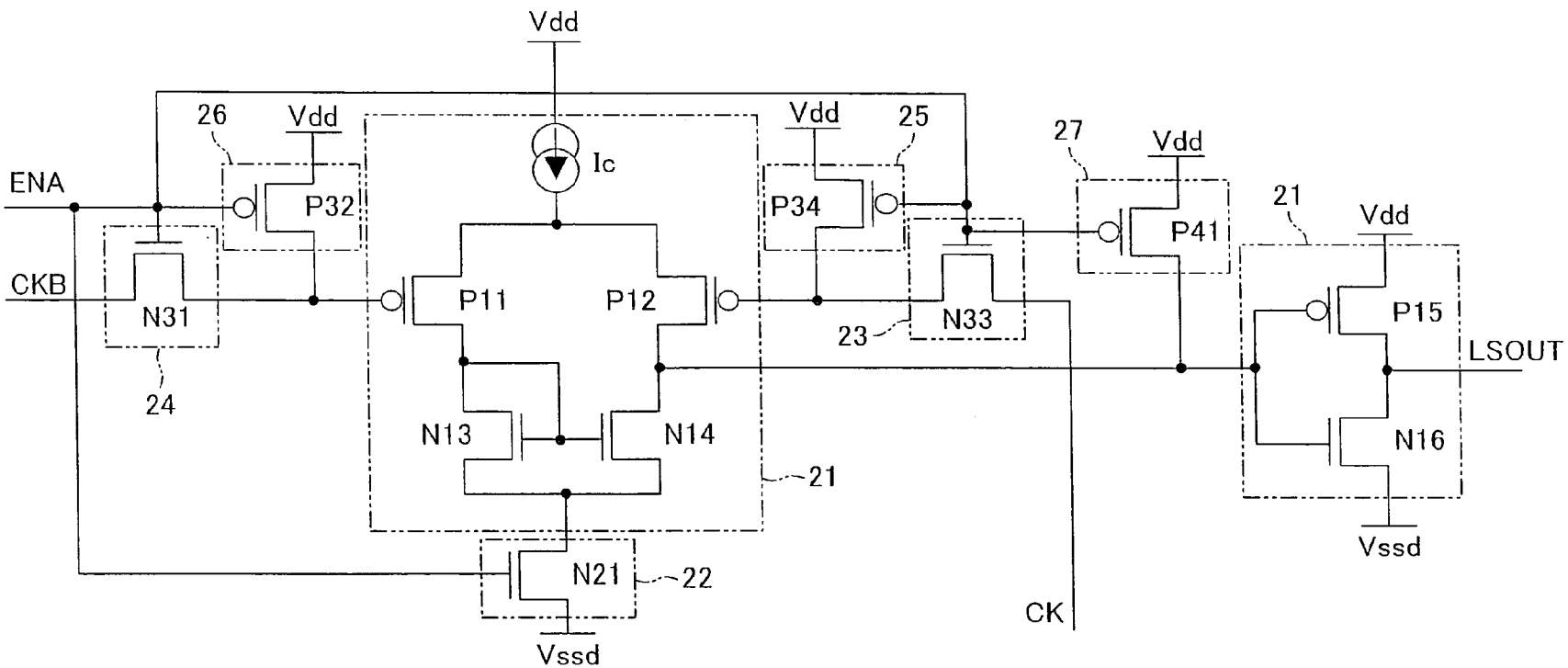
FIG. 6 is a block diagram showing a structure of a level shifter provided in the data signal line driver according to the embodiment of the present invention.

FIG. 6 is a block diagram showing an example of a structure of the level shifter LS1. The level shifter LS1 includes: a step-up/down transformer section 21 for level-shifting the clock signals SCK and SCKB; a power supply control section 22 for preventing power from being supplied to the step-up/down transformer section 21 during a stop period during which the clock signals SCK and SCKB do not need to be supplied; input control sections 23 and 24 for blocking, during the stop period, signal lines via which the clock signals SCK and SCKB are transmitted to the step-up/down transformer section 21; input signal control section 25 and 26 for blocking input switching elements (P11 and P12) of the step-up/down transformer section 21 during the stop period; and an output stabilizer section 27 for maintaining the output of the step-up/down transformer section 21 at a predetermined level during the stop period.

The step-up/down transformer section 21 is a differential input pair of an input stage. The step-up/down transformer section 21 includes: P-type MOS transistors P11 and P12, serving as the input switching elements, whose respective sources are connected to each other; a constant current source Ic from which a predetermined current is supplied to the respective sources of the transistors P11 and P12; N-type MOS transistors N13 and N14, constituting a current mirror circuit, which are connected to drains of the transistor P11 and P12, respectively, to serve as an active load; and CMOS-structured transistors P15 and N16 for amplifying the output of the differential input pair. The structure shown in FIG. 6 shows an example of level shifters LS1 to be respectively provided in the odd-numbered flip-flops SR1, SR3, . . . in each of which the input CK to the transistor P12 is directly outputted to the output LSOUT. However, in case of level shifters LS to be respectively provided in the even-numbered flip-flops SR2, SR4, . . . , the clock signals SCK and SCKB are inputted instead of each other.

To a gate of the transistor P11, the clock signal SCKB is inputted via an N-type MOS transistor N31 constituting the input control section 24. To a gate of the transistor P12, the clock signal SCK is inputted via an N-type MOS transistor N33 constituting the input control section 23. Further, the gate of the transistor P11 is designed to be pulled up to a power supply line of a high-level driving voltage Vdd via a P-type MOS transistor P32 constituting the input signal control section 26. Similarly, the gate of the transistor P12 is designed to be pulled up to the power supply line of the high-level driving voltage Vdd via a P-type MOS transistor P34 constituting the input signal control section 25. Moreover, respective gates of the transistors N31, N33, P32, P34 are supplied with the output signal CNO (enable signal ENA) inputted in common to the ENA terminal from the level shifter control circuit CN.

Therefore, when the output signal CNO from the level shifter control circuit CN becomes active (high level), the clock signals SCKB and SCK are allowed to be inputted to the transistors P11 and P12 via the transistors N31 and N33, respectively. Moreover, the transistors P32 and P34 are turned off. On the other hand, when the output signal CNO from the level shifter control circuit CN becomes nonactive (low level), the transistors N31 and N33 are turned off, so that the clock signals SCKB and SCK are prevented from being inputted. Moreover, the transistors P32 and P34 become conductive, so that the gates of the transistors P11 and P12 are pulled up to the high-level Vdd. With this, the transistors P11 and P12 of the input stage are surely turned off.

Meanwhile, a gate of the transistor N13 and a gate of the transistor N14 are connected to each other, and are connected to respective drains of the transistors P11 and N13. On the other hand, a drain of the transistor P12 and a drain of the transistor N14 are connected to each other, and serve as an output terminal that is connected to respective gates of the transistors P15 and N16. Respective sources of the transistors N13 and N14 are connected to a power supply line of a low-level driving voltage Vssd via an N-type MOS transistor N21 constituting the power supply control section 22. A gate of the MOS transistor N21 is supplied with the output signal CNO sent from the level shifter control circuit CN.

Therefore, when the output signal CNO sent from the level shifter control circuit CN becomes active (high level), the step-up/down transformer section 21 is supplied with power via the transistor N21. When the output signal CNO sent from the level shifter control circuit CN becomes nonactive (low level), the supply of power to the step-up/down transformer section 21 is stopped.

Further, the output stabilizer section 27 is a circuit that stabilizes the output signal LSOUT of the level shifter LS1 at the level of the low-level driving voltage Vssd, which output signal LSOUT is obtained in the stop period. The output stabilizer section 27 is constituted by a P-type MOS transistor P41, having a gate that is supplied with the output signal CNO sent from the level shifter control circuit CN, via which the respective gates of the transistors P15 and 16 are pulled up to the power supply line of the high-level driving voltage Vdd.

According to the level shifter LS1 arranged as described above, in cases where the output signal sent from the level shifter control circuit CN indicates an operation (high level), the transistors N21, N31, and N33 become conductive and the transistors P32, P34, and P41 are turned off. In this state, the current supplied from the constant current source Ic flows through the transistor N21 after having passed through the transistors P11 and N13 or the transistors P12 and N14. Further, the clock signals SCK and SCKB are applied to the gates of the transistors P12 and P11, respectively. As a result, the amount of current flowing through the gates of the transistors P11 and 12 corresponds to the ratio of the gate-source voltage of the transistors P11 to the gate-source voltage of the transistor P12. On the other hand, since the transistors N13 and N14 serve as an active load, the voltage of the node between the transistors P12 and N14 corresponds to the voltage level difference between the clock signals SCK and SCKB. The voltage is power-amplified by the transistors P15 and N16, and then is outputted as an output signal OUT.

The step-up/step-down transformer section 21 is not a voltage-driven type in which the transistors P12 and P11 of the input stage become conductive/nonconductive in accordance with the clock signals SCK and SCKB, respectively. The step-up/step-down transformer section 21 is a current-driven type in which the transistors P11 and P12 of the input stage are always conductive during operation. As described above, the current supplied from the constant current source Ic is divided in accordance with the ratio of the gate-source voltage of the transistor P12 to the gate-source voltage of the transistor P11. With this, even in cases where the amplitude of the clock signals SCK and the amplitude of the clock signal SCKB are lower than the threshold values of the transistors P11 and P12, respectively, the clock signals SCK and SCKB can be level-shifted without problems.

As a result, when the output signal CNO applied to the ENA terminal from the level shifter control circuit CN becomes active (high level), the level shifter LS1 outputs, even in cases where the amplitude of the clock signal SCK and the amplitude of the clock signal SCKB are lower (e.g., approximately 5 V from a circuit generating the video signal) than the difference between the high driving voltage and the low driving voltage (Vcc=Vdd−Vssd, e.g., approximately 15 V), the output signal LSOUT whose amplitude has been stepped up or down to the difference Vcc.

On the other hand, the output signal CNO from the level shifter control circuit CN is nonactive (low level) indicating an operation stoppage, the current flowing from the constant current source IC through the transistors P11 and 13 or the transistor P12 and N14 is blocked by the transistor N21. Therefore, the amount of power to be consumed due to the current can be reduced.

Further, in this state, the respective transistors N33 and N31 of the input control sections 23 and 24 are turned off. Therefore, the signal lines via which the clock signals SCK and SCKB are transmitted are disconnected from the transistors P12 and P11 of the input stage, respectively. Further, under suspension, the respective transistors P34 and P32 of the input signal control sections 25 and 26 are conductive. Therefore, the respective gate voltages of the transistors P11 and P12 are pulled up to the high-level driving voltage Vdd, so that the transistors P11 and P12 are turned off. With this, as with the case where the transistor N21 is turned off, power consumption can be reduced by the amount of current outputted by the constant current source Ic.

However, in this state, no current is supplied to the transistors P11 and P12. Therefore, the transistors P11 and P12 cannot operate as a differential input pair, so that the potential of the output terminal, i.e., of the node between the drains of the transistors P12 and N14 becomes unable to be determined. In light of this, in cases where the enable signal ENA indicates an operation stoppage, the output stabilizer section 27 becomes conductive. As a result, the potential of the output terminal, i.e., the gate potential of the transistors P15 and N16 is pulled up to the high-level driving voltage Vdd. With this, the transistor N16 becomes conductive, so that the output signal LSOUT becomes low.

Thus, while the output signal CNO sent from the level shifter control circuit CN indicates an operation stoppage, the output signal LSOUT of the level shifter LS1 is kept at a low level regardless of the clock signals SCK and SCKB.

(Flip-Flop SR-FF)

Figure 7:
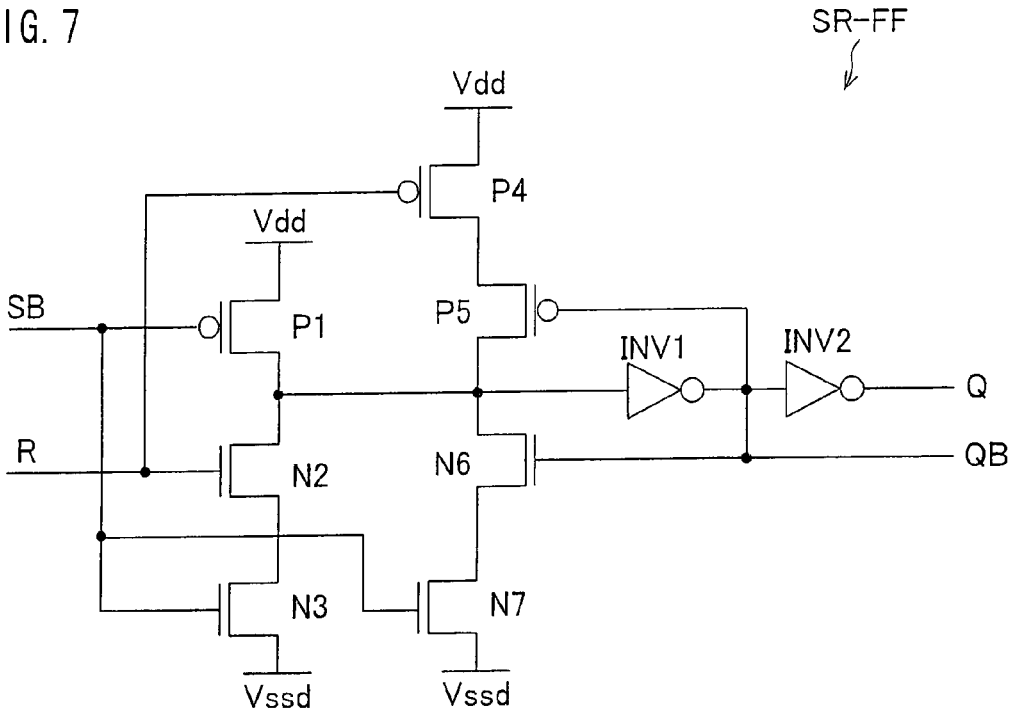
FIG. 7 is a block diagram showing a structure of a flip-flop provided in the flip-flop shown in FIG. 4.

FIG. 7 is a block diagram showing an example of a structure of the flip-flop SR-FF. As shown in FIG. 7, the flip-flop SR-FF includes a P-type MOS transistor P1 and N-type MOS transistors N2 and N3. The transistors P1, N2, and N3 are serially connected so as to be positioned between the power supply line of the high-level driving voltage Vdd and the power supply line of the low-level driving voltage Vssd.

Moreover, respective gates of the transistors P1 and N3 are connected to an SB terminal, serving as a set input terminal of the flip-flop SR-FF, which is supplied with a low active signal SB. The low active signal SB is obtained when the inverter I1 inverts the output signal LSO of the level shifter LS1.

Further, a gate of the transistor N2 is connected to an R terminal, serving as a reset input terminal of the flip-flop SR-FF, which is supplied with a high active signal R. The high active signal R is obtained when the inverter I2 inverts the output signal QB, inputted to the RB terminal of the flip-flop SR, which is outputted from a flip-flop SR located two stages after the flip-flop SR. Furthermore, the drain potential of the transistors P1 and N2 connected to each other is inverted by an inverter INV1 to be the inversion output signal QB, and is further inverted by an inverter INV2 to be an output signal Q.

Meanwhile, P-type MOS transistors P4 and P5 and N-type MOS transistors N6 and N7 are serially connected so as to be positioned between the power supply lines. Respective drains of the transistors P5 and N6 are connected to an input of the inverter INV1, and the inversion output signal QB obtained from the inverter INV1 is fed back to respective gates of the transistors P5 and N6.

Furthermore, a gate of the transistor P4 is connected to the R terminal serving as the reset input terminal of the flip-flop SR-FF, and is supplied with the signal R. Further, a gate of the transistor N7 is connected to the set input terminal of the flip-flop SR, and is supplied with the signal SB.

Figure 8:
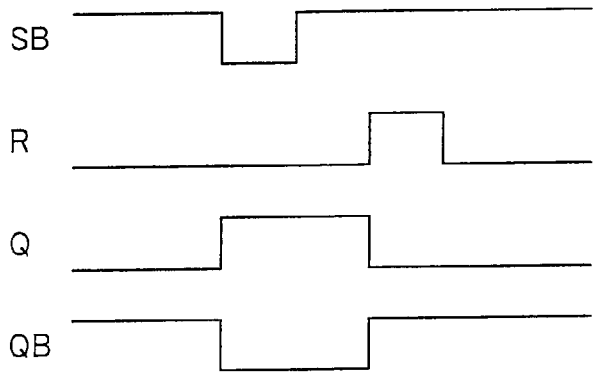
FIG. 8 is a timing chart showing signals relating to operation of the flip-flop shown in FIG. 8.

Therefore, in the flip-flop SR-FF, as shown in FIG. 8, when the set signal SB becomes active (low level) in a period during which the reset signal R is nonactive (low level), the transistor P1 becomes conductive, so that the input of the inverter INV1 is changed to a high level. With this, the output signal Q is changed to a high level, and the inversion output signal QB is changed to a low level. In this state, the reset signal R and the inversion output signal QB of the inverter INV1 cause the transistors P4 and P5 to be conductive, so that the output of the inverter INV1 is kept at the high level. Further, the reset signal R and the inversion output signal QB of the inverter INV1 causes the transistors N2 and N6 to be turned off. With this, even when the set signal SB becomes active (high level), the input of the inverter INV1 is kept at the high level. With this, the output signal Q is kept at a high level, and the inversion output signal QB is kept at the low level.

Thereafter, when the reset signal R becomes active (high level), the transistor P4 is turned off and the transistor N2 becomes conductive. Here, since the set signal SB remains nonactive (high level), the transistor P1 is turned off and the transistor N3 becomes conductive. Therefore, the input of the inverter INV1 is driven to be low. With this, the output signal Q is changed to a low level, and the inversion output signal QB is changed to a high level. This makes it possible to realize a set-reset flip-flop which sets a low active inversion output signal QB with the low active set signal SB and which resets the inversion output signal QB with a high active reset signal R.

(Operation of Flip-Flop SR)

Figure 9:
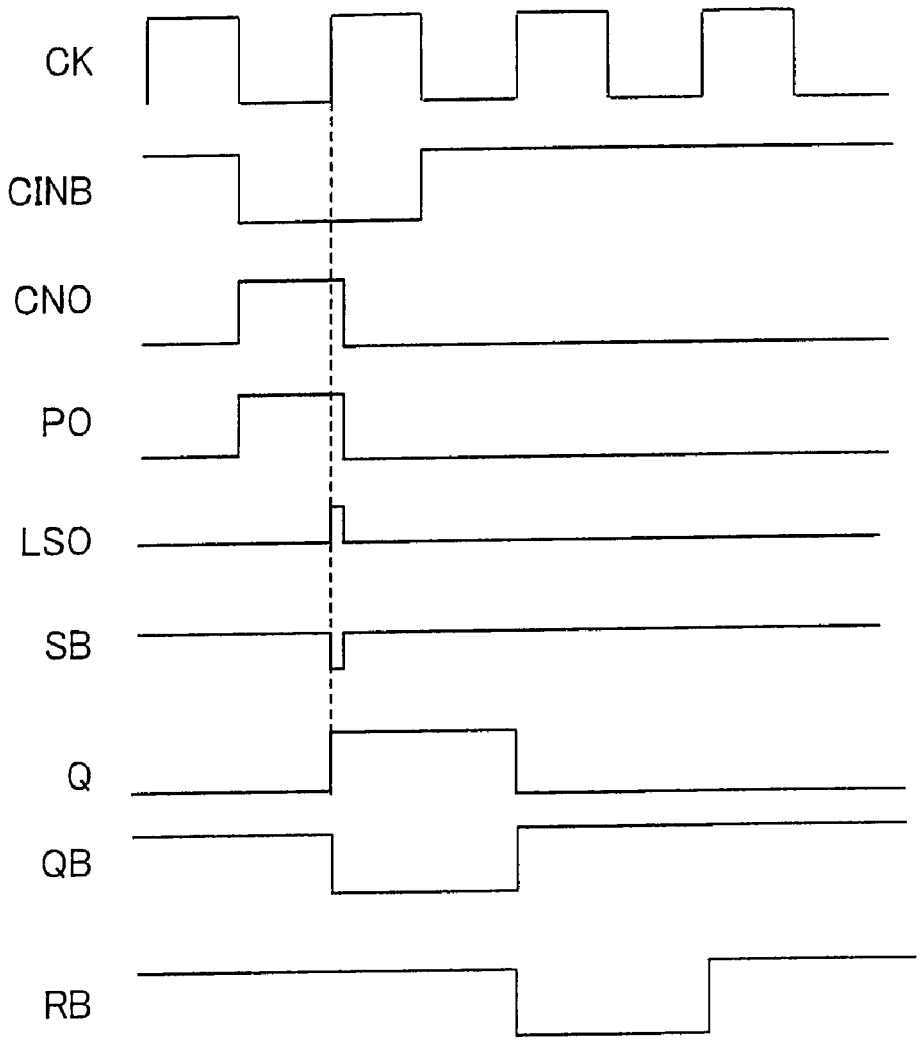
FIG. 9 is a timing chart showing signals relating to operation of the flip-flop shown in FIG. 4.

FIG. 9 is a timing chart concerning the odd-numbered flip-flops SR1, SR3, . . . . Note that the even-numbered flip-flops SR2, SR4, . . . are operated such that each of the signals shown in FIG. 9 are shifted by a half cycle with respect to the clock signal SCK. That is, as shown in FIG. 1, the inversion clock signal (clock signal) SCKB is inputted to the CK terminal of each of the even-numbered flip-flops SR2, SR4, . . . , and the clock signal SCK is inputted to the CKB terminal of each of the even-numbered flip-flops SR2, SR4, . . . . For this reason, the operation of the even-numbered flip-flops is shifted by one clock (a half cycle) of the clock signal from the operation of the odd-numbered flip-flops.

As shown in FIG. 9, at the moment the signal CINB inputted to the level shifter control circuit CN becomes low, the output Q of the flip-flop SR-FF provided in the flip-flop SR of the same stage is nonactive (low level). For this reason, the output signal CNO of the level shifter control circuit CN becomes high.

The high-level signal CNO is inputted to the ENA terminal of the level shifter LS1. Moreover, when the high-level signal CNO is inputted to the ENA terminal, the level shifter LS1 becomes capable of a level shifter operation, and outputs the output signal LSO obtained by level-shifting the input signal SCK.

Here, at the point of time where the signal inputted to the ENA terminal (the output signal CNO of the level shifter control circuit CN) becomes high, the clock signal SCK remains low, so that the output signal LSO from the level shifter LS1 remains low. Moreover, when the clock signal SCK becomes high after approximately one clock (after approximately a half cycle of the clock signal SCK), the output signal LSO of the level shifter LS1 is switched to a high level.

The high-level output signal LSO of the level shifter LS1 becomes low after having passed through the inverter I1, and then is inputted to the input terminal SB of the flip-flop SR-FF.

When the low-level signal is inputted to the SB terminal of the flip-flop SR-FF, the SR-FF is set so as to be active, so that the output signals Q and QB of the flip-flop SR-FF become high and low respectively.

Here, the output signal Q of the flip-flop SR-FF is inputted (fed back) to the level shifter control circuit CN. Therefore, at the moment the output signal Q becomes high, the output signal CNO of the level shifter control circuit CN becomes low.

When the low-level output signal CNO is inputted to the terminal ENA of the level shifter LS1, the level shifter LS1 becomes nonoperative. When the level shifter LS1 becomes nonoperative, the output signal LSO of the level shifter LS1 becomes low. Even when the output signal LSO becomes low, the output signals Q and QB of the flip-flop SR-FF continue to be active (the output signal Q at a high level; the output signal QB at a low level) until a high-level signal is inputted to the reset terminal R.

The reset terminal R of a flip-flop SR-FF receives an output signal QB, sent from a flip-flop SR located two stages after a flip-flop SR in which the flip-flop SR-FF is provided, which output signal QB has been inverted by the inverter I2. Therefore, as shown in FIG. 9, the output signals Q and QB of the flip-flop SR-FF which output signals Q and QB have become active are reset to nonactive when the clock signal SCK has been inputted by two clocks (by one cycle of the clock signal SCK).

Further, the input signal CINB inputted to the input terminal IN2 of the level shifter control circuit CN is the output signal QB of the previous flip-flop SR. Therefore, the input signal CINB becomes high after the output signals Q and QB of the flip-flop SR-FF have become active and when the clock signal SCK has been inputted by one clock (by a half clock of the clock signal SCK).

Therefore, when the output signals Q and QB of the flip-flop SR-FF have returned from an active level to a nonactive level, the input signal CINB inputted to the input terminal IN2 is already high, so that the output signal CNO from the level shifter control circuit CN remains low. With this, the level shifter LS1 becomes nonoperative, so that the output signal LSO of the level shifter LS1 remains low. For this reason, the output signals Q and QB of the flip-flop SR-FF are surely kept at a nonactive level (the output signal Q at a low level; the output signal QB at a high level).

Further, the output signal CNO, shown in the timing chart of FIG. 9, which is outputted from the level shifter control circuit CN is inputted to the delay circuit Pd (Pd1, Pd2, . . . , Pdn) of the same stage of the overlap prevention section 31*c* as the precharge pulse (precharge signal) PO (PO1, PO2, . . . , POn).

As described above, according to the flip-flop SR, the output signal Q is fed back to the level shifter control circuit CN, so that the output signal CNO of the level shifter control circuit CN becomes high before the output signal QB becomes active (low level). Therefore, by using the output signal CNO of the level shifter control circuit CN as the precharge signal PO, precharge can be performed prior to the QB serving as a sampling pulse.

Figure 10:
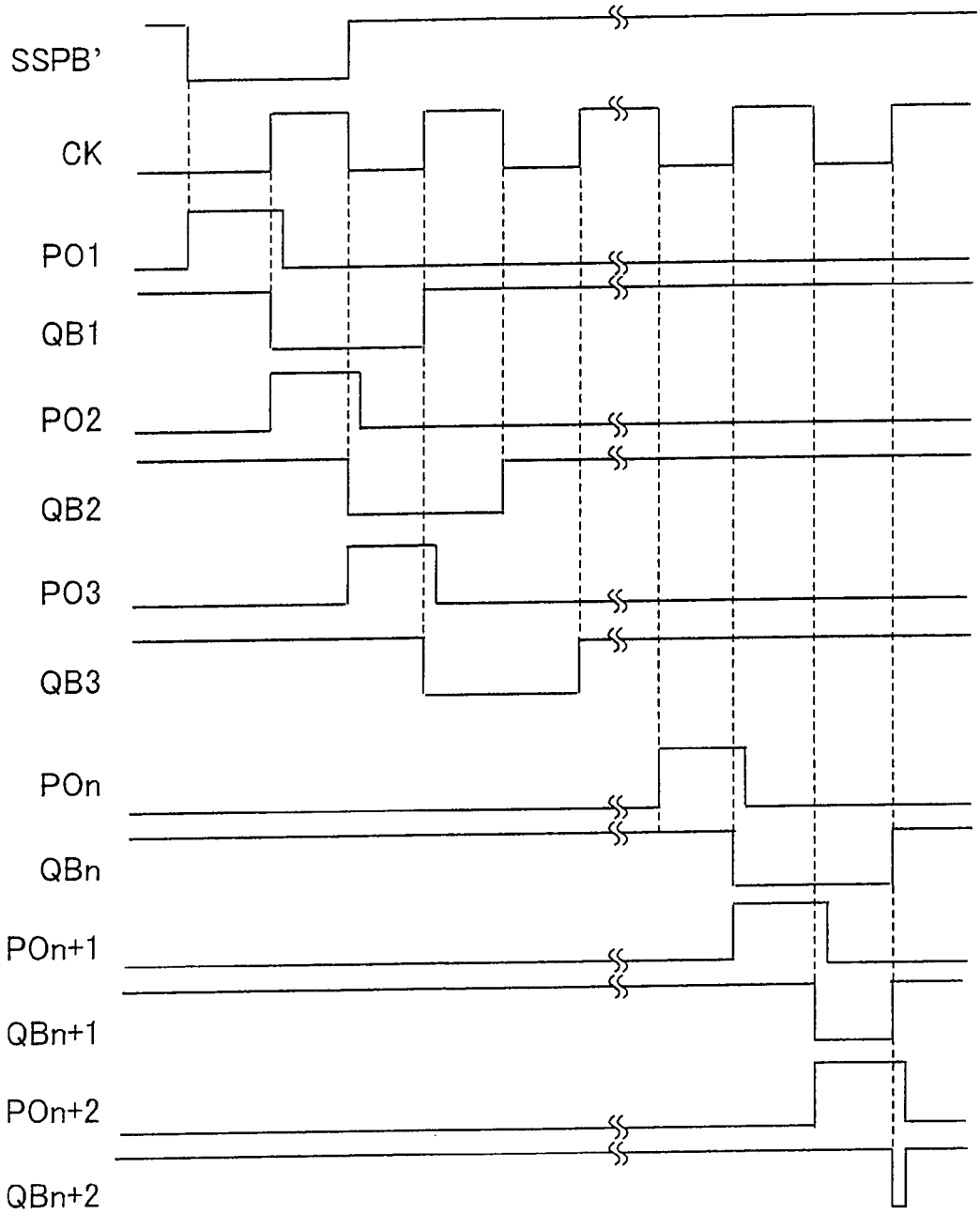
FIG. 10 is a timing chart showing signals relating to operation of a shift register section including the flip-flop shown in FIG. 4.

FIG. 10 is a timing chart showing respective waveforms of the output signals of each of the flip-flops SR1, SR2, . . . , SRn.

As shown in FIG. 10, according to the first flip-flop SR1, when the output signal SSPB' inputted from the level shifter LS to the CINB terminal is changed from a high level to a low level, the output signal PO1 from the PO terminal becomes high. Moreover, when the clock signal SCK is changed from a low level to a high level, the output signal QB1 from the QB terminal is switched from a high level to a low level. Further, as described above, the output signal Q1 is fed back to the level shifter control circuit CN. Therefore, the output signal PO1 from the PO terminal becomes low when the output signal QB1 becomes low (the output signal Q1 becomes high).

Further, the output signal QB1 of the flip-flop SR1 is inputted to the CINB terminal of the second flip-flop SR2. Therefore, when the output signal QB1 becomes low, the output signal PO2 from the terminal PO of the second flip-flop SR2 becomes high. Thereafter, when the clock signal SCK becomes low (the clock signal SCKB becomes high), the output signal QB2 from the QB terminal is switched from a high level to a low level. With this, the output signal PO2 from the PO terminal becomes low.

Further, the output signal QB2 of the flip-flop SR2 is inputted to the CINB terminal of the third flip-flop SR3. Therefore, when the output signal QB2 becomes low, the output signal PO3 from the PO terminal of the third flip-flop SR3 becomes high. Thereafter, when the clock signal SCK is changed from a low level to a high level, the output signal QB3 from the QB terminal is switched from a high level to a low level. With this, the output signal PO3 from the PO terminal becomes low. Here, the output signal QB3 of the third flip-flop SR3 is inputted to the RB terminal of the first flip-flop SR1. Therefore, when the output signal QB3 of the third flip-flop SR3 is switched to a low level, the output signal QB1 of the first flip-flop SR1 is reset to a high level.

The same is equally true of the subsequent flip-flops SRFF. That is, the same operation is carried out until that output signal QBn of the nth flip-flop SRn which has become low is reset to a high level when an output signal QBn+2 of the n+2th flip-flops SRn+2 becomes low. Note that the n+1th and n+2th flip-flops serve as dummy circuits for outputting timings for resetting the output signals QBn−1 and QBn of the n−1th and n−2th flip-flops, respectively.

(Overlap Prevention Section 31*c*)

As shown in FIGS. 9 and 10, there is a period of overlap between the active period (high-level period) of the precharge output signal PO sent from each of the flip-flop SR and the active period (low-level period) of the sampling output signal QB sent from the flip-flop SR. For this reason, when each source bass line is precharged and sampled by directly using the output signals PO and QB of the flip-flop SR, a wire via which the video signal VIDEO is supplied and a wire via which the precharging potential PVID is supplied are electrically connected to each other via the source bass line in a short circuit manner.

In light of this, the data signal line driver 31 is provided with the overlap prevention section 31*c* for preventing the output signals PO and QB of each of the flip-flops SR from overlapping each other.

The overlap prevention section 31*c* includes delay circuits Pd (Pd1, Pd2, . . . , Pdn), buffer circuits Pb (Pb1, Pb2, . . . , Pbn) (delay means), and NOR circuits NOR (NOR1, NOR2, . . . , NORn) serving as overlap elimination circuits (overlap eliminating means).

Figure 11:
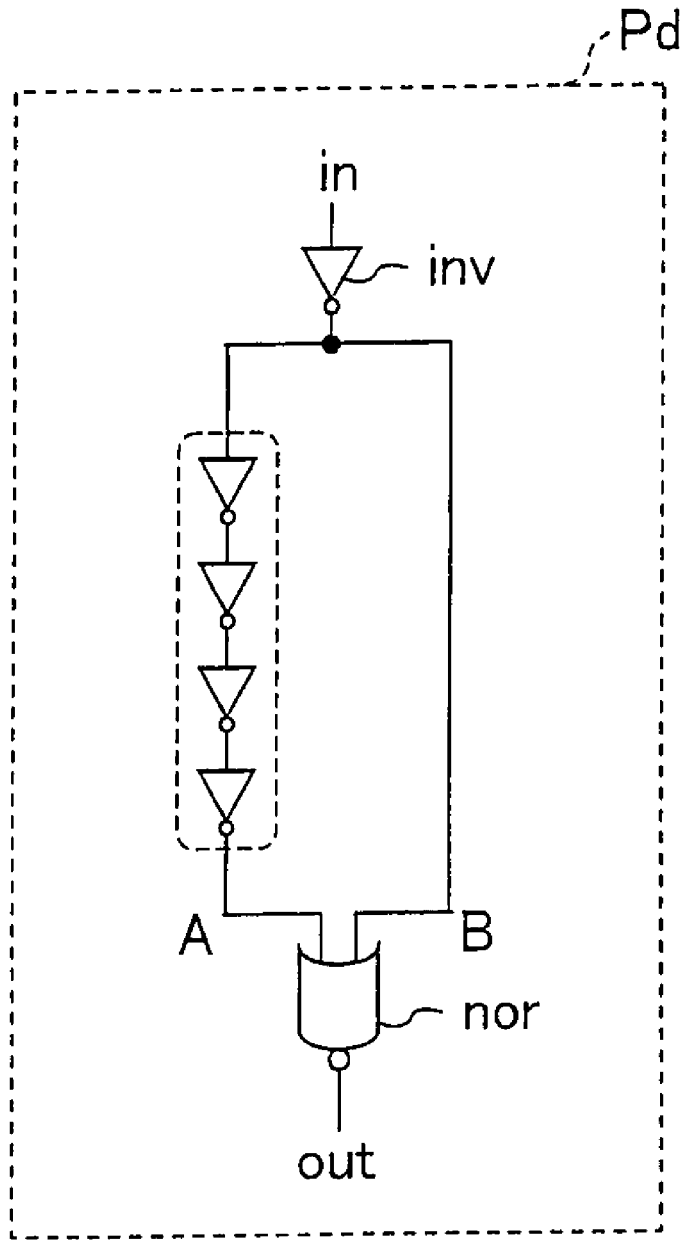
FIG. 11 is a block diagram showing a structure of a delay circuit provided in an overlap prevention section of the data signal line driver according to the embodiment of the present invention.
Figure 12:
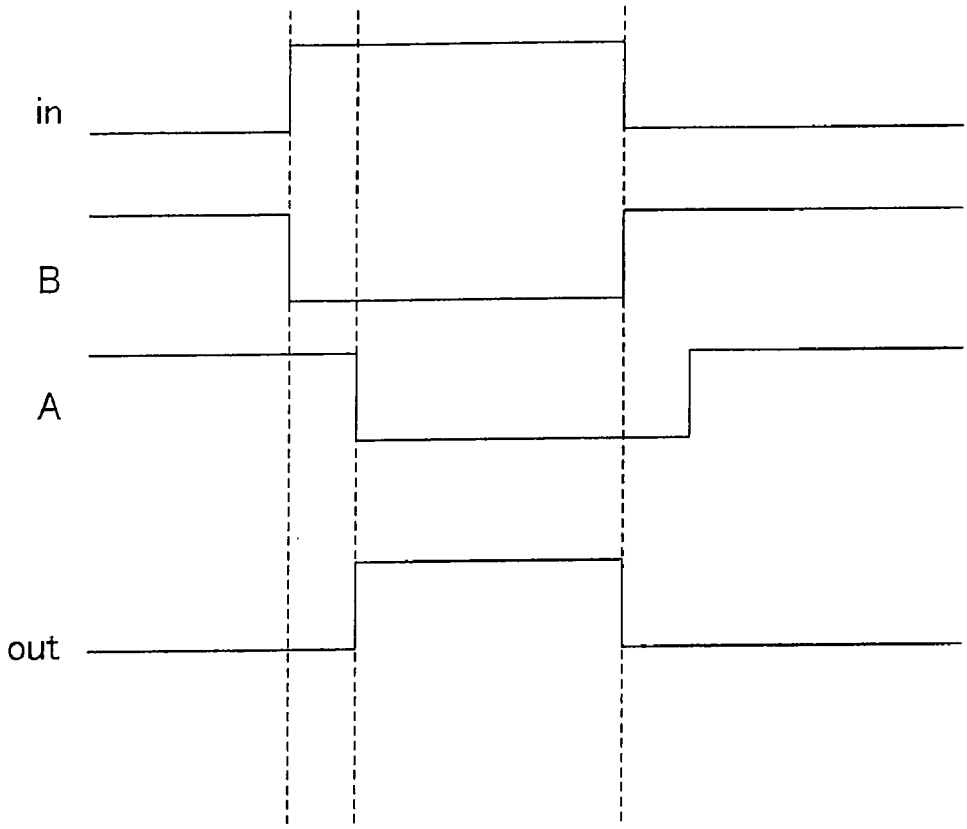
FIG. 12 is a timing chart showing signals relating to operation of the delay circuit shown in FIG. 11.

FIG. 11 is a block diagram showing a structure of each of the delay circuit Pd. As shown in FIG. 11, according to the delay circuit Pd, an input signal in is divided into signals A and B after having been inverted by an inverter circuit inv. The signal B is directly inputted to a NOR circuit nor. The signal A is delayed by passing through a plurality of serially connected inverter circuits, and then is inputted to the NOR circuit nor. As shown in the timing chart of FIG. 12, the output signal out of the delay circuit Pd has a falling pulse edge (back end) coinciding with the falling pulse edge of the input signal in, and has a rising pulse edge (front end) that is so delayed as to be later than the rising pulse edge of the input signal in.

The delay circuits Pd are connected to precharge pulse PSMP (PSMP1, PSMP2, . . . , PSMPn) output lines connected to the terminals PO of the flip-flop SR1, SR2, . . . , SRn of the shift register 31*a*, respectively. Note that the delay circuits Pd1, Pd2, . . . output output signal DO1, DO2, . . . to the corresponding buffer circuits Pb1, Pb2, . . . , respectively.

Figure 13:
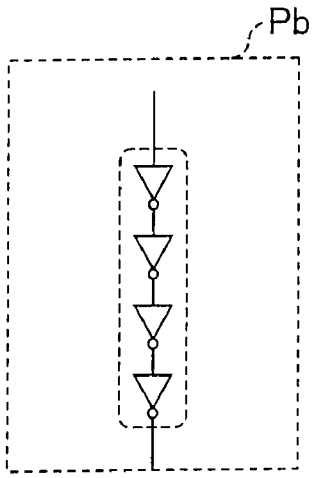
FIG. 13 is a block diagram showing a structure of a buffer circuit provided in the overlap prevention section of the data signal line driver according to the embodiment of the present invention.

Each of the buffer circuits Pb is a circuit for amplifying the current of an input signal. For example, as shown in FIG. 13, the buffer circuit Pb is a buffer in which a plurality (four in FIG. 13) of inverter circuits are serially connected. The buffer circuits Pb1, Pb2, . . . output output signals (precharge pulses) PSMP1, PSMP2, . . . , respectively, which are inputted to the sampling section 31*b*.

Further, the output signal PSMP (PSMP1, PSMP2, . . . , PSMPn) of each of the buffer circuits Pb is also inputted to one input terminal of each of the NOR circuits NOR1, NOR2, . . . , NORn. Moreover, the output signals QB1, QB2, . . . , QBn of the flip-flop SR1, SR2, . . . , SRn of the shift register 31*a* are inputted to the other input terminals of the NOR circuits NOR1, NOR2, . . . , NORn, respectively.

The NOR circuits NOR1, NOR2, . . . , NORn output output signals NOUT1, NOUT2, . . . , NOUTn, which are inputted to corresponding buffer circuits Sb1, Sb2, . . . , Sbn, respectively. Moreover, the buffer circuits Sb1, Sb2, . . . , Sbn output sampling signals (timing pulses) SMP1, SMP2, . . . , SMPn, respectively, which are inputted to the sampling section 31*b*.

Figure 14:
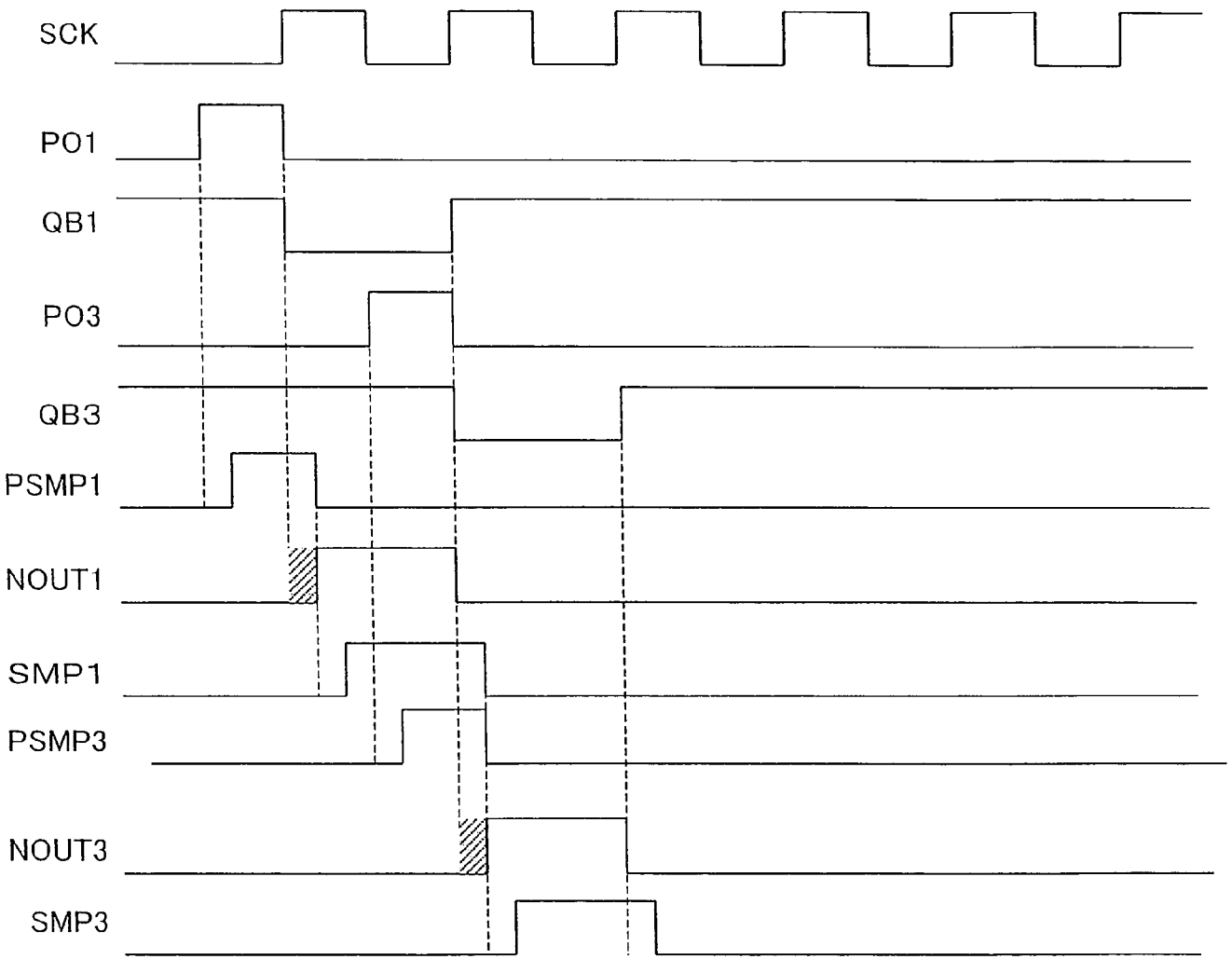
FIG. 14 is a timing chart concerning the overlap prevention section of the data signal line driver according to the embodiment of the present invention.

FIG. 14 is a timing chart concerning the overlap prevention section 31*c*. As shown in FIG. 14, the output signal PO1 from the terminal PO of the first flip-flop SR1 is delayed by the delay circuit Pd1 and the buffer circuit Pb1, and is outputted as the output signal PSMP1.

The output signal PSMP1 is inputted to one input terminal of the NOR circuit NOR1. Further, the output signal QB1 from the terminal QB of the first flip-flop SR1 is inputted to the other input terminal of the NOR circuit NOR1. Therefore, in cases where the output signal PSMP1 of the buffer circuit Pb1 and the output signal QB1 from the terminal QB of the flip-flop SR1 both become low, the output signal NOUT1 of the NOR circuit NOR1 becomes high. In other cases, the output signal NOUT1 becomes low.

With this, the NOR circuit NOR1 outputs the output signal NOUT1 obtained by eliminating that portion (see the shaded area of FIG. 11) of the output signal QB of the first flip-flop SR1 which overlaps the output signal PSMP1 of the buffer circuit Pb1 and by inverting the output signal QB.

Moreover, the output signal NOUT1 of the NOR circuit NOR1 is inputted to the buffer circuit Sb1, delayed, and outputted to the sampling section 31*b* as the output signal SMP1.

With this, as shown in FIG. 14, that portion of the active period (low-level period) of the output signal QB1 of the first flip-flop SR1 which overlaps the active period (high-level period) of the precharge signal PSMP1 is eliminated by the NOR circuit NOR1, and is made to be a nonactive period (low-level period). Furthermore, the output signal QB1 is inverted to be the signal NOUT1. Then, the signal NOUT1 is delayed and outputted by the buffer circuit Sb1 to be the sampling signal SMP1. Therefore, the active period of the precharge signal PSMP1 and the active period of the sampling signal SMP1 do not overlap each other.

The same is equally true of each of the flip-flop SR. That is, an active period of the precharge signal PSMP (PSMP1, PSMP2, . . . ) and an active period of the sampling signal SMP (SMP1, SMP2, . . . ) are prevented from overlapping each other.

Thus, the overlap elimination circuit (overlap prevention section) 31*c* eliminates that portion of an active period of the output signal QB of each of the flip-flop SR which overlaps an active period of the precharge pulse PSMP, and generates a timing pulse SMP that is to be inputted to the sampling section 31*b*. With this, even if such a flip-flop output is used that a back end (falling edge) of the precharge pulse PSMP and a front end (rising edge) of the timing pulse SMP are synchronized with each other, it is possible to surely prevent the back end of the precharge pulse PSMP and the front end of the sampling pulse SMP from overlapping each other. This makes it possible to surely prevent the video signal VIDEO and the precharging potential PVID from colliding with each other on the data signal line SL (SL1, SL2, . . . , SKn).

Incidentally, that output signal QBi of the ith (i is an integer of 1 to n) flip-flop SRi which has become active (low level) is reset to nonactive (high level) when that output signal QBi+2 of the i+2th flip-flop SRi+2 which is at a low level is inputted to the RB terminal of the flip-flop SRi. For this reason, as shown in FIG. 14, there is a period during which a front end (falling edge) of the output signal QBi+2 of the flip-flop SRi+2 and a back end (rising edge) of the output signal QBi of the flip-flop SRi almost coincide with each other or slightly overlap each other.

Meanwhile, when sampling signals (timing pulses) of different data signal lines (source bass lines) overlap, the same video signal VIDEO is shared by the different data signal lines. This causes such a problem that noise appears on the screen.

In order to solve this problem, in the data signal line driver 31, that portion of the active period of the output signal QB of each of the flip-flops SR which overlaps the active period of the precharge signal PSMP is eliminated by the NOR circuit NOR. Here, the precharge signal PSMP is obtained when the output signal PO of the flip-flop SR is delayed by the delay circuit Pd and the buffer circuit Pb, and the amount of delay (duration of delay) is longer than a period of overlap (duration of overlap) between the active period of the output signal QBi of the ith flip-flop SRi and the active period of the output signal QBi+2 of the i+2th flip-flop SRi+2.

This makes it possible to surely eliminate a period of overlap between the sampling signal SMPi to the ith data signal line SLi and the sampling signal SMPi+2 to the i+2th data signal line SLi+2. For example, as shown in FIG. 14, the active period of the sampling signal SMP1 to the first data signal line SL1 and the active period of the sampling signal SMP3 to the third data signal line SL3 do not overlap each other. This makes it possible to also prevent the sampling signals (timing pulses) SMP from overlapping each other. Therefore, deterioration in image quality can be surely prevented.

(Sampling Section 13*b*)

Figure 15:
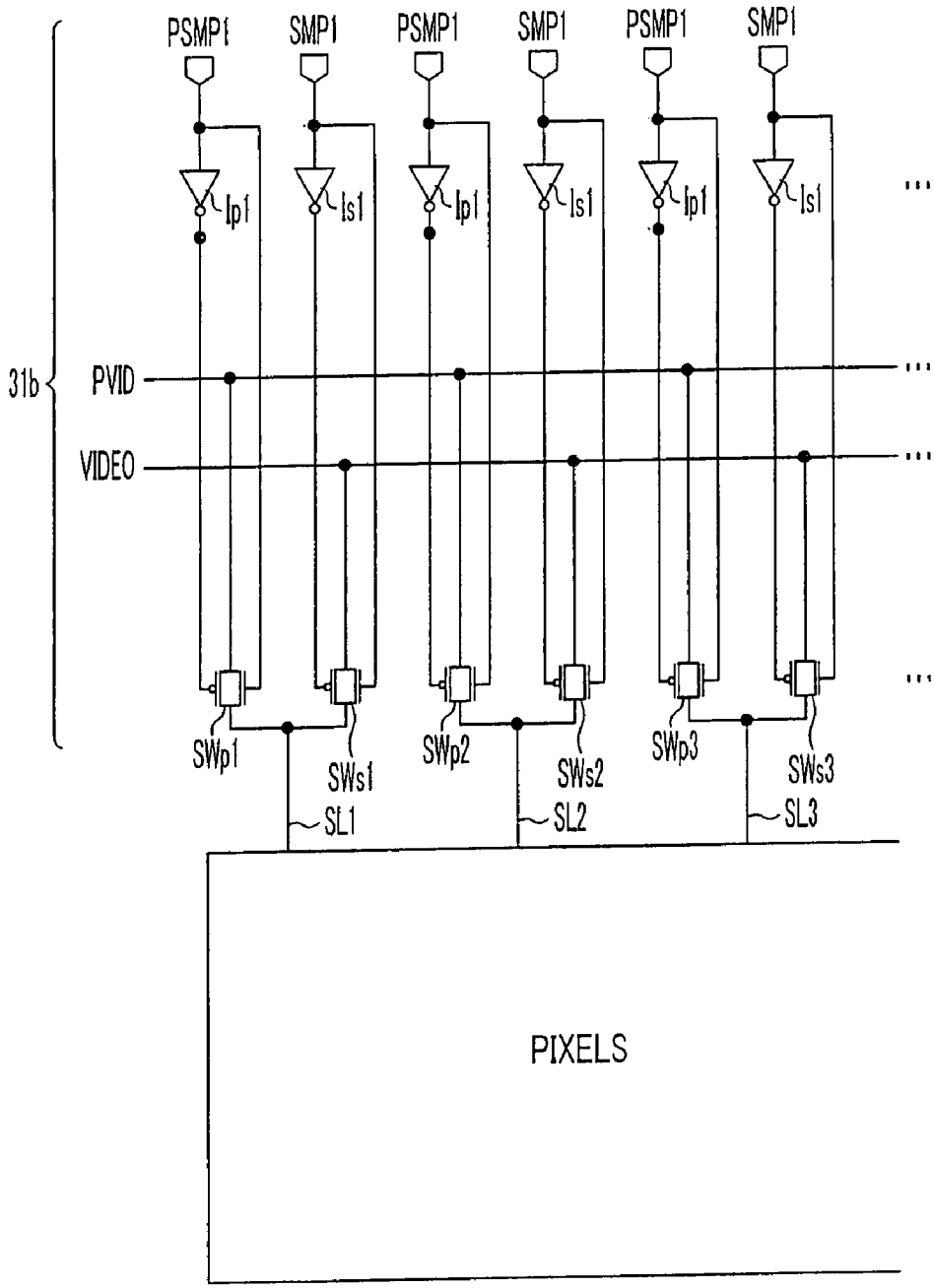
FIG. 15 is a block diagram showing an example of a structure of a sampling section of the data signal line driver according to the embodiment of the present invention.

FIG. 15 is a circuit diagram showing an example of a structure of the sampling section 31*b*. As shown in FIG. 15, the sampling section (writing circuit, precharge circuit) 31*b* includes (i) a precharge circuit constituted by inverters Ip (Ip1, Ip2, . . . , Ipn) and switches (second switches) SWp (SWp1, SWp2, . . . , SWpn) and (ii) a write circuit constituted by inverters Is (Is1, Is2, . . . , Isn) and switches (second switches) SWs (SWs, SWs2, . . . , SWsn).

Each of the switches SWs is an analog switch including (i) an N-channel MOS transistor (TFT) having a gate (first control terminal) to which an input signal is directly inputted and (ii) a P-channel MOS transistor (TFT) having a gate to which a signal obtained by inverting the input signal is inputted.

Each of the inverters Is inverts a sampling signal SMP inputted thereto, and inputs the inverted signal to a gate of a P-channel MOS transistor of the corresponding switch SWs while allowing the gate to have such a capacitance as to be sufficiently capable of charge and discharge. (The inverter Is inverts the input signal, and may be considered to have part of the function of the buffer circuit Sb of the overlap prevention section 31*c*.) Note that the sampling signals SMP inputted to the switches SWs are outputted from the buffer circuits Sb of the overlap prevention section 31*c*, respectively.

Each of the MOS transistors has a gate that is a capacitive control terminal, and each of the switches SWs becomes conductive or nonconductive in accordance with the charging voltage of the gate. To one end of a channel path of each of the switches SWs, an analog video signal (write signal) VIDEO is supplied from outside.

Each of the switches SWp is an analog switch including (i) an N-channel MOS transistor (TFT) having a gate (second control terminal) to which an input signal is directly inputted and (ii) a P-channel MOS transistor (TFT) having a gate to which a signal obtained by inverting the input signal is inputted.

Each of the inverters Ip inverts a precharge signal PSMP inputted thereto, and inputs the inverted signal to a gate of a P-channel MOS transistor while allowing the gate to have such a capacitance as to be sufficiently capable of charge and discharge. (The inverter Ip inverts the input signal, and may be considered to have part of the function of the buffer circuit Pb of the overlap prevention section 31*c*.) Note that the sampling signals PSMP inputted to the switches SWp are outputted from the buffer circuits Pb of the overlap prevention section 31*c*, respectively.

Each of the MOS transistors has a gate that is a capacitive control terminal, and each of the switches SWp becomes conductive/nonconductive in accordance with the charging voltage of the gate. To one end of a channel path of each of the switches SWp, a precharging potential PVID applied from outside is supplied.

Further, the other end of the channel path of each of the switches SWs and the other end of the channel path of each of the switches SWp are connected to a data signal line (signal supply line) SL (SL1, SL2, . . . , SLn) provided in a liquid crystal display panel.

With this, when the precharge signal PSMPi becomes active (high level), the switch SWpi becomes conductive (hereinafter, the expression "a switch becomes conductive or nonconductive" is used). As a result, the precharging potential PVID is applied to the data signal line SLi, so that the data signal line SLi and the pixel capacitor being selected are precharged. Here, as described above, the overlap prevention section 31*c* causes the sampling signal SMPi to be surely nonactive during the active (high-level) period of the precharge signal PSMPi. Therefore, the switch SWsi is surely nonconductive, so that the precharging potential PVID and the video signal VIDEO do not collide with each other on the data signal line SLi.

Moreover, when the sampling signal SMPi becomes active (high level), the switch SWsi becomes conductive. With this, the video signal VIDEO is supplied to the data signal line SLi, so that the data signal line SLi and the pixel capacitor are charged so as to have a predetermined voltage. That is, the video signal VIDEO is sampled, so that a sampling effective period (writing effective period) is started. The sampling effective period is a period, contained in the predetermined cycle, during which the data signal lines sequentially fall in their respective sampling periods. On this occasion, since the precharge signal PSMPi is surely nonactive, the switch SWpi is nonconductive, so that the precharging potential PVID and the video signal VIDEO do not collide with each other on the data signal line SLi.

Thus, sampling is performed in a dot-sequential manner by sequentially repeating an operation of supplying the video signal VIDEO to the data signal line SLi that has been precharged. Here, the sampling periods occurring before and after one another overlap one another by a half cycle of the clock signals SCK and SCKB. In this case, the sampling potential is determined in accordance with the respective charging potentials of the pixel capacitor and the data signal line which charging potentials are obtained at a falling edge (back end) of a timing pulse in each sampling period.

As described above, in the data signal line driver 31, signals of each flip-flop SRi is used for precharging a data signal line and a pixel capacitor each corresponding to the flip-flop SRi. For this reason, unlike in a conventional example, no dummy stage is required as the first stage of a shift register. Therefore, the size of the data signal line driver 31 and the size of a wiring region in which wires are provided are reduced. With this, the outer size of the panel can be reduced, and the ratio of the size of a display region to the size of the outer size of the panel can be increased.

Further, in the data signal line driver 31, since the output signals DO1, DO2, . . . from the delay circuits Pd are delayed by the buffer circuits Pb for amplifying the currents of the precharge pulses, the back end of the active period of the output signal PSMP outputted from the buffer circuit Pb as a final precharge pulse overlaps the front end of the active period of the output signal QB sent from the flip-flop SR. For this reason, in the NOR circuits NOR1, NOR2, . . . , that portion of the active period of the timing pulse SMP which overlaps the active period of the precharge pulse can be surely eliminated.

Further, the delay circuits Pd is designed to minimize a delay of a back end of a signal. However, a signal is delayed as long as it passes through a circuit. For this reason, the delay of the back end of a signal by the delay circuit Pd as well as the delay of a signal by the buffer circuit Pb contributes to eliminating overlap between a precharge pulse and a timing pulse and overlap between timing pulses.

In cases where the amount by which the precharge pulse PSMP inputted to the NOR circuit NOR is delayed with respect to the output signal PO sent from the flip-flop SR is not sufficient to prevent overlap between timing pulses SMP by eliminating the front ends of the timing pulses, a delay inverter circuit may be added in front of the delay circuit Pd or in front of the buffer circuit Pb. Alternatively, a delay inverter circuit may be added to an output line via which the output signal PSMP from the buffer circuit Pb is inputted to the NOR circuit NOR.

Further, overlap between an front end of a precharge pulse PSMP or timing pulse SMP and a back end of a timing pulse SMP to another data signal line exerts a great influence on display. The reason for this is as follows. That is, the front ends of these pulses mean that the switch SWp or SWs becomes conductive. When these switches SWp and SWs become conductive, the data signal line SL is yet to be sufficiently charged. Therefore, at the moment the switches SWp and SWs become conductive, there are great fluctuations in potential in that portion of the data signal line which has a capacitor or which is connected. Therefore, in addition to the function of preventing overlap between precharge pulses PSMP, the delay circuit Pd also has a function of preventing overlap between a front end of a precharge pulse PSMP and a back end of a timing pulse SMP.

Furthermore, in the data signal line driver 31, the precharge pulses PSMP are obtained by delaying the active periods of the output signals PO1, PO2, . . . of the flip-flops SR1, SR2, . . . , respectively, so that there is no overlap between the precharge pulses PSMP. This makes it possible to surely avoid such a situation that: even data signal lines that are not supposed to be charged simultaneously are connected to the precharging potential PVID, so that the precharge power supply becomes short of driving capability. Therefore, the foregoing arrangement makes it possible to surely precharge the data signal lines SL one by one.

Further, the sampling effective period described above is a period between the start of sampling in the first signal data line SL1 and the end of sampling in the last data signal line SLn. Moreover, during this period, a data signal line in which sampling is not performed is precharged when the output signal of each flip-flops SR is outputted to the sampling section 31*b* via the delay circuit Pd and the buffer circuit Pb, when the control terminal of the switch SWp of the sampling section 31*b* is charged, and when the switch SWp becomes conductive. The output signal PO of each flip-flop SR is generated by the output signal QB (or the inversion amplification signal SSPB' of the start pulse SSP) sent from the previous flip-flop SR and the output signal Q of the flip-flop SR.

That is, each flip-flop SRi outputs an active-level precharge output signal PO in cases where the output signal QB of the previous flip-flop SRi−1 is active (or the start pulse SSP is active) and the output signal Qi of the flip-flop SRi is nonactive. Moreover, when the active-level precharge signal PO is outputted via the delay circuit Pd and the buffer circuit Pb, the data signal line SLi can be precharged in a line-sequential manner.

Further, on this occasion, the system in which the sampling timing pulses SMP are supplied and the system in which the precharge signal PSMP are supplied are separated from each other. Therefore, the switch SWs and the switch SWp do not share a control signal circuit. With this, a high current, accompanying precharge, which flows through a data signal line SL can be prevented from oscillating, via the capacitive control terminal of the switch SWp, the potential of the video signal VIDEO of the data signal line SL in which the video signal is being written.

MODIFIED EXAMPLE

Modified Example of the Sampling Section 31*b*

The present embodiment explains a liquid crystal display device arranged such that a single data signal line (signal supply line) is provided for a pair of a precharge signal PSMP and a sampling signal SMP (a pair of an output line via which the precharge signal PSMP is outputted and an output line via which the sampling signal SMP is outputted). However, the present invention is not limited to this.

For example, data signal lines respectively corresponding to three colors (R, G, and B) may be provided for a pair of a precharge signal PSMP and a sampling signal SMP. In this case, the sampling section 31*b* may be replaced, for example, by a sampling section 31*b*' shown in FIG. 16.

Figure 16:
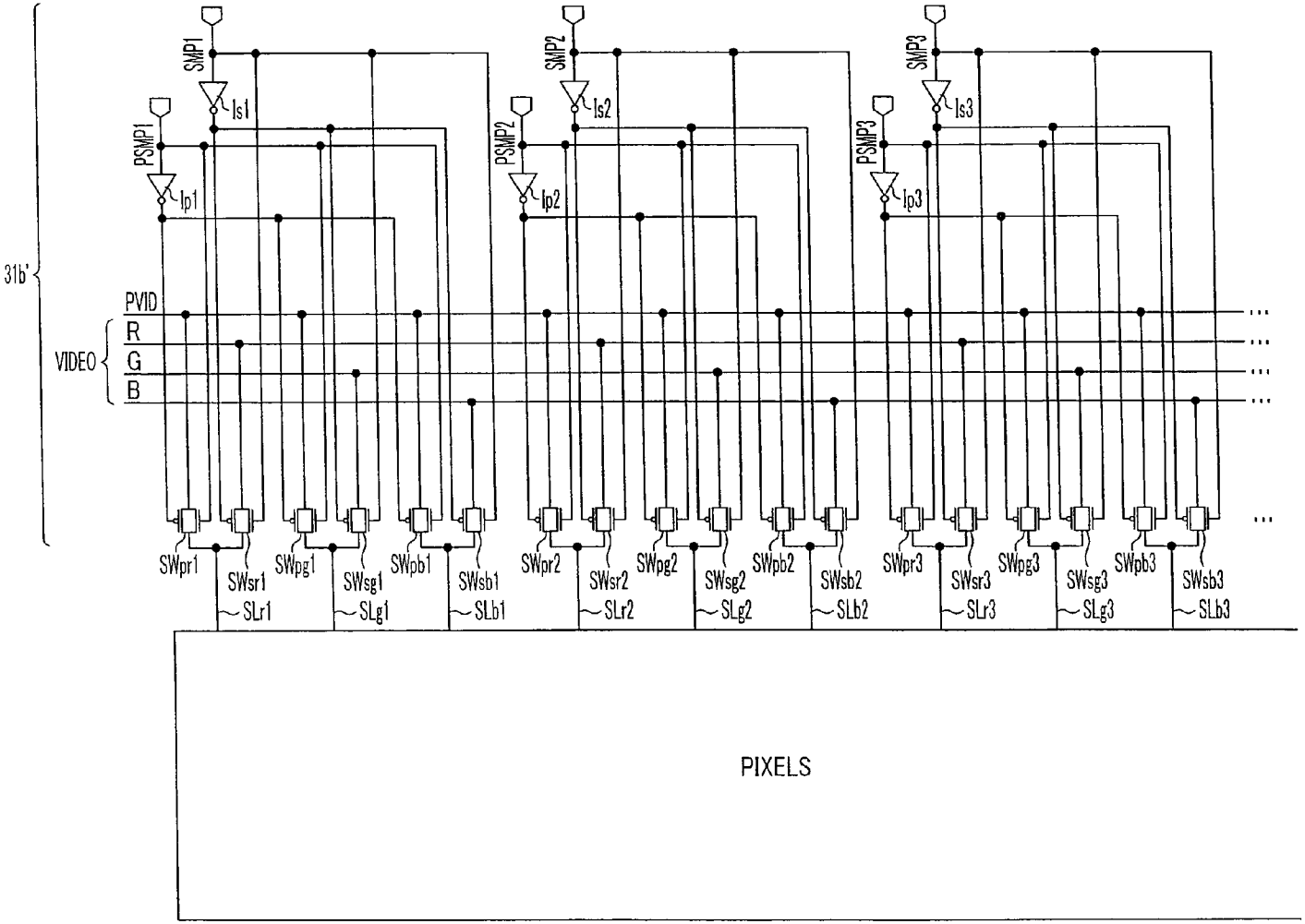
FIG. 16 is a block diagram showing another example of the structure of the sampling section of the data signal line driver according to the embodiment of the present invention.

The sampling section (write circuit, precharge circuit) 31*b*' shown in FIG. 16 shows an example of an arrangement in which no phase expansion is performed, i.e., in which a pair of a precharge signal PSMP and a sampling signal SMP is used for charging three data signal lines respectively corresponding to R (red), G (green), and B (blue) (e.g., used for causing three pixels to carry out a display).

The sampling section (write circuit, precharge circuit) 31*b*' includes (i) a precharge circuit constituted by inverters Ip (Ip1, Ip2, . . . , Ipn), switches SWpr (SWpr1, SWpr2, . . . , SWprn), switches SWpg (SWpg1, SWpg2, . . . , SWpgn), and switches SWpb (SWpb1, SWpb2, . . . , SWpbn) and (ii) a write circuit constituted by inverters Is (Is1, Is2, . . . , Isn), switches SWsr (SWsr1, SWsr2, . . . , SWsrn), switches SWsg (SWsg1, SWsg2, . . . , SWsgn), and switches SWsb (SWsb1, SWsb2, . . . , SWsbn).

Each of the switches SWsr, SWsg, and SWsb is an analog switch including an N-channel MOS transistor (TFT) having a gate (first control terminal) to which an input signal is directly inputted and a P-channel MOS transistor (TFT) having a gate to which a signal obtained by inverting the input signal is inputted.

Each of the inverters Is inverts a sampling signal SMP inputted thereto, and inputs the inverted signal to a gate of a P-channel MOS transistor of each of the corresponding switches SWsr, SWsg, and SWsb while allowing the gate to have such a capacitance as to be sufficiently capable of charge and discharge. (The inverter Is inverts the input signal, and may be considered to have part of the function of the buffer circuit Sb of the overlap prevention section 31*c*.) Note that the sampling signals SMP inputted to the groups of switches SWsr, SWsg, and SWsb are outputted from the buffer circuits Sb of the overlap prevention section 31*c*, respectively.

Each of the MOS transistors has a gate that is a capacitive control terminal, and each of the switches SWsr, SWsg, and SWsb becomes conductive or nonconductive in accordance with the charging voltage of the gate. To one end of a channel path of each of the switches SWsr, SWsg, and SWsb, an analog video signal (write signal) VIDEO (VIDEO(R), VIDEO(G), VIDEO(B)) supplied from outside is inputted. That is, the video signal VIDEO(R) is inputted to one end of a channel path of each of the switches SWsr1, SWsr2, . . . , SWsrn. The video signal VIDEO(G) is inputted to one end of a channel path of each of the switches SWsg1, SWsg2, . . . , SWsgn. The video signal VIDEO(B) is inputted to one end of a channel path of each of the switches SWsb1, SWsb2, . . . , SWsbn.

Each of the switches SWpr, SWpg, and SWpb is an analog switch including an N-channel MOS transistor (TFT) having a gate (second control terminal) to which an input signal is directly inputted and a P-channel MOS transistor (TFT) having a gate to which a signal obtained by inverting the input signal is inputted.

Each of the inverters Ip inverts a precharge signal PSMP inputted thereto, and inputs the inverted signal to a gate of a P-channel MOS transistor of each of the corresponding switches SWpr, SWpg, and SWpb while allowing the gate to have such a capacitance as to be sufficiently capable of charge and discharge. (The inverter Ip inverts the input signal, and may be considered to have part of the function of the buffer circuit Pb of the overlap prevention section 31*c*.) Note that the precharge signals PSMP inputted to the groups of switches SWpr, SWpg, and SWpb are outputted from the buffer circuits Pb of the overlap prevention section 31*c*, respectively.

Each of the MOS transistors has a gate that is a capacitive control terminal, and each of the switches SWpr, SWpg, and SWpb becomes conductive or nonconductive in accordance with the charging voltage of the gate. To one end of a channel path of each of the switches SWpr, SWpg, and SWpb, a precharging potential applied from outside is inputted.

The other ends of the channel paths of the switches SWpr (SWpr1, SWpr2, . . . , SWprn) and the other ends of the channel paths of the switches SWsr (SWsr1, SWsr2, . . . , SWsrn) are connected to data signal lines (signal supply lines) SLr (SLr1, SLr2, . . . , SLrn) provided in a liquid crystal display panel, respectively. Similarly, the other ends of the channel paths of the switches SWpg (SWpg1, SWpg2, . . . , SWpgn) and the other ends of the channel paths of the switches SWsg (SWsg1, SWsg2, . . . , SWsgn) are connected to data signal lines (signal supply lines) SLg (SLg1, SLg2, . . . , SLgn) provided in the liquid crystal display panel, respectively. Further, the other ends of the channel paths of the switches SWpb (SWpb1, SWpb2, . . . , SWpbn) and the other ends of the channel paths of the switches SWsb (SWsb1, SWsb2, . . . , SWsbn) are connected to data signal lines (signal supply lines) SLb (SLb1, SLb2, . . . , SLrn) provided in the liquid crystal panel, respectively.

With this, when the precharge signal PSMPi becomes active (high level), the switches SWpr1, SWpg1, and SWpb1 become conductive. As a result, the precharging potential PVID is applied to the data signal lines SLri, SLgi, and SLbi, so that the data signal lines SLri, SLgi, and SLbi and the pixel capacitors being selected are precharged. Here, as described above, the overlap prevention section 31*c* causes the sampling signal SMPi to be surely nonactive during the active (high-level) period of the precharge signal PSMPi. Therefore, the switches SWsri, SWsgi, and SWsbi are surely nonconductive, so that the precharging potential PVID and the video signal VIDEO do not collide with each other on the data signal lines SLri, SLgi, and SLbi.

Moreover, when the sampling signal SMPi becomes active (high level), the switches SWsri, SWsgi, and SWsbi become conductive. With this, the video signal VIDEO (VIDEO(R), VIDEO(G), VIDEO(B)) is supplied to the data signal lines SLri, SLgi, and SLbi, so that the data signal lines SLri, SLgi, and SLbi and pixel capacitors respectively corresponding thereto are charged so as to have a predetermined voltage. That is, the video signal VIDEO is sampled, so that a sampling effective period (writing effective period) is started. The sampling period is a period, contained in the predetermined cycle, during which the data signal lines sequentially fall in their respective sampling periods. On this occasion, since the precharge signal PSMPi is surely nonactive, the switch SWpi is nonconductive, so that the precharging potential PVID and the video signal VIDEO do not collide with each other on the data signal lines SLri, SLgi, and SLbi.

Thus, sampling is performed in a dot-sequential manner by sequentially repeating an operation of supplying the video signal VIDEO to the data signal lines SLri, SLgi, and SLbi that have been precharged.

Thus, in an arrangement in which data signal lines respectively corresponding to three colors (R, G, and B) are provided for a pair of a precharge signal PSMP and a sampling signal SMP, the shift register 31*a* is surrounded by video signal wires respectively corresponding to R, G, and B. Therefore, in the data signal line driver 31 according to the present embodiment, no dummy circuit is needed, so that the outer size of the panel can be effectively reduced.

Further, the data signal line driver 31 may be arranged so as to include a plurality of phases each including three colors (R, G, and B) and data signal lines, respectively corresponding to video signal lines of the colors of the phases, each of which is provided for a pair of a precharge signal PSMP and a sampling signal SMP. In this case, it is only necessary to replace the sampling section 31*b* with a sampling section 31*b*" shown in FIG. 17.

Figure 17:
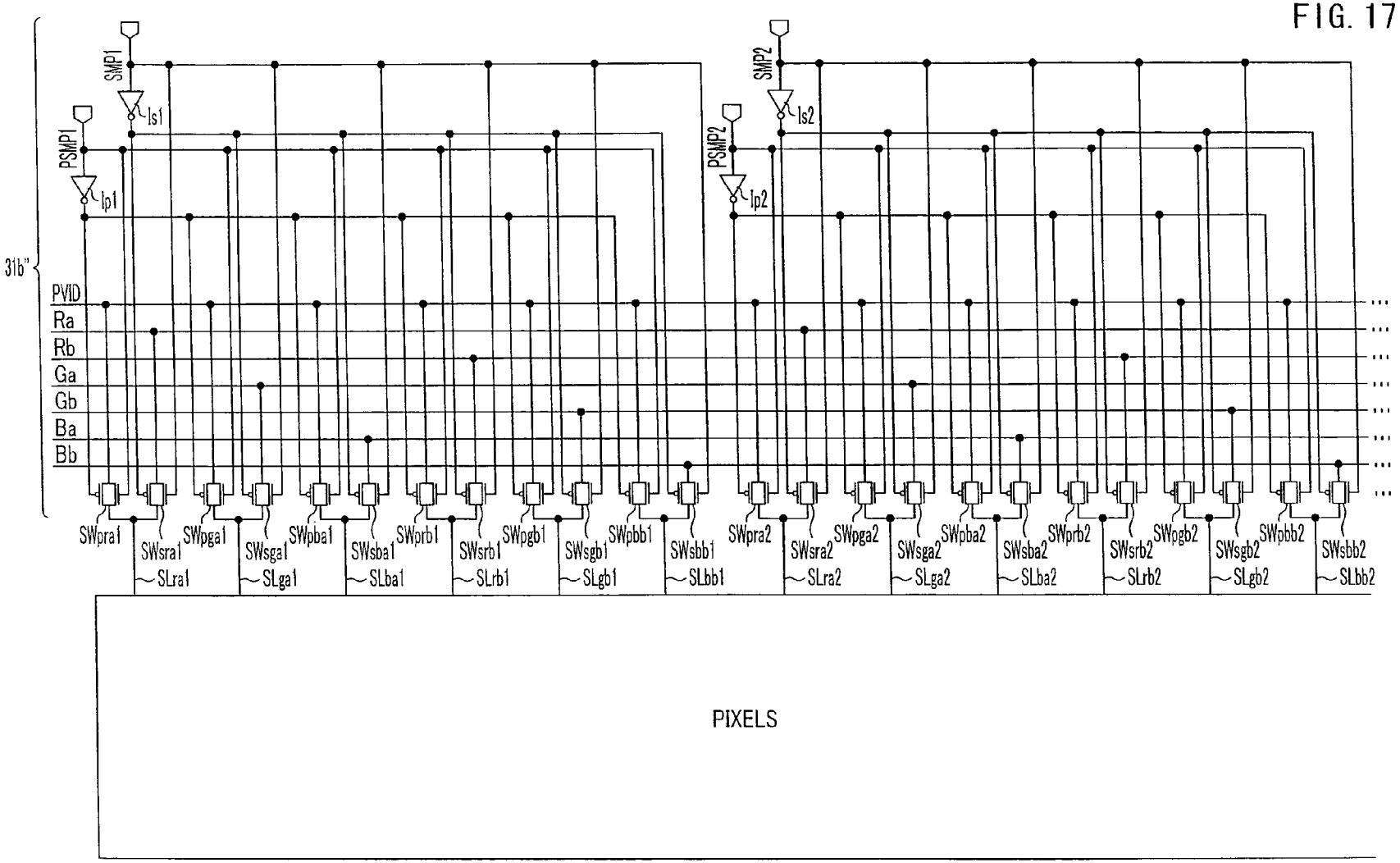
FIG. 17 is a block diagram showing another example of the structure of the sampling section of the data signal line driver according to the embodiment of the present invention.

The sampling section (write circuit, precharge circuit) 31*b*" shown in FIG. 17 shows an example of an arrangement in which no phase expansion is performed, i.e., in which two phases each including R (red), G (green), and B (blue) are provided and a pair of a precharge signal PSMP and a sampling signal SMP is used for charging six data signal lines (e.g., used for causing six pixels to carry out a display).

The sampling section (write circuit, precharge circuit) 31*b*" includes (i) a precharge circuit constituted by inverters Ip (Ip1, Ip2, . . . , Ipn), switches SWpra (SWpra1, SWpra2, . . . , SWpran), switches SWprb (SWprb1, SWprb2, . . . , SWprbn), switches SWpga (SWpga1, SWpga2, . . . , SWpgan), switches SWpgb (SWpgb1, SWpgb2, . . . , SWpgbn), switches SWpba (SWpba1, SWpba2, . . . , SWpban), and switches SWpbb (SWpbb1, SWpbb2, . . . , SWpbbn) and (ii) a write circuit constituted by inverters Is (Is1, Is2, . . . , Isn), switches SWsra (SWsra1, SWsra2, . . . , SWsran), switches SWsrb (SWsrb1, SWsrb2, . . . , SWsrbn), switches SWsga (SWsga1, SWsga2, . . . , SWsgan), switches SWsgb (SWsgb1, SWsgb2, . . . , SWsgbn), switches SWsba (SWsba1, SWsba2, . . . , SWsban), and switches SWsbb (SWsbb1, SWsbb2, . . . , SWsbbn).

Each of the switches SWsra, SWsrb, SWsga, SWsgb, SWsba, and SWsbb is an analog switch including an N-channel MOS transistor (TFT) having a gate (first control terminal) to which an input signal is directly inputted and a P-channel MOS transistor (TFT) having a gate to which a signal obtained by inverting the input signal is inputted.

Each of the inverters Is inverts a sampling signal SMP inputted thereto, and inputs the inverted signal to a gate of a P-channel MOS transistor of each of the corresponding switches SWsra, SWsrb, SWsga, SWsgb, SWsba, and SWsbb while allowing the gate to have such a capacitance as to be sufficiently capable of charge and discharge. (The inverter Is inverts the input signal, and may be considered to have part of the function of the buffer circuit Sb of the overlap prevention section 31*c*.) Note that the sampling signals SMP inputted to the groups of switches SWsra, SWsrb, SWsga, SWsgb, SWsba, and SWsbb is outputted from the buffer circuits Sb of the overlap prevention section 31*c*, respectively.

Each of the MOS transistors has a gate that is a capacitive control terminal, and each of the switches SWsra, SWsrb, SWsga, SWsgb, SWsba, and SWsbb becomes conductive or nonconductive in accordance with the charging voltage of the gate. To one end of a channel path of each of the switches SWsra, SWsrb, SWsga, SWsgb, SWsba, and SWsbb, an analog video signal (write signal) VIDEO (VIDEO(Ra), VIDEO (Rb), VIDEO(Ga), VIDEO(Gb), VIDEO(Ba), VIDEO(Bb)) supplied from outside are inputted. That is, the video signal VIDEO(Ra) is inputted to one end of a channel path of each of the switches SWsra, and the video signal VIDEO (Rb) is inputted to one end of a channel path of each of the switches SWsrb. Further, the video signal VIDEO(Ga) is inputted to one end of a channel path of each of the switches SWsga, and the video signal VIDEO(Gb) is inputted to one end of a channel path of each of the switches SWsgb. Further, the video signal VIDEO(Ba) is inputted to one end of a channel path of each of the switches SWsba, and the video signal VIDEO(Bb) is inputted to one end of a channel path of each of the switches SWsbb.

Each of the switches SWpra, SWprb, SWpga, SWpgb, SWpba, and SWpbb is an analog switch including an N-channel MOS transistor (TFT) having a gate (second control terminal) to which an input signal is directly inputted and a P-channel MOS transistor (TFT) having a gate to which a signal obtained by inverting the input signal is inputted.

Each of the inverters Ip inverts a precharge signal PSMP inputted thereto, and inputs the inverted signal to a gate of a P-channel MOS transistor of each of the corresponding switches SWpra, SWprb, SWpga, SWpgb, SWpba, and SWpbb while allowing the gate to have such a capacitance as to be sufficiently capable of charge and discharge. (The inverter Ip inverts the input signal, and may be considered to have part of the function of the buffer circuit Pb of the overlap prevention section 31*c*.) Note that the precharge signals PSMP inputted to the groups of switches SWpra, SWprb, SWpga, SWpgb, SWpba, and SWpbb is outputted from the buffer circuits Pb of the overlap prevention section 31*c*, respectively.

Each of the MOS transistors has a gate that is a capacitive control terminal, and each of the switches SWpra, SWprb, SWpga, SWpgb, SWpba, and SWpbb becomes conductive or nonconductive in accordance with the charging voltage of the gate. To one end of a channel path of each of the switches SWpra, SWprb, SWpga, SWpgb, SWpba, and SWpbb, a precharging potential applied from outside is inputted.

The other ends of the channel paths of the switches SWpra (SWpra1, SWpra2, . . . , SWpran) and the other ends of the channel paths of the switches SWsra (SWsra1, SWsra2, . . . , SWsran) are connected to data signal lines (signal supply lines) SLra (SLra1, SLra2, . . . , SLran) provided in a liquid crystal display panel, respectively. Similarly, the other ends of the channel paths of the switches SWprb (SWprb1, SWprb2, . . . , SWprbn) and the other ends of the channel paths of the switches SWsrb (SWsrb1, SWsrb2, . . . , SWsrbn) are connected to data signal lines (signal supply lines) SLrb (SLrb1, SLrb2, . . . , SLrbn) provided in the liquid crystal display panel, respectively.

Further, the other ends of the channel paths of the switches SWpga (SWpga1, SWpga2, . . . , SWpgan) and the other ends of the channel paths of the switches SWsga (SWsga1, SWsga2, . . . , SWsgan) are connected to data signal lines (signal supply lines) SLga (SLga1, SLga2, . . . , SLgan) provided in the liquid crystal display panel, respectively. Further, the other ends of the channel paths of the switches SWpgb (SWpgb1, SWpgb2, . . . , SWpgbn) and the other ends of the channel paths of the switches SWsgb (SWsgb1, SWsgb2, . . . , SWsgbn) are connected to data signal lines (signal supply lines) SLgb (SLgb1, SLgb2, . . . , SLgbn) provided in the liquid crystal display panel, respectively.

Further, the other ends of the channel paths of the switches SWpba (SWpba1, SWpba2, . . . , SWpban) and the other ends of the channel paths of the switches SWsba (SWsba1, SWsba2, . . . , SWsban) are connected to data signal lines (signal supply lines) SLba (SLba1, SLba2, . . . , SLban) provided in the liquid crystal display panel, respectively. Further, the other ends of the channel paths of the switches SWpbb (SWpbb1, SWpbb2, . . . , SWpbbn) and the other ends of the channel paths of the switches SWsbb (SWsbb1, SWsbb2, . . . , SWsbbn) are connected to data signal lines (signal supply lines) SLbb (SLbb1, SLbb2, . . . , SLbbn) provided in the liquid crystal display panel, respectively.

With this, when the precharge signal PSMPi becomes active (high level), the switches SWprai, SWprbi, SWpgai, SWpgbi, SWpbai and SWpbbi become conductive. As a result, the precharging potential PVID is applied to the data signal lines SLrai, SLrbi, SLgai, SLgbi, SLbai, and SLbbi, so that the data signal lines SLrai, SLrbi, SLgai, SLgbi, SLbai, and SLbbi and the pixel capacitors being selected are precharged.

Here, as described above, the overlap prevention section 31*c* causes the sampling signal SMPi to be surely nonactive during the active (high level) period of the precharge signal PSMPi. Therefore, the switches SWsrai, SWsrbi, SWsgai, SWsgbi, SWsbai and SWsbbi are surely nonconductive, so that the precharging potential PVID and the video signal VIDEO do not collide with each other on the data signal lines SLrai, SLrbi, SLgai, SLgbi, SLbai, and SLbbi.

Moreover, when the sampling signal SMPi becomes active (high level), the switches SWsrai, SWsrbi, SWsgai, SWsgbi, SWsbai and SWsbbi become conductive. With this, the video signal VIDEO (VIDEO(Ra), VIDEO(Rb), VIDEO(Ga), VIDEO(Gb), VIDEO(Ba), VIDEO(Bb)) is supplied to the data signal lines SLrai, SLrbi, SLgai, SLgbi, SLbai, and SLbbi, so that the data signal lines SLrai, SLrbi, SLgai, SLgbi, SLbai, and SLbbi and the pixel capacitors corresponding thereto are charged so as to have a predetermined voltage. That is, the video signal VIDEO is sampled, so that a sampling effective period (writing effective period) is started. The sampling period is a period, contained in the predetermined cycle, during which the data signal lines sequentially fall in their respective sampling periods. On this occasion, since the precharge signal PSMPi is surely nonactive, the switch SWpi is nonconductive, so that the precharging potential PVID and the video signal VIDEO do not collide with each other on the data signal lines SLrai, SLrbi, SLgai, SLgbi, SLbai, and SLbbi.

Thus, sampling is performed in a dot-sequential manner by sequentially repeating an operation of supplying the video signal VIDEO to the data signal lines SLrai, SLrbi, SLgai, SLgbi, SLbai, and SLbbi that have been precharged.

Thus, in an arrangement in which a video signal is phase-expanded, the shift register 31*a* is surrounded by a larger number of video signal wires. Therefore, in the data signal line driver 31 according to the present embodiment, no dummy circuit is needed, so that the outer size of the panel can be effectively reduced especially in an arrangement a video signal is phase-expanded.

Modified Example 1 of the Flip-Flop SR

In the present embodiment, the shift register 31*a* includes a plurality of set-reset flip-flops. However, the present invention is not limited to this.

Figure 18:
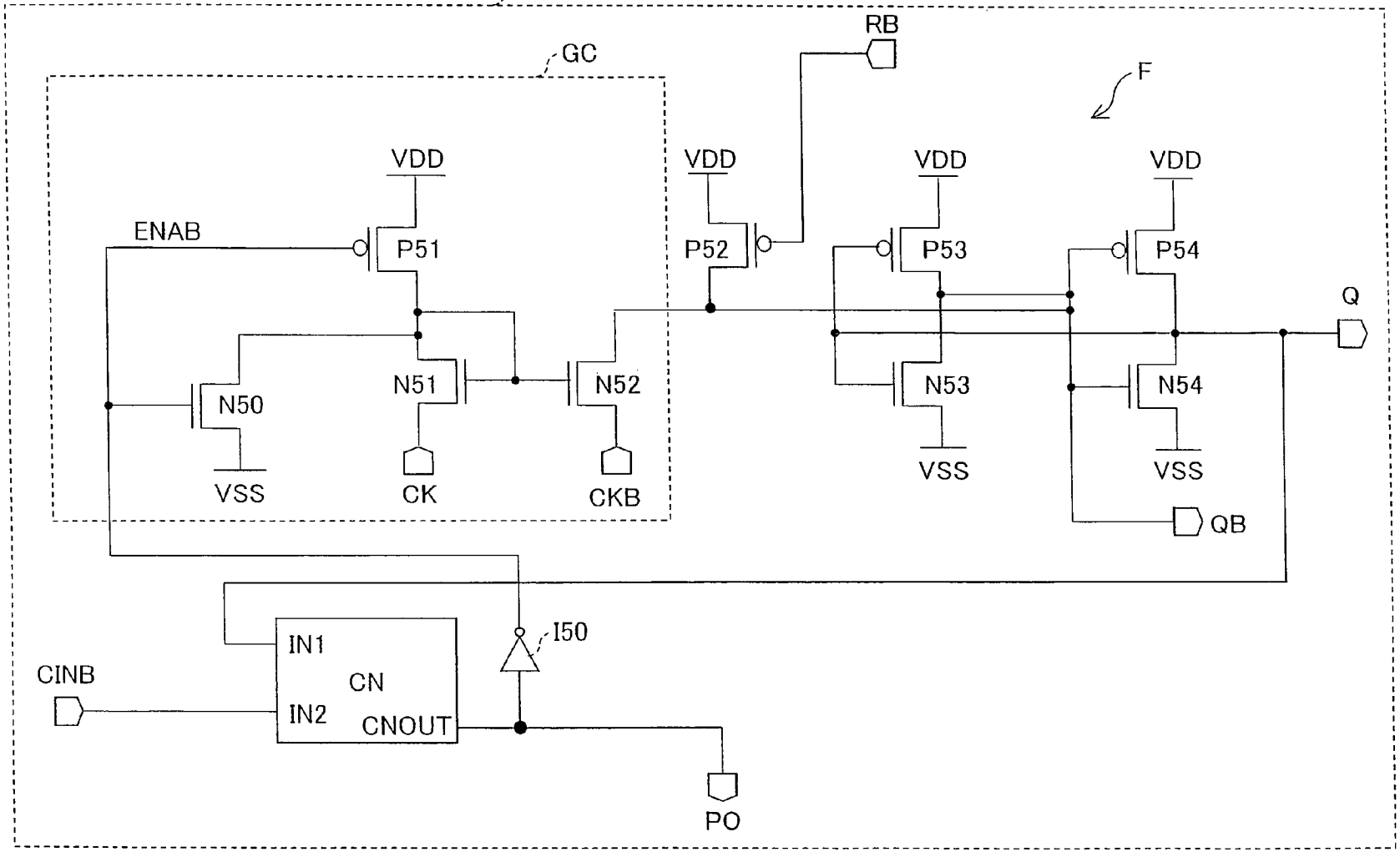
FIG. 18 is a block diagram showing a shift register block provided, instead of the flip flop, in the data signal line driver according to the embodiment of the present invention.

For example, the flip-flops SR (SR1, SR2, . . . , SRn+2) may be respectively replaced by shift register blocks SRB (SRB1, SRB2, . . . , SRBn+2) each including a gating circuit and a flip-flop each described in Patent Document 8. In FIG. 18, the arrangement of the flip-flop in Patent Document 8 is changed for the sake of convenience.

As shown in FIG. 18, each of the shift register blocks SRB includes a control circuit CN, a gating circuit GC, a flip-flop F, and an inverter I50. Further, as with each of the flip-flops SR, each of the shift register blocks SRB includes a CK terminal, a CKB terminal, a CINB terminal, an RB terminal, a PO terminal, and a QB terminal. Moreover, the same signals as with the flip-flop SR are inputted to and outputted from the terminals, respectively.

The control circuit CN is arranged in the same manner as the level shifter control circuit CN. An input terminal IN1 of the control circuit CN is connected to the CINB terminal, and an input terminal IN2 of the control circuit CN is connected to a Q terminal. With this, an output signal Q of the flip-flop F is inputted to the input terminal IN2. Further, an output terminal CNOUT of the control circuit CN is connected to the PO terminal and an input terminal of the inverter I50.

The gating circuit GC includes transistors P51, N50, N51, and N52. The flip-flop F includes transistors P52, P53, P54, N53, and N54. Each of the transistors P51 to P54 is a P-channel MOS transistor, and each of the transistors N50 to N54 is an N-channel MOS transistor.

The transistors P51 and N51 are serially connected to each other so as to be positioned between a power supply VDD and a clock input terminal CK. A node between the transistors P51 and N51 is connected to a power supply VSS via the transistor N50. Respective gates of the transistors P51 and N50 are connected to an output terminal of the inverter I50. With this, the respective gates of the transistors P51 and N50 are supplied with an enable signal ENAB, which is a signal obtained by inverting an output signal (output signal PO) of the control circuit CN. The gate of the transistor P51 is low active, and is supplied with an input signal inputted to the RB terminal.

The transistors P52 and N52 are serially connected to each other so as to be positioned between the power supply VDD and a clock input terminal CKB, and a node between the transistors P52 and N52 serves as an output terminal of the gating circuit GC. A gate of the transistor N52 is connected to a gate of the transistor N51, and these gates are connected to a drain of the transistor N51. A gate of the transistor P52 is low active, and is supplied with an input signal inputted to the RB terminal.

The transistors P53 and N53 are serially connected to each other so as to be positioned between the power supply VDD and the power supply VSS. The transistors P54 and N54 are serially connected to each other so as to be positioned between the power supply VDD and the power supply VSS. A gate of the transistor P53 and a gate of the transistor N53 are connected to each other, and a node therebetween is connected to a node between the transistors P54 and N54. A gate of the transistor P54 and a gate of the transistor N54 are connected to each other, and a node therebetween is connected to a node between the transistors P53 and N53 and the output terminal of the gating circuit GC, and serves as an inversion output terminal QB of the flip-flop F. A node between the transistors P54 and N54 is connected to an output terminal Q of the flip-flop F.

Figure 19:
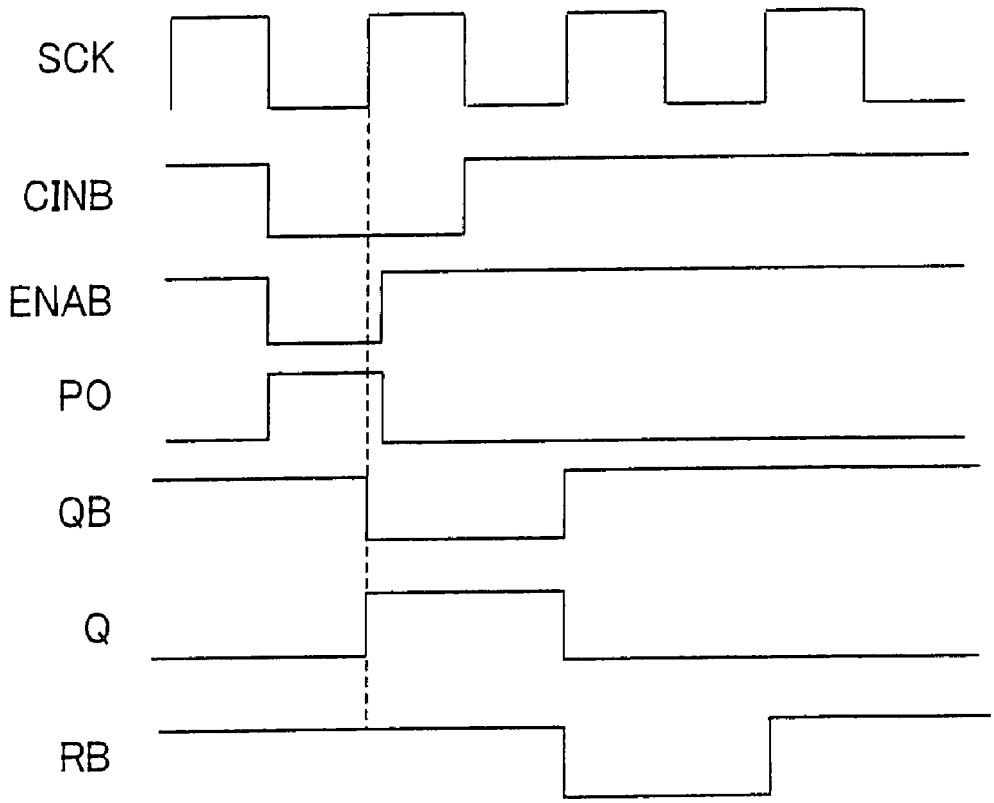
FIG. 19 is a timing chart showing signals relating to operation of the shift register block shown in FIG. 18.

In the following, operation of the shift register block SR arranged as described above is explained with reference to a timing chart shown in FIG. 19. FIG. 19 shows respective waveforms of input signals of odd-numbered shift register blocks SRB of the first to n+2th shift register blocks SRB. As for even-numbered shift register blocks SRB, the respective waveforms of the input signals are shifted by one clock (a half cycle) of clock signals SCK and SCKB. That is, the clock signal SCK in FIG. 19 is replaced by an inversion signal SCKB obtained by inverting the clock signal SCK.

When the input signal CINB is at a high level, the output signal Q of the flip-flop F is already nonactive (low level), so that the output signal (output signal PO) of the control circuit CN becomes low. The low-level signal is inverted by the inverter I50 so as to be a high-level signal, which is inputted as an enable signal ENAB to the enable terminal ENAB of the gating circuit GC.

The gating circuit GC becomes operable in a period during which the enable signal ENAB is at a low level. In the operable state, the clock signal SCK is level-shifted, and then is outputted to the flip-flop F.

When the input signal CINB becomes low, the output signal Q of the flip-flop F is already nonactive (low level), so that the output signal (output signal PO) of the control circuit CN becomes high. Therefore, a low-level signal is inputted to the enable terminal ENAB of the gating circuit GC via the inverter I50.

At the first point of time where the low-level signal is inputted to the enable terminal ENAB, the clock signal SCK is low and the clock signal SCKB is high, so that the inversion output signal QB of the flip-flop F remains high.

Moreover, after the passage of the length of one pulse of the clock signal SCK (after the passage of a half cycle of the clock signal SCK), the clock signal SCK becomes high and the clock signal SCKB becomes low, so that the output signal Q and inversion output signal QB of the flip-flop F become high and low respectively.

Since the output signal Q is inputted to the input terminal IN1 of the control circuit CN, the output signal (output signal PO) of the control circuit CN becomes low at a timing elapsed by the delay time of the control circuit CN since the output signal Q became high. Further, the enable signal ENAB to be inputted to the gating circuit GC becomes high.

When the high-level signal is inputted to the enable terminal ENAB of the gating circuit GC, the gating circuit GC becomes nonoperative.

When the gating circuit GC becomes nonoperative, the output signal thereof becomes low. However, the output signal Q and inversion output signal QB of the flip-flop F are maintained at an active level (the output signal Q at a high level; the inversion output signal at a low level) until a low-level signal is inputted to the reset terminal RB. Thereafter, the output signal Q and the inversion output signal QB becomes nonactive (the output signal Q at a low level; the inversion output signal at a high level) at such a timing that the signal to be inputted to the reset terminal RB becomes low. To the reset terminal RB, an inversion output signal QB of a flip-flop F provided in a shift register block SR located two stages after the current stage is inputted.

Thus, also in an arrangement in which the shift register block SRB, output signals PO, Q, and QB substantially identical to those obtained when the flip-flop SR is used are obtained. Therefore, the data signal line driver 31 operates in the same manner as in the case where the flip-flop SR is used.

Under the conventional technology, even in cases where the shift register block SRB is used, it has been necessary that an output signal of a shift register block located two or more stages before the current stage or a start pulse SSP and an output signal of a shift register block located one or more stages before the current stage be used to generate a precharge signal. Therefore, in order to precharge a first data signal line or first and second data signal lines, it has been necessary to provide a dummy circuit (dummy shift register block).

On the other hand, according to the foregoing arrangement, each shift register block SRB uses an output signal thereof to generate a precharge signal PO, so that no such dummy circuit is needed. Therefore, the size of the data signal line driver 31 and the size of a wiring region, surrounding the data signal line driver 31, in which wires are provided are reduced. With this, the outer size of the panel can be reduced, and the ratio of the size of a display region to the outer size of the panel can be reduced.

Further, in cases where the amplitude of the clock signals SCK and SCKB to be inputted to the gating circuit GC is smaller than the amplitude of the power supply voltage, a constant current flows through the gating circuit GC. The enable signal ENAB in FIG. 19 shows that the operating period of the gate circuit GC (the low-level period of the enable signal ENAB) corresponds to the length of approximately one pulse of the clock signal SCK (approximately a half cycle the clock signal SCK). The delay time for determining a timing at which the enable signal ENAB becomes nonactive depends mainly on the delay time obtained in the control circuit CN. In the conventional arrangement, a constant current flows in a period during which the input signal CINB is active (the length of approximately two pulses of the clock signal SCK (approximately one cycle of the clock signal SCK)). However, in this example, the constant current flowing through the gating circuit GC can be reduced.

Further, each of the gating circuit GC, the flip-flop F, and the control circuit CN delays a signal in processing the signal. The gating signal GC slightly delays and outputs signals obtained by level-shifting the clock signals SCK and SCKB inputted thereto. However, after the signals have been outputted from the gating circuit GC, the output signal Q is outputted with some delay and the inversion output signal QB is outputted without delay. The output signal PO to the PO terminal, i.e., the output signal of the control circuit CN becomes low slightly later than the output timing of the inversion output signal QB, so that the enable signal ENAB becomes high. Therefore, the delay time between the output of the signals from the gating circuit GC and the change of the enable signal ENAB to a high level is dominated by the delay time obtained in the control circuit CN.

According to the basic idea that the gating circuit GC no longer needs to operate once a pulse of the output signal Q of the flip-flop F becomes able to be ensured, if the enable signal ENAB is made nonactive at a point of time where a small amount of time has elapsed since the start of a pulse of the inversion output signal QB, operation of the gating circuit QB can be surely stopped after the pulse of the output signal Q becomes able to be started. For that purpose, it is only necessary to obtain a delay time in the control circuit CN.

Further, since there is no delay time between the output of the signals by the gating circuit GC and the output of the inversion output signal QB by the flip-flop F, such a condition that it is only necessary to obtain a delay time in the control circuit CN matches the idea of minimizing the operating time of the gating circuit GC.

The output signal QB serves as an input signal CINB of the next shift register block SRB, the delay causes a delay in timing at which an enable signal ENAB in the next shift register block SRB becomes active, so that the pulse width of the enable signal ENAB is the length of approximately one pulse (a half cycle of the clock signal SCK).

Modified Example 2 of the Flip-Flop SR

Figure 32:
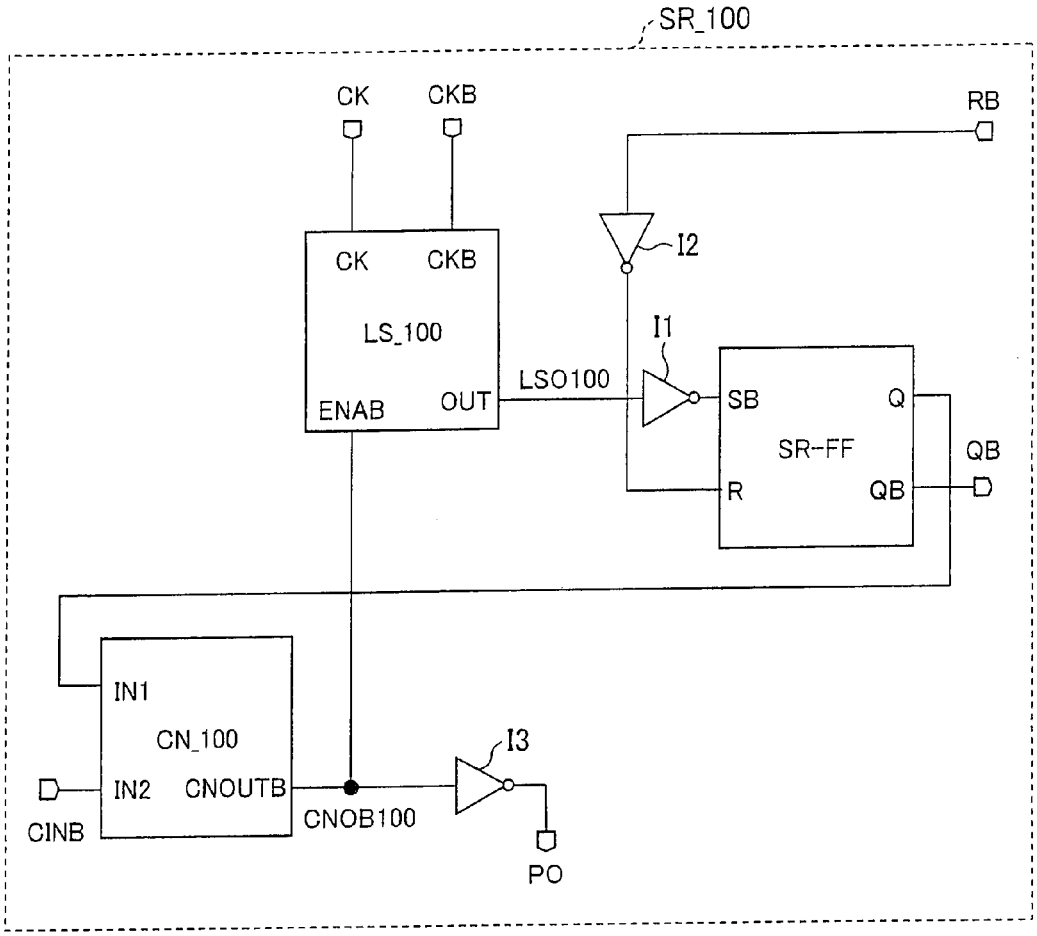
FIG. 32 is a block diagram showing a modified example of the flip-flop provided the data signal line driver according to the embodiment of the present invention.

Further, the flip-flop SR (SR1, SR2, . . . , SRn+2) shown in FIG. 4 may be replaced by a flip-flop SR_100 (SR_$\mathbf{100}_1$, SR_$\mathbf{100}_2$, . . . , SR_$\mathbf{100}_{n+2}$) shown in FIG. 32. FIG. 32 is a block diagram showing a structure of each flip-flop SR_100. As shown in FIG. 32, the flip-flop SR includes a level shifter control circuit CN_100, a level shifter LS_100, a set-reset flip-flop SR-FF, an inverter I1, an inverter I2, and an inverter I3. Note that the flip-flop SR-FF is arranged in the same manner as in FIG. 4.

(Level Shifter Control Circuit CN_100)

Figure 33:
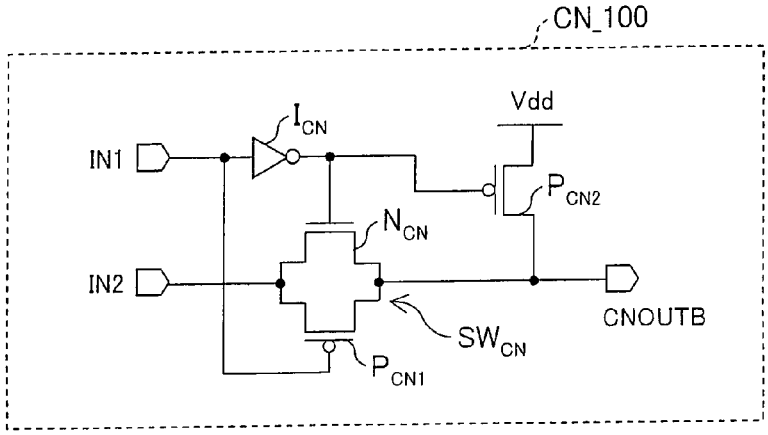
FIG. 33 is a block diagram showing a structure of a level shifter control circuit provided in the flip-flop shown in FIG. 32.

FIG. 33 is a block diagram showing a structure of the level shifter control circuit (control circuit) CN_100. As shown in FIG. 33, the level shifter control circuit CN_100 includes two input terminals IN1 and IN2, an inverter $I_{CN}$, a switch $SW_{CN}$, a P-channel MOS transistor (TFT) $P_{CN2}$, and an output terminal CNOUTB. Note that the switch $SW_{CN}$ is an analog switch including an N-channel MOS transistor (TFT) $N_{CN}$ and a P-channel MOS transistor (TFT) $P_{CN1}$.

The input terminal IN1 receives an output signal Q of the flip-flop SR-FF. The input terminal IN2 receives an input signal inputted to a CINB terminal of the flip-flop SR_100.

The input terminal IN1 is connected to a gate of the P-channel MOS transistor $P_{CN1}$. Further, the input terminal IN1 is connected to a gate of the N-channel MOS transistor $N_{CN}$ and a gate of the P-channel MOS transistor $P_{CN2}$ via the inverter $I_{CN}$.

The input terminal IN2 is connected to a source of the P-channel MOS transistor $P_{CN1}$ and a source of the N-channel MOS transistor $N_{CN}$. Further, a drain of the P-channel MOS transistor $P_{CN1}$ and a drain of the N-channel MOS transistor $N_{CN}$ are connected to the output terminal CNOUTB.

Further, a source of the P-channel MOS transistor $P_{CN2}$ is connected to a power supply line of a high-level driving voltage Vdd, and a drain of the P-channel MOS transistor $P_{CN2}$ is connected to the output terminal CNOUTB.

With this, in cases where at least either of (i) the input signal to the input terminal IN1 (i.e., the output signal Q of the flip-flop SR-FF) and (ii) the input signal to the input terminal IN2 (i.e., the input signal to the CINB terminal of the flip-flop SR_100) is at a high level, an output signal CNOB100 from the output terminal CNOUTB is at a high level. Moreover, in cases where both the input signal to the input terminal IN1 and the input signal to the input terminal IN2 are at a low level, the output signal CNOB100 from the output terminal CNOUTB is at a low level.

As shown in FIG. 32, the output signal CNOB100 from the output terminal CNOUTB is directly inputted to an ENAB terminal of the level shifter LS_100, and is outputted to a PO terminal of the flip-flop SR_100 after having been inverted by the inverter I3.

(Level Shifter LS_100)

Figure 34:
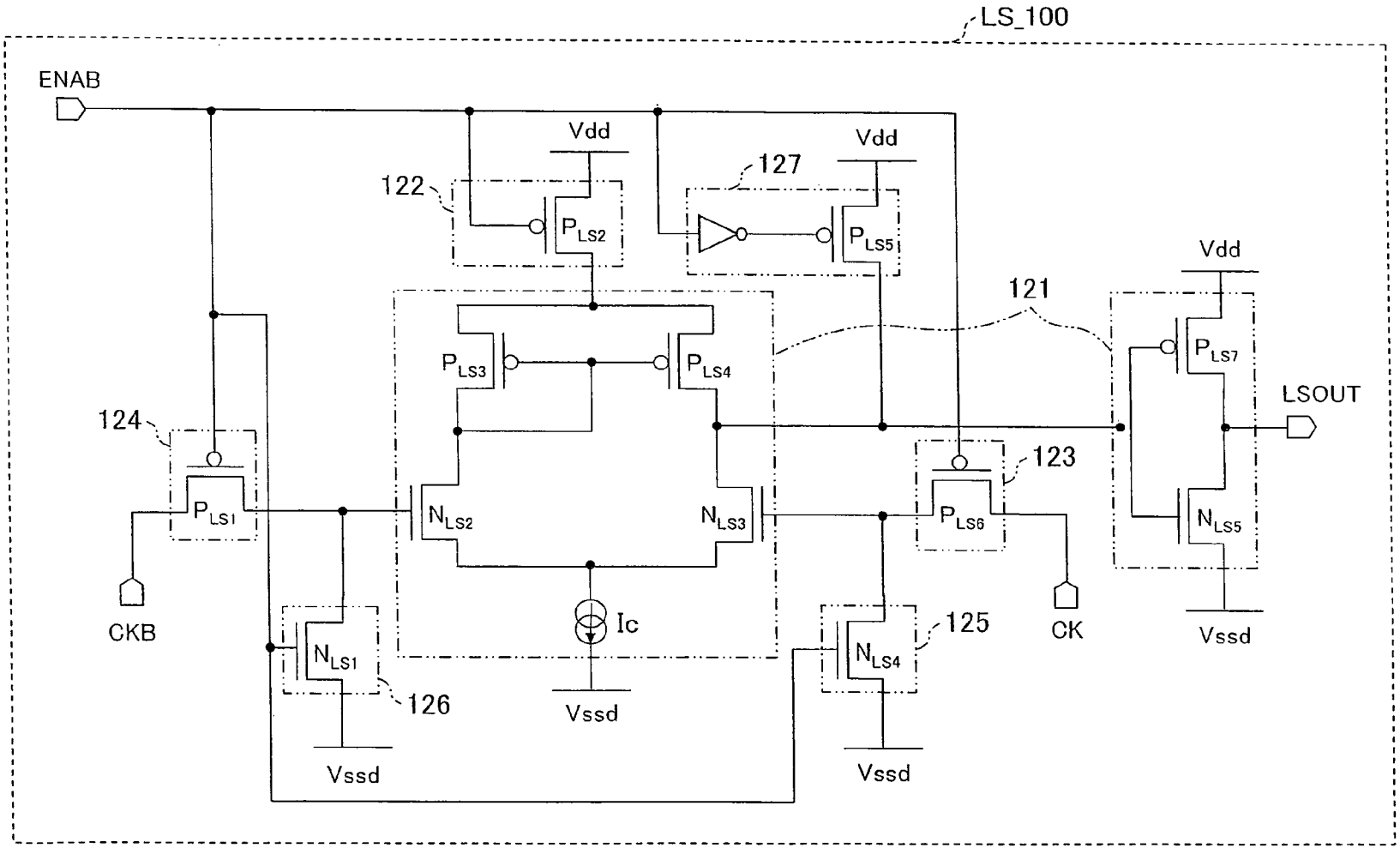
FIG. 34 is a block diagram showing a structure of a level shifter provided in the flip-flop shown in FIG. 32.

FIG. 34 is a block diagram showing an example of a structure of the level shifter LS_100. The level shifter LS_100 includes: a step-up/down transformer section 121 for level-shifting the clock signals SCK and SCKB; a power supply control section 122 for preventing power from being supplied to the step-up/down transformer section 121 during a stop period during which the clock signals SCK and SCKB do not need to be supplied; input control sections 123 and 124 for blocking, during the stop period, signal lines via which the clock signals SCK and SCKB are transmitted to the step-up/down transformer section 121; input signal control section 125 and 126 for blocking input switching elements ($N_{LS2}$ and $N_{LS3}$) of the step-up/down transformer section 121 during the stop period; and an output stabilizer section 127 for maintaining the output of the step-up/down transformer section 121 at a predetermined level during the stop period.

The step-up/down transformer section 121 is a differential input pair of an input stage. The step-up/down transformer section 121 includes: N-type MOS transistors $N_{LS2}$ and $N_{LS3}$, serving as the input switching elements, whose respective sources are connected to each other; a constant current source Ic connected between the respective sources of the transistors $N_{LS2}$ and $N_{LS3}$ and a power supply line of a low-level driving voltage Vssd; P-type MOS transistors $P_{LS3}$ and $P_{LS4}$, constituting a current mirror circuit, which are connected to drains of the transistor $N_{LS2}$ and $N_{LS3}$, respectively, to serve as an active load; and CMOS-structured transistors $P_{LS7}$ and $N_{LS5}$ for amplifying the output of the differential input pair. The structure shown in FIG. 34 shows an example of level shifters LS1 to be respectively provided in the odd-numbered flip-flops $SR_100_1$, $SR_100_3$, . . . in each of which the input CK to the transistor $N_{LS3}$ is directly outputted the output LSOUT. However, in case of level shifters LS_100 to be respectively provided in the even-numbered flip-flops $SR_100_2$, $SR_100_4$, . . . , the clock signals SCK and SCKB are inputted instead of each other.

To a gate of the transistor $N_{LS2}$, the clock signal SCKB is inputted via a P-type MOS transistor $P_{LS1}$ constituting the input control section 124. To a gate of the transistor $N_{LS3}$, the clock signal SCK is inputted via a P-type MOS transistor $P_{LS6}$ constituting the input control section 123. Further, the gate of the transistor $N_{LS2}$ is designed to be pulled down to a power supply line of a low-level driving voltage Vssd via an N-type MOS transistor $N_{LS1}$ constituting the input signal control section 126. Similarly, the gate of the transistor $N_{LS3}$ is designed to be pulled down to the power supply line of the low-level driving voltage Vssd via an N-type MOS transistor $N_{LS4}$ constituting the input signal control section 125. Moreover, respective gates of the transistors $P_{LS1}$, $P_{LS6}$, $N_{LS1}$, $N_{LS4}$ are supplied with the output signal CNOB100 (enable signal ENAB100) inputted to the ENAB terminal from the level shifter control circuit CN_100.

Therefore, when the output signal CNOB100 from the level shifter control circuit CN_100 becomes active (low level), the clock signals SCKB and SCK are allowed to be inputted to the transistors $N_{LS2}$ and $N_{LS3}$ via the transistors $P_{LS1}$ and $P_{LS6}$, respectively. Moreover, the transistors $N_{LS1}$ and $N_{LS4}$ are turned off. On the other hand, when the output signal CNOB100 from the level shifter control circuit CN_100 becomes nonactive (high level), the transistors $P_{LS1}$ and $P_{LS6}$ are turned off, so that the clock signals SCKB and SCK are prevented from being inputted. Moreover, the transistors $N_{LS1}$ and $N_{LS4}$ become conductive, so that the gates of the transistors $N_{LS2}$ and $N_{LS3}$ are pulled down to the low-level Vssd. With this, the transistors $N_{LS2}$ and $N_{LS3}$ of the input stage are surely turned off.

Meanwhile, a gate of the transistor $P_{LS3}$ and a gate of the transistor $P_{LS4}$ are connected to each other, and are connected to respective drains of the transistors $P_{LS3}$ and $N_{LS2}$. On the other hand, a drain of the transistor $P_{LS4}$ and a drain of the transistor $N_{LS3}$ are connected to each other, and serve as an output terminal that is connected to respective gates of the transistors $P_{LS7}$ and $N_{LS5}$. Respective sources of the transistors $P_{LS3}$ and $P_{LS4}$ are connected to a power supply line of a high-level driving voltage Vdd via a P-type MOS transistor $P_{LS2}$ constituting the power supply control section 122. A gate of the MOS transistor $P_{LS2}$ is supplied with the output signal CNOB100 sent from the level shifter control circuit CN_100.

Therefore, when the output signal CNOB100 of the level shifter control circuit CN_100 becomes active (low level), the step-up/down transformer section 121 is supplied with power via the transistor $P_{LS2}$. When the output signal CNOB100 of the level shifter control circuit CN_100 becomes nonactive (high level), the supply of power to the step-up/down transformer section 121 is stopped.

Further, the output stabilizer section 127 is a circuit that stabilizes the output signal LSOUT of the level shifter LS_100 at the level of the low-level driving voltage Vssd, which output signal LSOUT is obtained in the stop period.

The output stabilizer section 127 is constituted by an inverter $I_{LS}$ and a P-type MOS transistor $P_{LS5}$. The inverter $I_{LS}$ is provided between the ENAB terminal and a gate of the transistor $P_{LS5}$. Therefore, the output signal CNOB100 of the level shifter control circuit CN_100 is inverted by the inverter $I_{LS}$, and then is supplied to the gate of the transistor $P_{LS5}$. With this, when the output signal CNOB100 of the level shifter control circuit CN_100 is at a high level, the respective gates of the transistors $P_{LS7}$ and $N_{LS5}$ are pulled up to the power supply line of the high-level driving voltage Vdd via the transistor $P_{LS5}$.

According to the level shifter LS_100 arranged as described above, in cases where the output signal of the level shifter control circuit CN_100 is at a low level, the transistors $P_{LS1}$, $P_{LS2}$, and $P_{LS6}$ become conductive and the transistors $N_{LS1}$, $N_{LS4}$, and $P_{LS5}$ are turned off. In this state, a current supplied via the transistor $P_{LS2}$ passes through the transistors $P_{LS3}$ and $N_{LS2}$ or the transistors $P_{LS4}$ and $N_{LS3}$, and flows through the constant current supply Ic. Further, the clock signals SCK and SCKB are applied to the gates of the transistors $N_{LS3}$ and $N_{LS2}$, respectively. As a result, the amount of current flowing through the gates of the transistors $N_{LS2}$ and $N_{LS3}$ corresponds to the ratio of the gate-source voltage of the transistors $N_{LS2}$ to the gate-source-voltage of the transistor $N_{LS3}$. On the other hand, since the transistors $P_{LS3}$ and $P_{LS4}$ serve as an active load, the voltage of the node between the transistors $P_{LS4}$ and $N_{LS3}$ corresponds to the voltage level difference between the clock signals SCK and SCKB. The voltage is power-amplified by the transistors $P_{LS7}$ and $N_{LS5}$, and then is outputted as an output signal LSO100 from the output terminal LSOUT.

The step-up/step-down transformer section 121 is not a voltage-driven type in which the transistors $P_{LS3}$ and $P_{LS4}$ of the input stage become conductive/nonconductive in accordance with the clock signals SCK and SCKB, respectively. The step-up/step-down transformer section 121 is a current-driven type in which the transistors $P_{LS4}$ and $P_{LS3}$ of the input stage are always conductive during operation. As described above, the current is divided in accordance with the ratio of the gate-source voltage of the transistor $P_{LS4}$ to the gate-source voltage of the transistor $P_{LS3}$. With this, even in cases where the amplitude of the clock signals SCK and the amplitude of the clock signal SCKB are lower than the threshold value of the transistor $N_{LS3}$ and the threshold value of the transistor $N_{LS2}$, respectively, the clock signals SCK and SCKB can be level-shifted without problems.

As a result, when the output signal CNOB100 applied to the ENA terminal from the level shifter control circuit CN_100 becomes active (low level), the level shifter LS_100 outputs, even in cases where the amplitude of the clock signal SCK and the amplitude of the clock signal SCKB are lower (e.g., approximately 5 V from a circuit generating the video signal) than the difference between the high driving voltage and the low driving voltage (Vcc=Vdd−Vssd, e.g., approximately 15 V), the output signal LSO100 whose amplitude has been stepped up or down to the difference Vcc.

On the other hand, the output signal CNOB100 from the level shifter control circuit CN_100 is nonactive (low level) indicating an operation stoppage, the transistor $P_{LS2}$ prevents the current from flowing through the transistors $P_{LS3}$ and $N_{LS2}$ or the transistor $P_{LS4}$ and $N_{LS3}$. Therefore, the amount of power to be consumed due to the current can be reduced.

Further, in this state, the respective transistors $P_{LS6}$ and $P_{LS1}$ of the input control sections 123 and 124 are turned off. Therefore, the signal lines via which the clock signals SCK and SCKB are transmitted are disconnected from the transistors $N_{LS3}$ and $N_{LS2}$ of the input stage, respectively. Further, under suspension, the respective transistors $N_{LS4}$ and $N_{LS1}$ of the input signal control sections 125 and 126 are conductive. Therefore, the respective gate voltages of the transistors $N_{LS2}$ and $N_{LS3}$ are pulled down to the low-level driving voltage Vssd, so that the transistors $N_{LS2}$ and $N_{LS3}$ are turned off. With this, as with the case where the transistor $P_{LS2}$ is turned off, power consumption can be reduced by the amount of current outputted by the constant current source Ic.

However, in this state, no current is supplied to the transistors $N_{LS2}$ and $N_{LS3}$. Therefore, the transistors $N_{LS2}$ and $N_{LS3}$ cannot operate as a differential input pair, so that the potential of the output terminal, i.e., of the node between the respective drains of the transistors $P_{LS4}$ and $N_{LS3}$ becomes unable to be determined. In light of this, in cases where the enable signal ENAB indicates an operation stoppage, the transistor $P_{LS5}$ of the output stabilizer section 127 becomes conductive. As a result, the output terminal, i.e., the gate potential of the transistors $P_{LS7}$ and $N_{LS5}$ is pulled up to the high-level driving voltage Vdd. With this, the transistor $N_{LS5}$ becomes conductive, so that the output signal LSO100 becomes low.

Thus, while the output signal CNOB100 from the level shifter control circuit CN_100 indicates an operation stoppage, the output signal LSO100 of the level shifter LS_100 is kept at a low level regardless of the clock signals SCK and SCKB.

(Operation of Flip-Flop SR_100)

Figure 35:
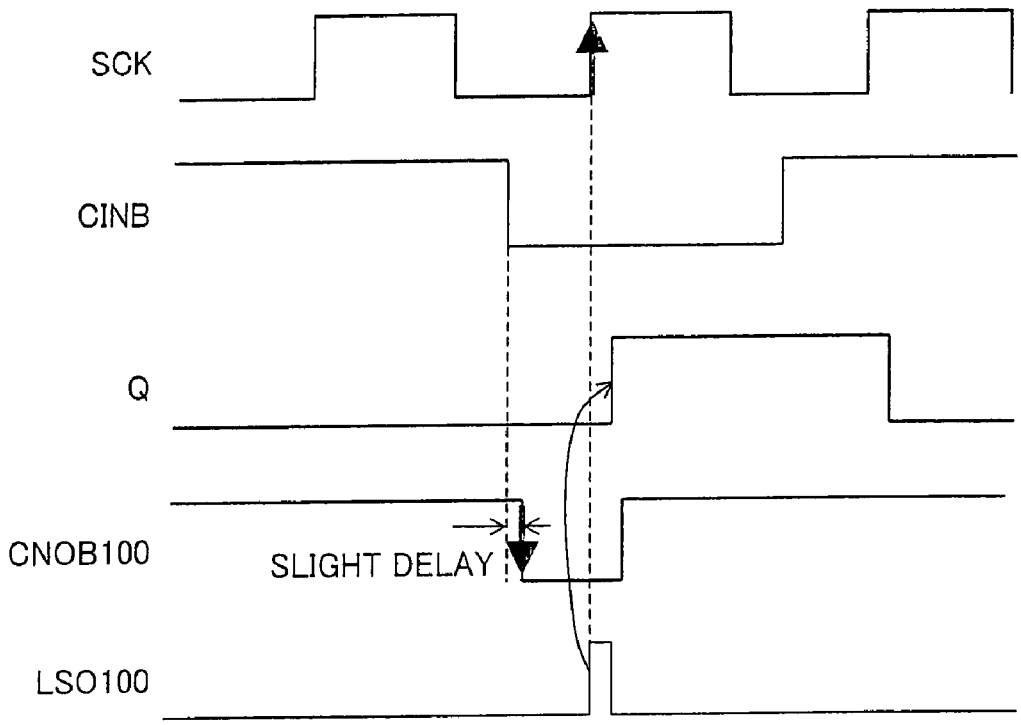
FIG. 35 is a timing chart showing signals relating to operation of the flip-flop shown in FIG. 32.

FIG. 35 is a timing chart concerning the odd-numbered flip-flops SR_$\mathbf{100}_1$, SR_$\mathbf{100}_3$, . . . . Note that the even-numbered flip-flops SR_$\mathbf{100}_2$, SR_$\mathbf{100}_4$, . . . are operated such that each of the signals shown in FIG. 35 are shifted by a half cycle with respect to the clock signal SCK. That is, as shown in FIG. 1, each of the even-numbered flip-flops SR2, SR4, . . . is arranged such that: the inversion clock signal (clock signal) SCKB is inputted to the CK terminal; and the clock signal SCK is inputted to the CKB terminal. For this reason, the operation of the even-numbered flip-flops is shifted by one clock (a half cycle) of the clock signal from the operation of the odd-numbered flip-flops.

As shown in FIG. 35, at the moment the signal CINB inputted to the level shifter control circuit LS_100 becomes low, the output Q of the flip-flop SR-FF provided in the flip-flop SR_100 of the same stage is nonactive (low level). For this reason, the output signal CNOB100 of the level shifter control circuit CN_100 becomes low.

The low-level signal CNOB100 is inputted to the ENAB terminal of the level shifter LS_100. Moreover, when the low-level signal CNOB100 is inputted to the ENA terminal, the level shifter LS_100 becomes capable of a level shifter operation, and outputs the output signal LSO100 obtained by level-shifting the input signal SCK. Thus, the falling edge of the output signal CNOB100 of the level shifter control circuit CN_100 level-shifts a rising edge of the clock signal SCK, so that the output signal LSO100 is outputted.

Here, at the point of time where the signal inputted to the ENA terminal (the output signal CNO of the level shifter control circuit CN_100) becomes low, the clock signal SCK remains low, so that the output signal LSO100 of the level shifter LS_100 remains low. Moreover, when the clock signal SCK becomes high after approximately one clock (after approximately a half cycle of the clock signal SCK), the output signal LSO100 of the level shifter LS_100 is switched to a high level.

The high-level output signal LSO100 of the level shifter LS_100 becomes low after having passed through the inverter I1, and then is inputted to the input terminal SB of the flip-flop SR-FF.

When the low-level signal is inputted to the SB terminal of the flip-flop SR-FF, the SR-FF is set so as to be active, so that the output signals Q and QB of the flip-flop SR-FF become high and low respectively.

Here, the output signal Q of the flip-flop SR-FF is inputted (fed back) to the level shifter control circuit CN_100. Therefore, at the moment the output signal Q becomes high, the output signal CNOB100 of the level shifter control circuit CN_100 becomes high.

When the high-level output signal CNOB100 is inputted to the terminal ENAB of the level shifter LS_100, the level shifter LS_100 becomes nonoperative. When the level shifter LS_100 becomes nonoperative, the output signal LSO100 of the level shifter LS_100 becomes low. Even when the output signal LSO100 becomes low, the output signals Q and QB of the flip-flop SR-FF continue to be active (the output signal Q at a high level; the output signal QB at a low level) until a high-level signal is inputted to the reset terminal R.

The reset terminal R of a flip-flop SR-FF receives an output signal QB of a flip-flop SR located two stages after a flip-flop SR in which the flip-flop SR-FF is provided, which output signal QB has been inverted by the inverter I2. Therefore, as shown in FIG. 35, the active output signals Q and QB of the flip-flop SR-FF which output signals Q and QB have become active are reset to nonactive when the clock signal SCK has been inputted by two clocks (by one cycle of the clock signal SCK).

Further, the input signal CINB inputted to the input terminal IN2 of the level shifter control circuit CN_100 is the output signal QB of the previous flip-flop SR. Therefore, the input signal CINB becomes high after the output signals Q and QB of the flip-flop SR-FF have become active and when the clock signal SCK has been inputted by one clock (by a half clock of the clock signal SCK).

Therefore, when the output signals Q and QB of the flip-flop SR-FF have returned from an active level to a nonactive level, the input signal CINB inputted to the input terminal IN2 is already high, so that the output signal CNOB100 of the level shifter control circuit CN_100 remains high. With this, the level shifter LS_100 becomes nonoperative, so that the output signal LSO100 of the level shifter LS_100 remains low. For this reason, the output signals Q and QB of the flip-flop SR-FF are surely kept at a nonactive level (the output signal Q at a low level; the output signal QB at a high level).

Further, the output signal CNOB100, shown in the timing chart of FIG. 35, which is outputted from the level shifter control circuit CN_100 is inputted as the precharge pulse (precharge signal) PO (PO1, PO2, . . . , POn) to the delay circuit Pd (Pd1, Pd2, . . . , Pdn) of the same stage of the overlap prevention section 31*c*.

As described above, according to the flip-flop SR_100, the output signal Q is fed back to the level shifter control circuit CN_100, so that the output signal CNOB100 of the level shifter control circuit CN_100 becomes low before the output signal QB becomes active (low level). Therefore, by using the output signal CNOB100 of the level shifter control circuit CN_100 as the precharge signal PO, precharge can be performed prior to the QB serving as a sampling pulse.

Thus, even in cases where the flip-flop SR_100 shown in FIG. 32 is used instead of the flip-flop SR shown in FIG. 4, operation can be carried out in substantially the same manner as is the case where the flip-flop SR is used.

Whereas the level shifter control circuit CN of the flip-flop SR uses the NOR circuit (logic circuit) NR1, the level shifter control circuit CN_100 of the flip-flop SR_100 uses a switch (switch circuit) $SW_{CN}$. For this reason, the shift register can be operated at a high speed in cases where the amount of delay caused when a pulse passes through the switch circuit is smaller than the amount of delay caused when the pulse passes through the logic circuit.

In cases where the amount of delay of CNOB100 is large, it becomes impossible to pick up a rising edge of the clock signal SCK. In this case, the shift register becomes unable to sequentially shift at timings of rising edges (falling edges in an even-numbered flip-flop) of the clock signal SCK, so that the shift register becomes unable to operate at a normal timing. For this reason, it is preferable that whether the flip-flop SR or the flip-flop SR_100 is used be determined in accordance with the amount by which an output signal is delayed in a level shifter control circuit.

Further, the present embodiment explains the liquid crystal display device 1 in which the display section 2, the data signal line driver 31, and the scanning signal line driver 4 are monolithically formed. However, the present invention is not limited to this. The drivers 31 and 4 and the display section 2 may be formed on separate substrates.

Further, the present embodiment explains a case where the data signal line driver 31 is provided in the liquid crystal display device 1. However, the present invention is not limited to this. For example, the data signal line driver 31 may be applied to any display device, such as an organic EL display device, in which a wiring capacitor needs to be charged.

Embodiment 2

Another embodiment of the present invention is described. Unless otherwise specified, those members and signals which have the same functions and are capable of the same modifications (configuration changes) as those described in Embodiment 1 are given the same reference numerals, and are not described.

(Data Signal Line Driver 41)

Figure 20:
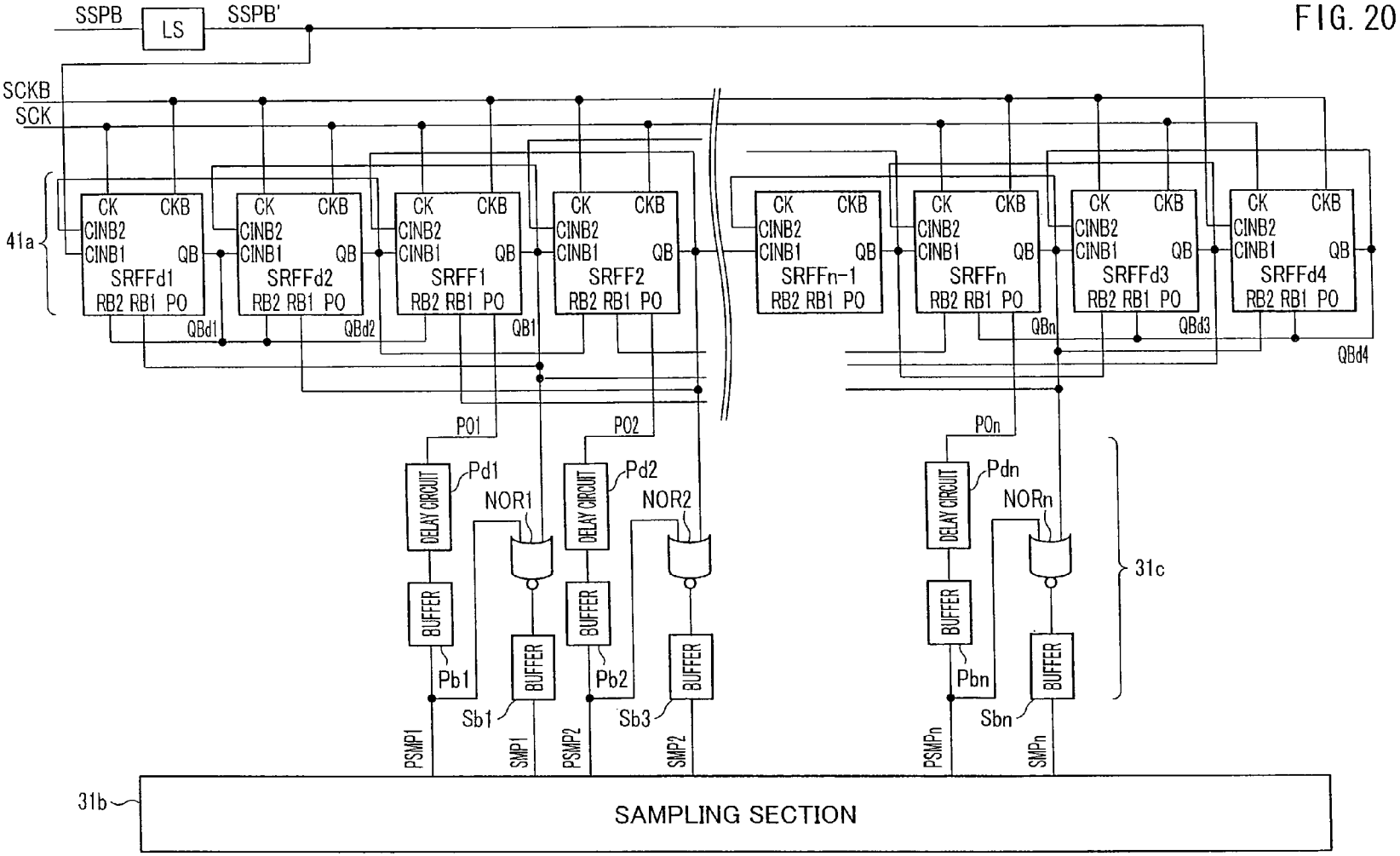
FIG. 20 is a block diagram showing a structure of a data signal line driver according to another embodiment of the present invention.

FIG. 20 is a block diagram showing a structure of a data signal line driver 41 according to the present embodiment. The data signal line driver 41 is provided in the liquid crystal display device 1 according to Embodiment 1 so as to replace the data signal line driver 31.

As shown in FIG. 20, the data signal line driver 41 includes a level shifter LS, a shift register 41*a*, a sampling section 31*b*, and an overlap prevention section 31*c*. The level shifter LS, the sampling section 31*b*, and the overlap prevention section 31*c* are arranged in the same manner as in Embodiment 1.

(Shift Register 41*a*)

The shift register 41*a* includes a plurality of set-reset flip-flops SRFF (SRFFd1, SRFFd2, SRFF1, SRFF2, . . . , SRFFn, SRFFd3, SRFFd4), and is a bidirectional shift register capable of switching between two shift directions, namely, a forward direction extending from SRFFd1 to SRFFd4 and a reverse direction extending from SRFFd4 to SRFFd1.

Each of the flip-flops SRFF includes a CK terminal, a CKB terminal, CINB1 and CINB2 terminals to which set signals are inputted, RB1 and RB2 terminals to which reset signals are inputted, a QB terminal from which a sampling signal QB (QB1, QB2, . . . , QBn) is outputted, a PO terminal from which a precharge signal PO (PO1, PO2, . . . , POn) is outputted, and an SC terminal (not shown) to which a shift-direction control signal (scan switching signal) SC is inputted. Note that the scan switching signal SC is outputted from the control circuit 5 of the liquid crystal display device 1.

In each of the odd-numbered SRFFd1, SRFF1, SRFF3, . . . , a clock signal SCK is inputted to the CK terminal, and an inversion clock signal (clock signal) SCKB is inputted to the CKB terminal. Further, in each of the even-numbered SRFFd2, SRFFd4, . . . , the inversion clock signal (clock signal) SCKB is inputted to the CK terminal, and the clock signal SCK is inputted to the CKB terminal.

Further, the CINB1 terminal of the first flip-flop SRFF1 and the CINB2 terminal of the last flip-flop SRFFd4 receive an output signal SSPB' of the level shifter LS as a set signal. The CINB1 terminal of each of the second and subsequent flip-flops SRFFd2, SRFFd1, . . . , SRFFd3, SRFFd4 is connected to the QB terminal of the previous flip-flop.

Meanwhile, the CINB2 terminal of each of the first to second last flip-flops SRFFd1 to SRFFd3 is connected to the QB terminal of the next flip-flop.

Further, the RB1 terminals of the first to n+2th flip-flops SRFFd1 to SRFFn receive output signals QB1, QB2, . . . , QBd4 from flip-flops located two stages after the flip-flops, respectively. Further, the RB1 terminal of the second last flip-flop SRFFd3 receives the output signal QBd4 from the last flip-flop SRFFd4, and the RB1 terminal of the last flip-flop SRFFd4 receives the output signal QBd4 from the last flip-flop SRFFd4.

Meanwhile, the RB2 terminal of the first flip-flop SRFFd1 receives the output signal QBd1 from the first flip-flop SRFFd1. Further, the RB2 terminal of the second flip-flop SRFFd2 receives the output signal QBd2 from the first flip-flop SRFFd1. Moreover, the RB terminal of each of the third to last flip-flops SRFF1 to SRFFd4 receives an output signal QB (QBd1, QBd2, QB1, . . . , QBn) from a flip-flop located two stages before the flip-flop.

Further, the PO terminal of each of the third to n+2th flip-flops SR1, SR2, . . . , SRn is connected to the corresponding delay circuit Pd (Pd1, Pd2, . . . , Pdn) provided in the overlap prevention section 31*c*.

(Flip-Flop SRFF)

Figure 21:
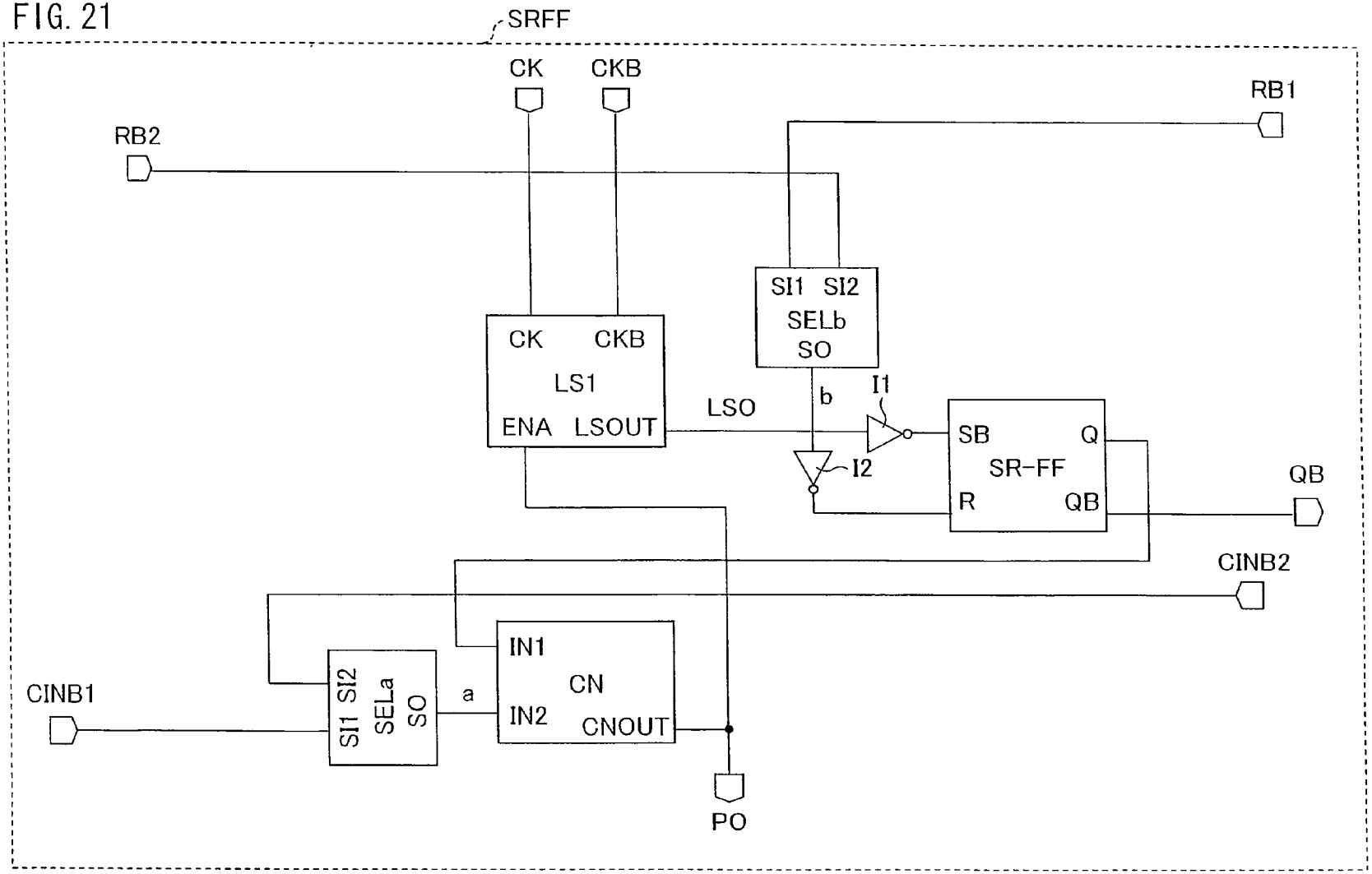
FIG. 21 is a block diagram showing a structure of a flip-flop SRFF provided in the data signal line driver according to the embodiment of the present invention.

FIG. 21 is a block diagram showing an example of a structure of each of the flip-flops SRFF (SRFFd1, SRFFd2, SRFF1, . . . , SRFFd4).

As shown in FIG. 21, each of the flip-flops SRFF includes a level shift control circuit CN, a level shifter LS, a set-reset flip-flop SR-FF, a selector SELa, a selector SELb, an inverter I1, and an inverter I2.

The level shift control circuit CN, the level shifter LS1, the flip-flop SR-FF are arranged in the same manner as the circuits described in Embodiment 1.

The selector SELa includes input terminals SI1 and SI2 and an output terminal SO. The input terminal SI1 of the selector SELa is connected to the CINB1 terminal of the flip-flop SRFF, and the input terminal SI2 is connected to the CINB2 terminal of the flip-flop SRFF. Further, the output terminal SO of the selector SELa is connected to an input terminal IN2 of the level shifter control circuit CN. Further, the selector SELa is supplied with the scan switching signal SC.

The selector SELb is arranged in the same manner as is the selector SELa, and includes input terminal SI1 and SI2 and an output terminal SO. The input terminal SI1 of the selector SELb is connected to the RB1 terminal of the flip-flop SRFF, and the input terminal SI2 is connected to the RB2 terminal of the flip-flop SRFF. Further, the output terminal SO of the selector SELb is connected to an input terminal of the inverter I2 whose output terminal is connected to the R terminal of the flip-flop SRFF. Further, the selector SELb is supplied with the scan switching signal SC.

Figure 22:
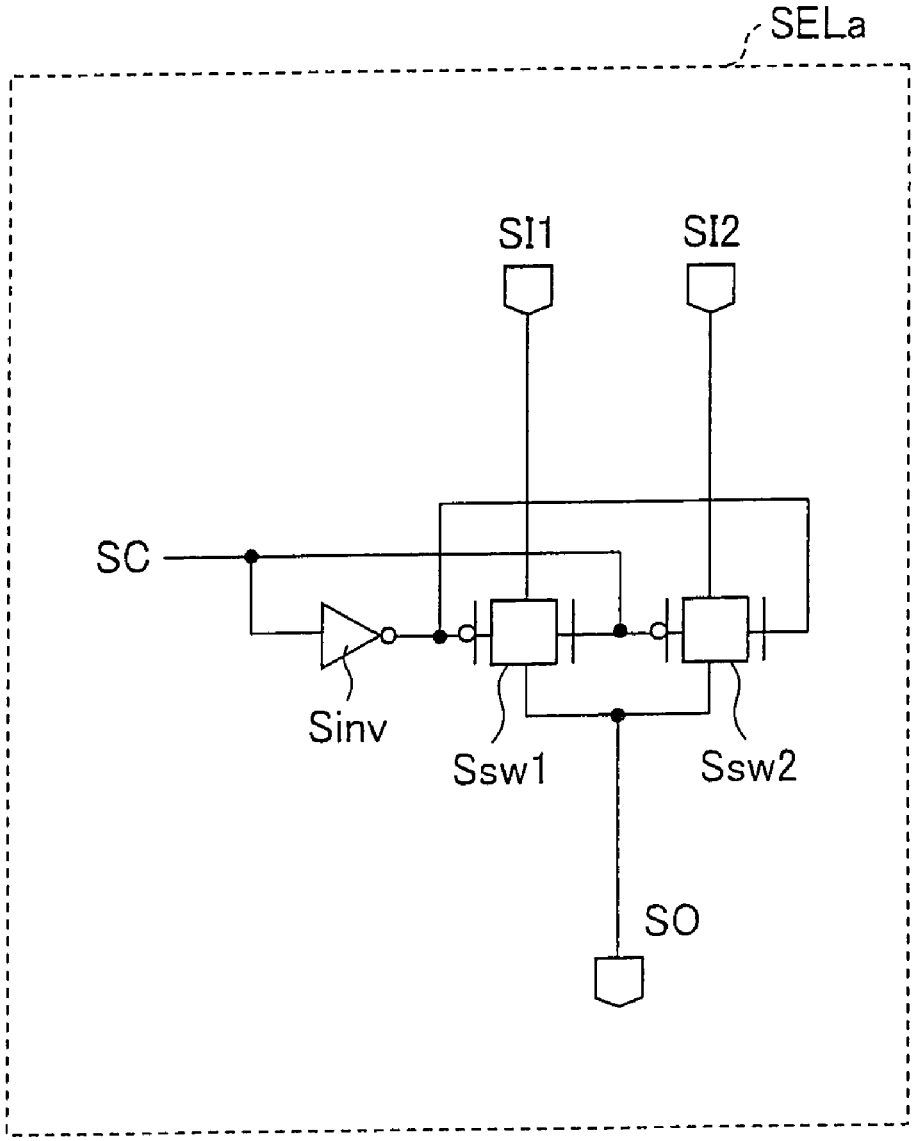
FIG. 22 is a block diagram showing a structure of a selector provided in the flip-flop shown in FIG. 21.

FIG. 22 is a block diagram showing an example of a structure of each of the selectors SELa and SELb. As shown in FIG. 22, each of the selectors SELa and SELb includes an inverter Sinv and switches Ssw1 and Ssw2.

Each of the switches Ssw1 and Ssw2 is an analog switch including an N-channel MOS transistor (TFT) having a gate to which an input signal is directly inputted and a P-channel MOS transistor (TFT) having a gate to which a signal obtained by inverting the input signal is inputted.

The inverter Sinv inverts the scan switching signal SC inputted to the selector SELa or SELb, and inputs the inverted signal to a gate of a P-channel MOS transistor of the switch SW1 or SW2 while allowing the gate to have such a capacitance as to be sufficiently capable of charge and discharge.

Each of the MOS transistors has a gate that is a capacitive control terminal, and each of the switches Ssw1 and Ssw2 becomes conductive or nonconductive in accordance with the charging voltage of the gate.

To one end of a channel path of the switch Ssw1, an input signal SI1 is inputted. To one end of a channel path of the switch Ssw1, an input signal SI2 is inputted. The other end of the channel path of the switch Ssw1 and the other end of the channel path of the switch Ssw2 are both connected to the output terminal SO.

According to the selector SELa or SELb thus arranged, in cases where the scan switching signal SC is at a high level indicative of a forward-direction scan, the transistors of the switch Ssw1 become conductive and the transistors of the switch Ssw2 become nonconductive. Therefore, the output terminal SO outputs, as output signal a or b, the signal inputted to the input terminal SI1.

Further, in cases where the scan switching signal is at a low level indicative of a reverse-direction scan, the transistors of the switch Ssw1 become nonconductive and the transistors of the switch Ssw2 become conductive. Therefore, the output terminal SO outputs, as the output signal a or b, the signal inputted to the input terminal SI2.

Figure 23:
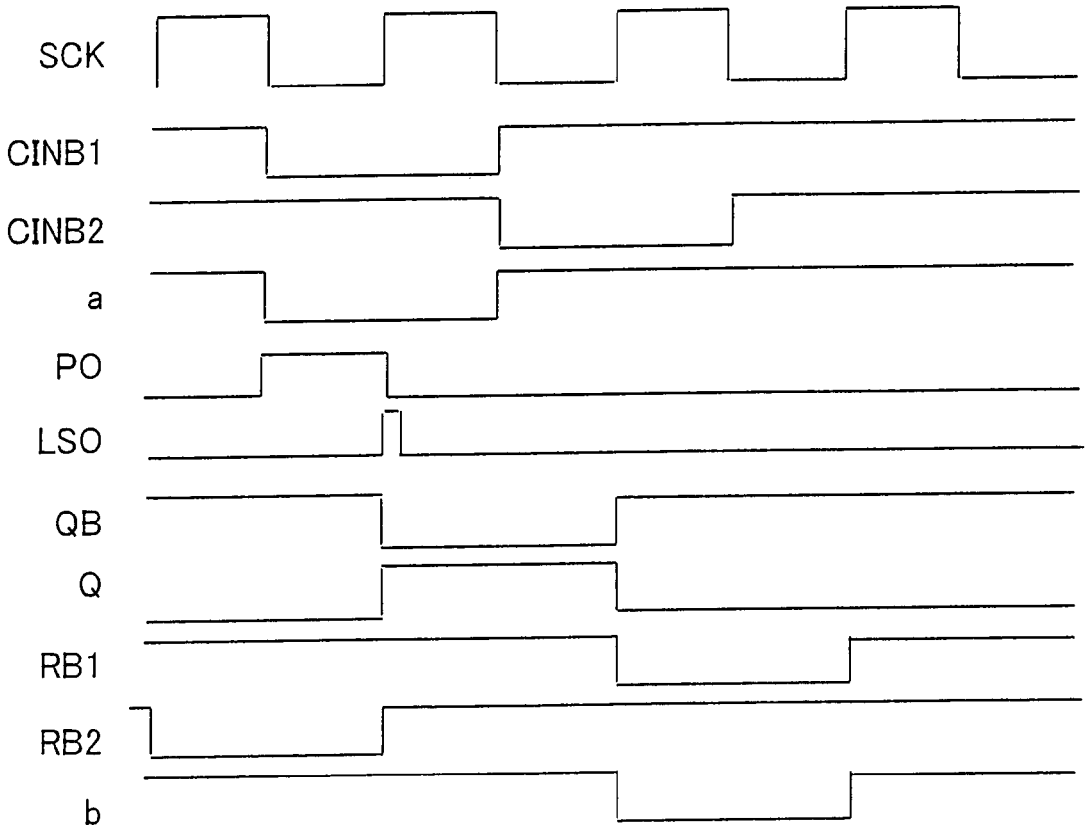
FIG. 23 is a timing chart, obtained when the shift direction is a forward direction, which shows signals relating to operation of the flip-flop shown in FIG. 21.

The following explains operation of the shift register 41*a*. First, a case where the shift direction is a forward direction (positive scan) is explained. FIG. 23 is a timing chart, obtained when the shift direction is a forward direction, which concerns each of the flip-flops SRFF.

In this case, the scan switching signal SC is at a high level indicative of a positive scan. Therefore, the selector SELa outputs, as the output signal a, the signal CINB1 inputted to the CINB1 terminal, and the selector SELb outputs, as the output signal b, the signal RB1 inputted to the RB1 terminal.

When the signal CINB1 inputted to the CINB1 terminal of the flip-flop SRFF becomes low, the output signal a of the selector SELa becomes low, so that, as explained in Embodiment 1, the output signal of the level shifter control circuit CN becomes high. Therefore, the precharge signal PO outputted from the PO terminal becomes high.

Thereafter, when the clock signal SCK becomes high, the output signal LSO of the level shifter LS1 becomes high, so that the output signals of the flip-flop SRFF become active (the signal Q at a high level; the signal QB at a low level). Here, the output signal Q of SR-FF is inputted to the input terminal IN1 of the level shifter control circuit CN. Therefore, when the output signal Q becomes high, the output signal (output signal PO) of the level shifter control circuit CN becomes low, so that the output signal LSO of the level shifter LS1 becomes low.

Thereafter, the signal RB1 inputted to the RB1 terminal of the flip-flop SRFF, i.e., the output signal QB of a flip-flop SRFF located two stages after the flip-flop SRFF (however, the respective RB1 terminals of the flip-flops SRFFd3 and SRFFd4 receive the output signal QBd4 of the flip-flop SRFFd4) becomes low, the output signal b of the selector SELb becomes low, so that the output signals Q and QB of the flip-flop SR-FF are reset to be nonactive (the signal Q at a low level; the signal QB at a high level).

Figure 24:
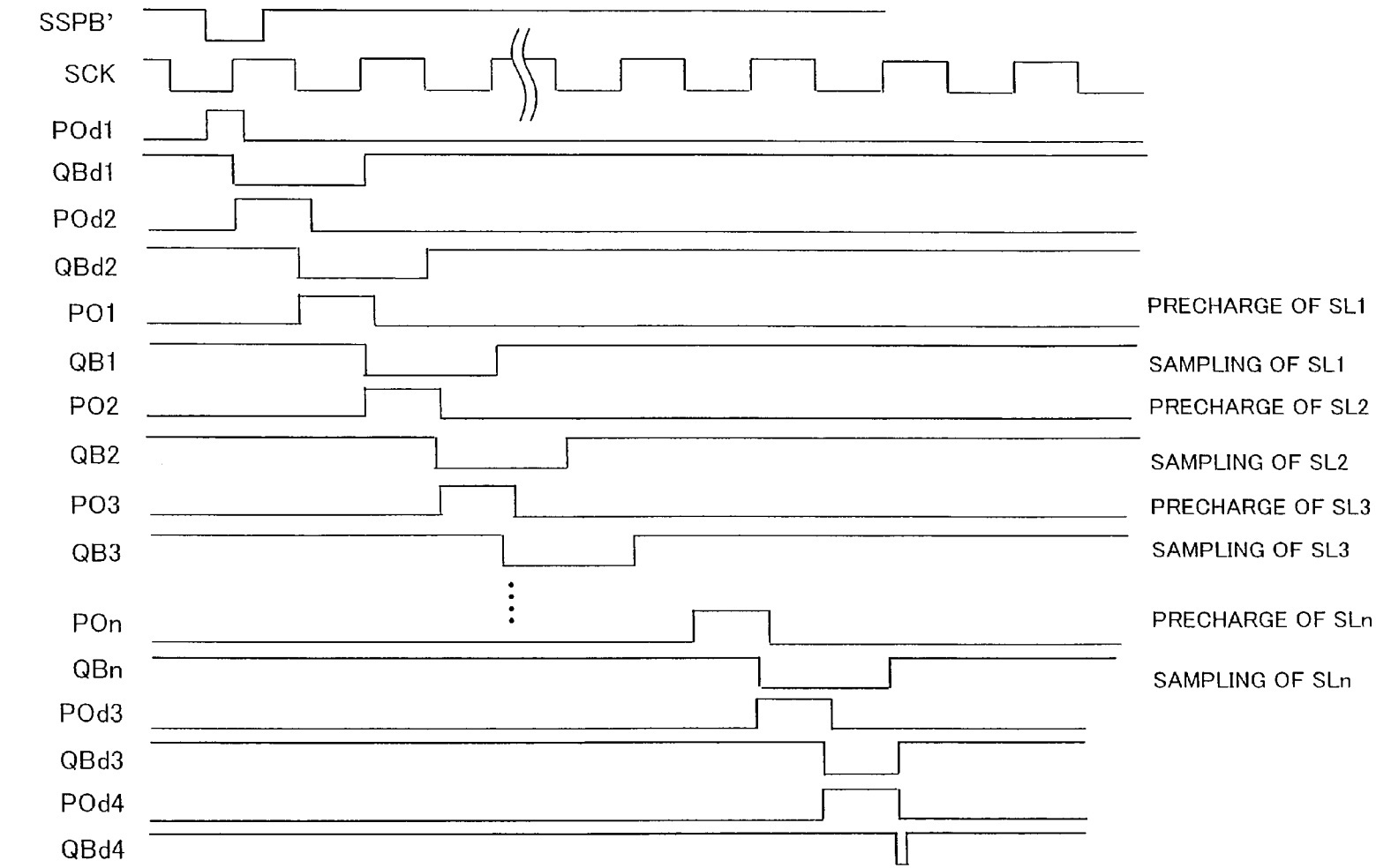
FIG. 24 is a timing chart, obtained when the flip-flop shown in FIG. 21 is shifted in a forward direction, which shows signals relating to operation of the data signal line driver according to the embodiment of the present invention.

FIG. 24 is a timing chart, obtained when the shift direction is a forward direction, which concerns the data signal line driver 41.

As shown in FIG. 24, when the signal SSPB', outputted from the level shifter LS, which is based on the start pulse SSPB becomes low, the signal POd1 outputted from the PO terminal of the flip-flop SRFFd1 becomes high. Thereafter, when the clock signal SCK becomes high, the sampling output signal QBd1 becomes low. Further, the output signal Qd1 is fed back to the level shifter control circuit CN. Therefore, when the output signal QBd1 becomes low (the output signal Qd1 becomes high), the output signal POd1 of the level shifter control circuit CN becomes low. Moreover, the output signal QB of the flip-flop SRFF1 located two stages after the flip-flop SRFFd1 becomes low, the output signal QBd1 of the flip-flop SRFFd1 is reset to a high level.

Further, the output signal QBd1 of the flip-flop SRFFd1 is inputted to the second flip-flop SRFFd2. Therefore, when the output signal QBd1 becomes low, the output signal POd2 of the level shifter control circuit CN provided in the second flip-flop SRFFd2 becomes high. Thereafter, when the clock signal SCK becomes low (the clock signal SCKB becomes high), the output signal QBd2 from the QB terminal is switched from a high level to a low level. Moreover, this causes the output signal POd2 of the level shifter control circuit CN to be low. Thereafter, when the output signal QB2 of the flip-flop SRFF2 located two stages after the flip-flop SRFFd2 becomes low, the output signal QBd2 of the flip-flop SRFFd2 is reset to a high level.

Further, the output signal QBd2 of the flip-flop SRFFd2 is inputted to the third flip-flop SRFF1. Therefore, when the output signal QBd2 becomes low, the output signal PO1 from the PO terminal provided in the third flip-flop SRFF1 becomes high. Thereafter, when the clock signal SCK is changed from a low level to a high level, the output signal QB1 from the QB terminal is switched from a high level to a low level. Moreover, this causes the output signal PO1 from the PO terminal to be low. Here, the output signal QB1 of the third flip-flop SRFF1 is inputted to the RB terminal of the first flip-flop SRFFd1. Therefore, when the output signal QB1 of the third flip-flop SRFF1 is switched to a low level, the output signal QBd1 of the first flip-flop SRFFd1 is reset to a high level.

The same is equally true of the subsequent flip-flops SRFF. That is, the same operation is carried out until that output signal QB of each of the flip-flops SRFF which has become low is reset to a high level when an output signal QB of a flip-flop SRFF located two stages after the flip-flop SRFF becomes low. Note that the flip-flops SRFFd3 and SRFFd4 serve as dummy circuits for outputting timings at which the output signals QBn−1 and QBn of the flip-flops SRFFn−1 and SRFFn are reset, respectively.

Thus, according to the data signal line driver 41, in cases where the shift direction is a forward direction (positive scan), a signal of each flip-flop SRFFk (k is an integer of 1 to n) is used for precharging a data signal line and a pixel capacitor that correspond to the flip-flop SRFFk. Further, an output signal of a flip-flop SRFFk+2 located two stages after the flip-flop SRFFk is used for resetting the output signals Qk and QBk of the flip-flop SR-FFk. With this, the sampling period is finished.

Figure 25:
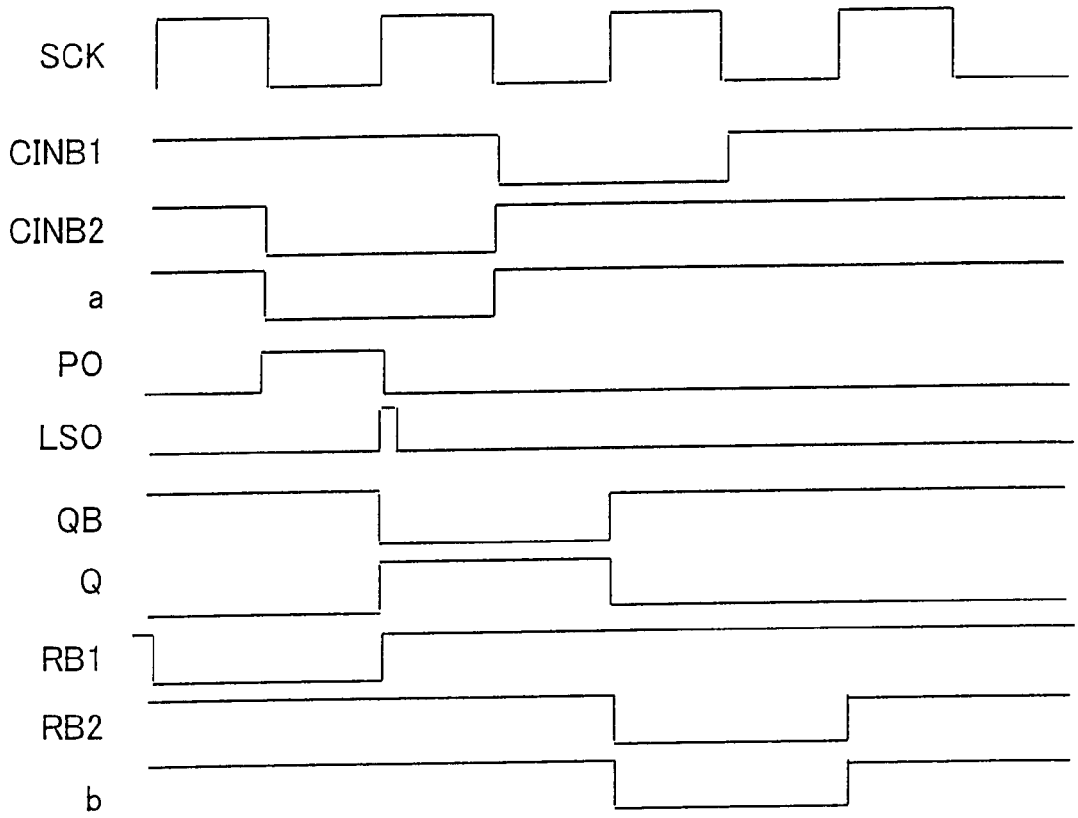
FIG. 25 is a timing chart, obtained when the shift direction is a reverse direction, which shows signals relating to operation of the flip-flop shown in FIG. 21.

The following explains a case where the shift direction is a reverse direction (reverse scan). FIG. 25 is a timing chart, obtained when the shift direction is a reverse direction, which concerns each of the flip-flops SRFF.

In this case, the scan switching signal SC is at a low level indicative of a reverse scan. Therefore, the selector SELa outputs, as the output signal a, the signal CINB2 inputted to the CINB2 terminal, and the selector SELb outputs, as the output signal b, the signal RB2 inputted to the RB2 terminal.

When the signal CINB2 inputted to the CINB2 terminal of the flip-flop SRFF becomes low, the output signal a of the selector SELa becomes low, so that, as explained in Embodiment 1, the output signal of the level shifter control circuit CN becomes high. Therefore, the precharge signal PO outputted from the PO terminal becomes high.

Thereafter, when the clock signal SCK becomes high, the output signal LSO of the level shifter LS1 becomes high, so that the output signals of the flip-flop SRFF become active (the signal Q at a high level; the signal QB at a low level). Here, the output signal Q of SR-FF is inputted to the input terminal IN1 of the level shifter control circuit CN. Therefore, when the output signal Q becomes high, the output signal (output signal PO) of the level shifter control circuit CN becomes low, so that the output signal LSO of the level shifter LS1 becomes low.

Thereafter, the signal RB2 inputted to the RB2 terminal of the flip-flop SRFF, i.e., the output signal QB of a flip-flop SRFF located two stages after the flip-flop SRFF along the shift direction (reverse scan direction) (however, the respective RB2 terminals of the flip-flops SRFFd2 and SRFFd1 receive the output signal QBd1 of the flip-flop SRFFd1) becomes low, the output signal b of the selector SELb becomes low, so that the output signals Q and QB of the flip-flop SR-FF are reset to be nonactive (the signal Q at a low level; the signal QB at a high level).

Figure 26:
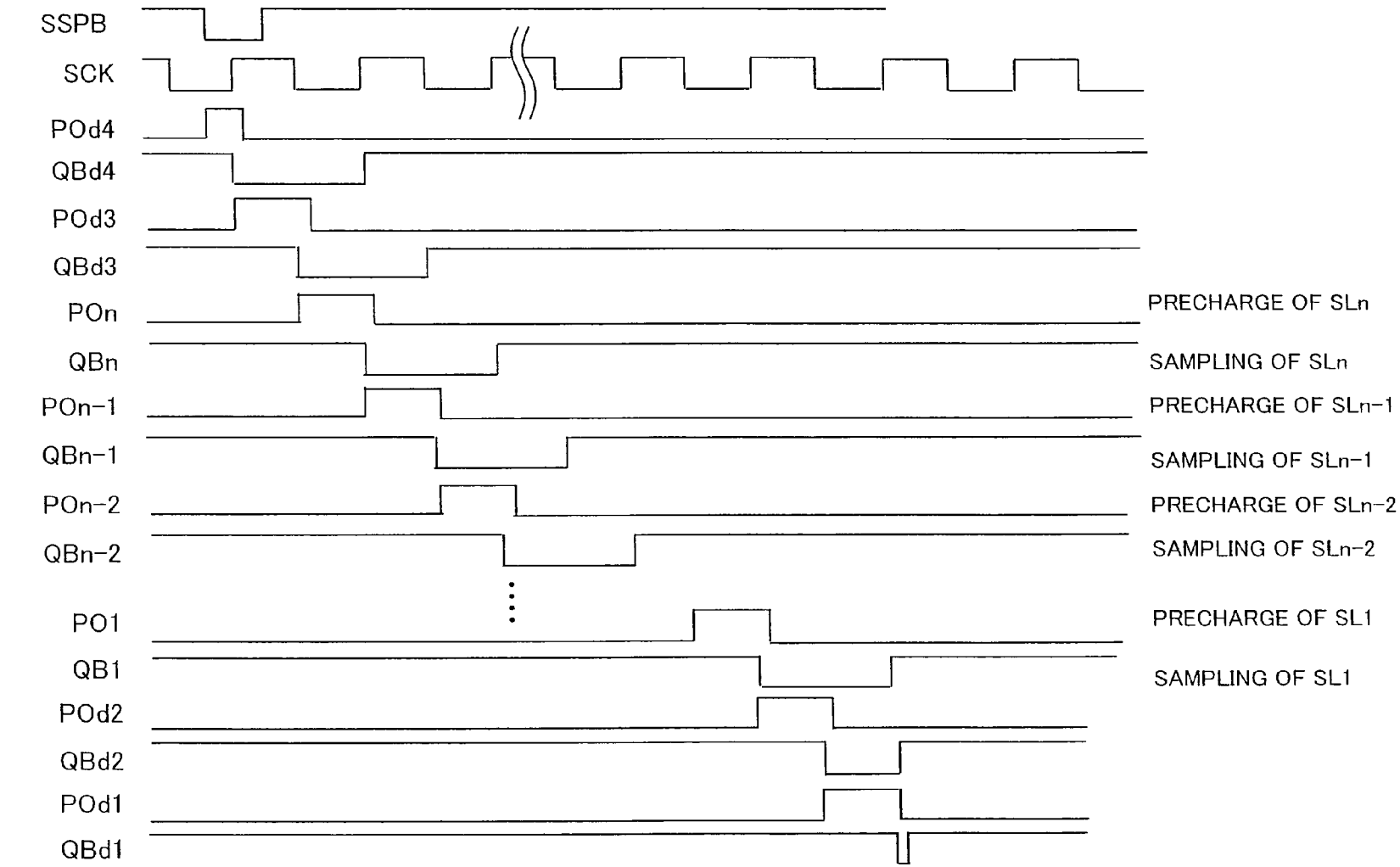
FIG. 26 is a timing chart, obtained when the flip-flop shown in FIG. 21 is shifted in a reverse direction, which shows signals relating to operation of the data signal line driver according to the embodiment of the present invention.

FIG. 26 is a timing chart, obtained when the shift direction is a reverse direction, which concerns the data signal line driver 41.

As shown in FIG. 26, when the signal SSPB', outputted from the level shifter LS, which is based on the start pulse SSPB becomes low, the signal POd4 outputted from the PO terminal of the flip-flop SRFFd4 becomes high. Thereafter, when the clock signal SCK becomes high, the sampling output signal QBd4 becomes low. Further, the output signal Qd4 is fed back to the level shifter control circuit CN. Therefore, when the output signal QBd4 becomes low (the output signal Qd4 becomes high), the output signal POd4 of the level shifter control circuit CN becomes low. Moreover, the output signal QBn of the flip-flop SRFFn located two stages after the flip-flop SRFFd1 along the shift direction becomes low, the output signal QBd4 of the flip-flop SRFFd4 is reset to a high level.

Further, the output signal QBd4 of the flip-flop SRFFd4 is inputted to the next (second along the shift direction) flip-flop SRFFd3. Therefore, when the output signal QBd4 becomes low, the output signal POd3 of the level shifter control circuit CN provided in the second flip-flop SRFFd3 becomes high. Thereafter, when the clock signal SCK becomes low (the clock signal SCKB becomes high), the output signal QBd3 from the QB terminal is switched from a high level to a low level. Moreover, this causes the output signal POd3 of the level shifter control circuit CN to be low. Thereafter, when the output signal QBn−1 of the flip-flop SRFFn−1 (located two stages after the flip-flop SRFFd2 along the shift direction) becomes low, the output signal QBd3 of the flip-flop SRFFd3 is reset to a high level.

Further, the output signal QBd3 of the flip-flop SRFFd3 is inputted to the next (third along the shift direction) flip-flop SRFFn. Therefore, when the output signal QBd3 becomes low, the output signal POn from the PO terminal provided in the third flip-flop SRFFn becomes high. Thereafter, when the clock signal SCK is changed from a low level to a high level, the output signal QBn from the QB terminal is switched from a high level to a low level. Moreover, this causes the output signal POn from the PO terminal to be low. Here, the output signal QBn of the third flip-flop SRFFn is inputted to the RB2 terminal of the first flip-flop SRFFd4. Therefore, when the output signal QBn of the third flip-flop SRFFn is switched to a low level, the output signal QBd4 of the first flip-flop SRFFd4 is reset to a high level.

The same is equally true of the flip-flops SRFF that follow along the shift direction. The same operation is carried out until that output signal QB of each of the flip-flops SRFF which has become low is reset to a high level when an output signal QB of a flip-flop SRFF located two stages after the flip-flop SRFF along the shift direction becomes low. Note that the flip-flops SRFFd2 and SRFFd1 serve as dummy circuits for outputting timings at which the output signals QB2 and QB1 of the flip-flops SRFF2 and SRFF1 are reset, respectively.

Thus, according to the data signal line driver 41, in cases where the shift direction is a reverse direction (reverse scan), a signal of each flip-flop SRFFk is used for precharging a data signal line and a pixel capacitor that correspond to the flip-flop SRFFk. Further, an output signal of a flip-flop SRFFk+2 located two stages after the flip-flop SRFFk along the shift direction (reverse scan direction) is used for resetting the output signals Qk and QBk of the flip-flop SR-FFk. With this, the sampling period is finished.

Therefore, according to the data signal line driver 41, regardless of whether the shift direction is a forward direction or reverse direction, a signal of each of the flip-flops SRFF is used for precharging a data signal line and a pixel capacitor that correspond to the flip-flop SRFF. Further, an output signal of a flip-flop SRFF located two stages after the flip-flop SRFF along the shift direction is used for resetting the output signals Q and QB of the flip-flop SRFF. With this, the sampling period can be finished.

As described above, according to the data signal line driver 41, a signal of each of the flip-flops SRFF are used for precharging a data signal line and a pixel capacitor that correspond to the flip-flop SRFF. Therefore, unlike in Patent Document 3 for example, it is not necessary to provide a precharge signal switching circuit for selecting an output stage of a precharge circuit driving signal in accordance with the shift direction of a bidirectional shift register.

According to the technique of Patent Document 3, the precharge signal switching circuit receives a precharge circuit driving signal from an output stage located two stages before the precharge signal switching circuit and a precharge circuit driving signal from an output stage located two stages after the precharge signal switching circuit. This causes such a problem that an increase in the amount of space that the precharge signal switching circuit occupies and an increase in the amount of space in which wires are provided cause an increase in the size of the driving circuit.

On the other hand, the data signal line driver 41 according to the present embodiment makes it unnecessary to provide such a precharge signal switching circuit and wires via which the precharge signal switching circuit receives a precharge circuit driving signal from an output stage located two stages before the precharge signal switching circuit and a precharge circuit driving signal from an output stage located two stages after the precharge signal switching circuit.

This makes it possible to simplify the structure of the data signal line driver 41 and to reduce the size of a wiring region, surrounding the data signal line driver 41, in which wires are provided. This makes it possible to reduce the outer size of the panel and to increase the ratio of the size of a display region to the outer size of the panel.

Modified Example

Modified Example of the Flip-Flop SRFF

In the present embodiment, the shift register 41*a* is described as including a plurality of set-reset flip-flops. However, the present invention is not limited to this.

Figure 27:
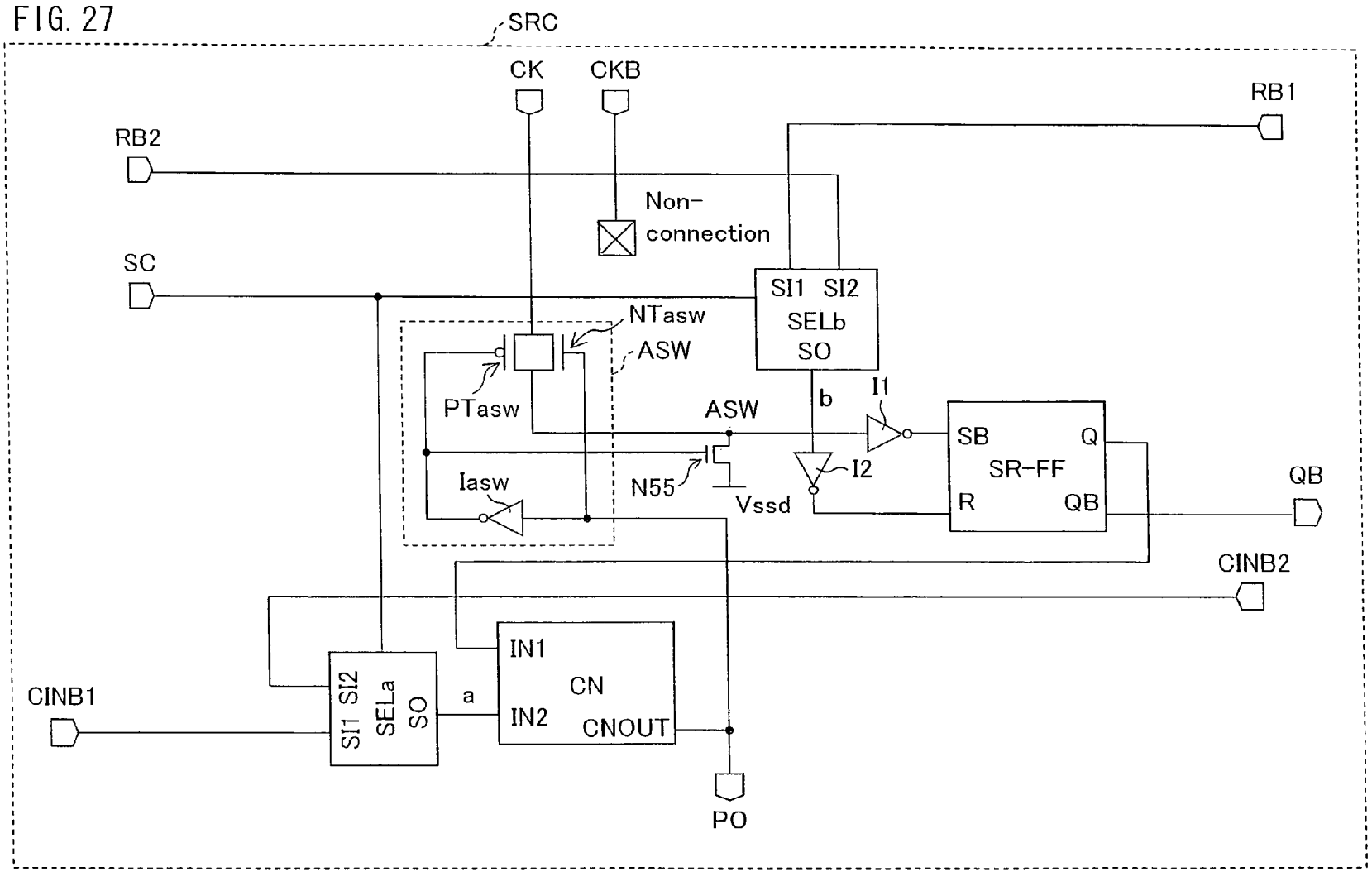
FIG. 27 is a block diagram showing a structure of a shift register circuit provided, instead of the flip-flop shown in FIG. 21, in the data signal line driver according to the embodiment of the present invention.

For example, each of the flip-flops SRFF (SRFFd1, SRFFd2, SRFF1, . . . , SRFFd4) may be replaced by a shift register circuit SRC (SRCd1, SRCd2, SRC1, SRC2, . . . , SRCd4) shown in FIG. 27.

As shown in FIG. 27, the shift register circuit SRC is arranged such that the level shifter LS1 of the flip-flop SRFF is replaced by a switch circuit ASW and that the CKB terminal serves as a non-connection terminal.

The switch circuit ASW includes an inverter Iasw, an N-channel MOS transistor (TFT) NTasw having a gate to which an input signal is directly inputted, and a P-channel MOS transistor (TFT) PTasw having a gate to which a signal obtained by inverting the input signal is inputted.

The inverter Iasw inverts the output signal (output signal PO) of the control circuit CN, and inputs the inverted signal to the gate of the P-channel MOS transistor PTasw while allowing the gate to have such a capacitance as to be sufficiently capable of charge and discharge. Note that the control circuit CN is arranged in the same manner as is the level shifter control circuit described above.

Further, the output of the inverter Iasw is connected to a gate of an N-type MOS transistor N55. A source of the transistor N55 is connected to a low-side power supply Vssd, and a drain of the transistor N55 is connected to the input terminal of the inverter I1.

Each of the MOS transistors has a gate that is a capacitive control terminal, and becomes conductive or nonconductive in accordance with the charging voltage of the gate. One end of a channel path of each of the MOS transistors is connected to the CK terminal. Note that the CK terminal of each of the odd-numbered shift register circuits SRCd1, SRC1, SRC3, . . . receives a clock signal SCK and that the CK terminal of each of the even-numbered shift register circuits SRCd2, SRC2, SRC4, . . . receives an inversion clock signal (clock signal) SCKB.

Further, the other end of the channel path of each of the MOS transistors is connected to the input terminal of the inverter I1. With this, the output signal ASW of the switch circuit ASW is inputted to the inverter I1.

Figure 28:
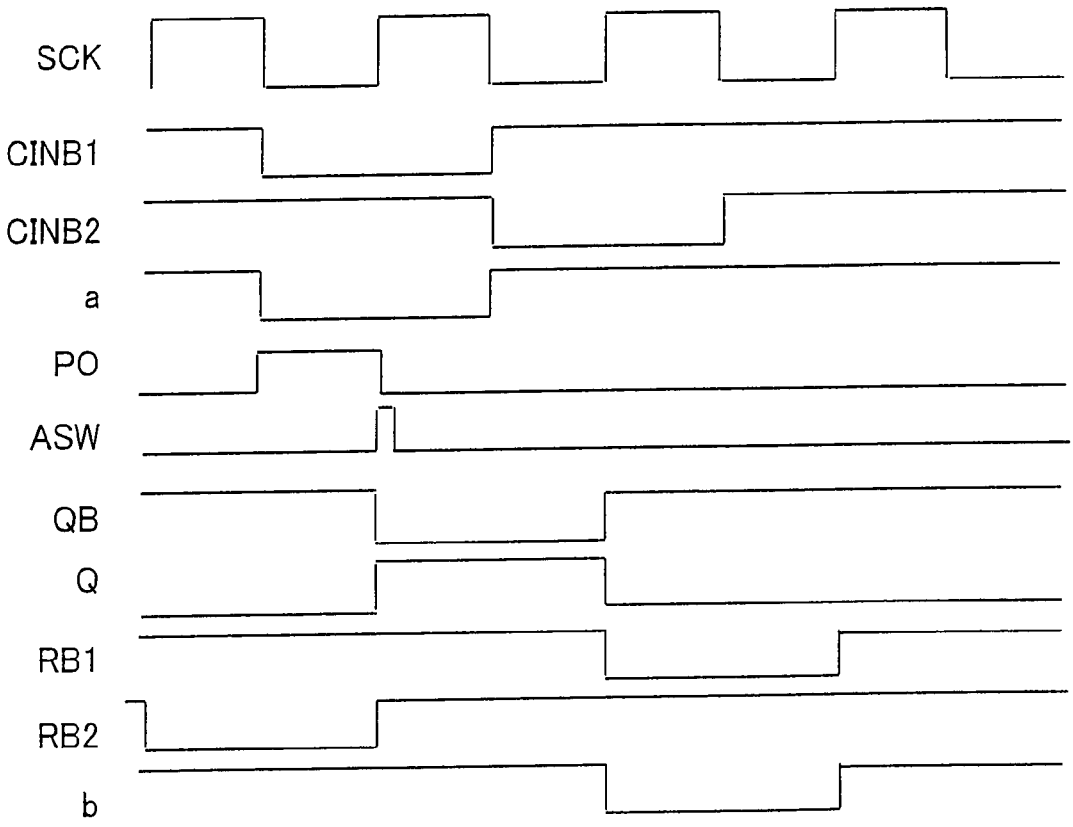
FIG. 28 is a timing chart, obtained when the shift direction is a forward direction, which shows signals relating to operation of the shift register circuit shown in FIG. 27.

FIG. 28 is a timing chart, obtained when the shift direction is a forward direction (positive scan), which concerns each of the shift register circuits SRC.

In this case, the scan switching signal SC is at a high level indicative of a positive scan. Therefore, the selector SELa outputs, as the output signal a, the signal CINB1 inputted to the CINB1 terminal, and the selector SELb outputs, as the output signal b, the signal RB1 inputted to the RB1 terminal.

When the signal CINB1 inputted to the CINB1 terminal of the flip-flop SRFF becomes low, the output signal a of the selector SELa becomes low, so that the output signal of the control circuit CN becomes high. Therefore, the precharge signal PO outputted from the PO terminal becomes high.

Further, when the output signal of the control circuit CN becomes high, the MOS transistors PTasw and NTasw of the switch circuit ASW become conductive.

Therefore, when the clock signal SCK becomes high thereafter, the output signal ASW of the switch circuit ASW becomes high, so that the output signals of the flip-flop SR-FF become active (the signal Q at a high level; the signal QB at a low level). Here, the output signal Q of the flip-flop SR-FF is inputted to the input terminal IN1 of the level shifter control circuit CN. Therefore, when the output signal Q becomes high, the output signal of the level shifter control circuit CN becomes low, so that the MOS transistors PTasw and NTasw of the switch circuit ASW become nonconductive. At this time, the inverter Iasw is at a low level. Therefore, the transistor N55 is turned on, so that the output signal ASW is pulled down to a low level.

Thereafter, the signal RB1 inputted to the RB1 terminal of the shift register circuit SRC, i.e., the output signal QB of a shift register circuit SRC located two stages after the shift register circuit SRC (however, the respective RB1 terminals of the shift register circuits SRCd3 and SRCd4 receive the output signal QBd4 of the flip-flop SRCd4) becomes low, the output signal b of the selector SELb becomes low, so that the output signals Q and QB of the shift register circuit SRC is reset to be nonactive (the signal Q at a low level; the signal QB at a high level).

Figure 29:
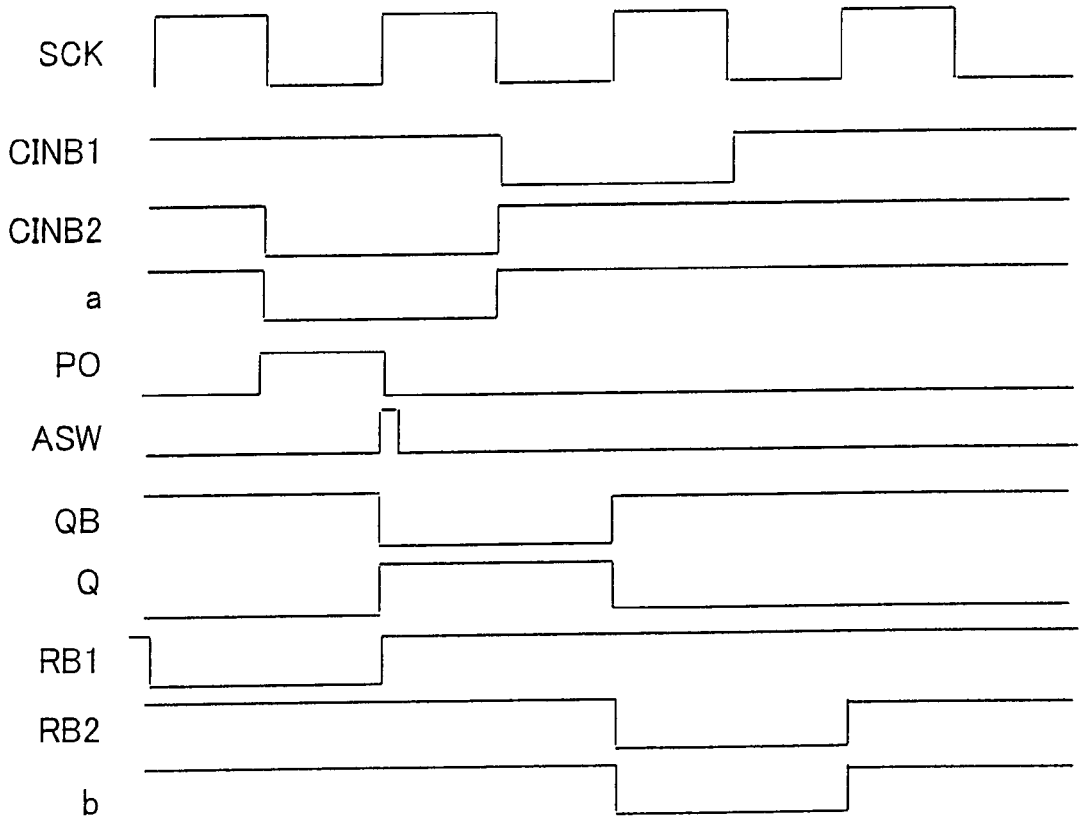
FIG. 29 is a timing chart, obtained when the shift direction is a reverse direction, which shows signals relating to operation of the shift register circuit shown in FIG. 27.
Figure 30:
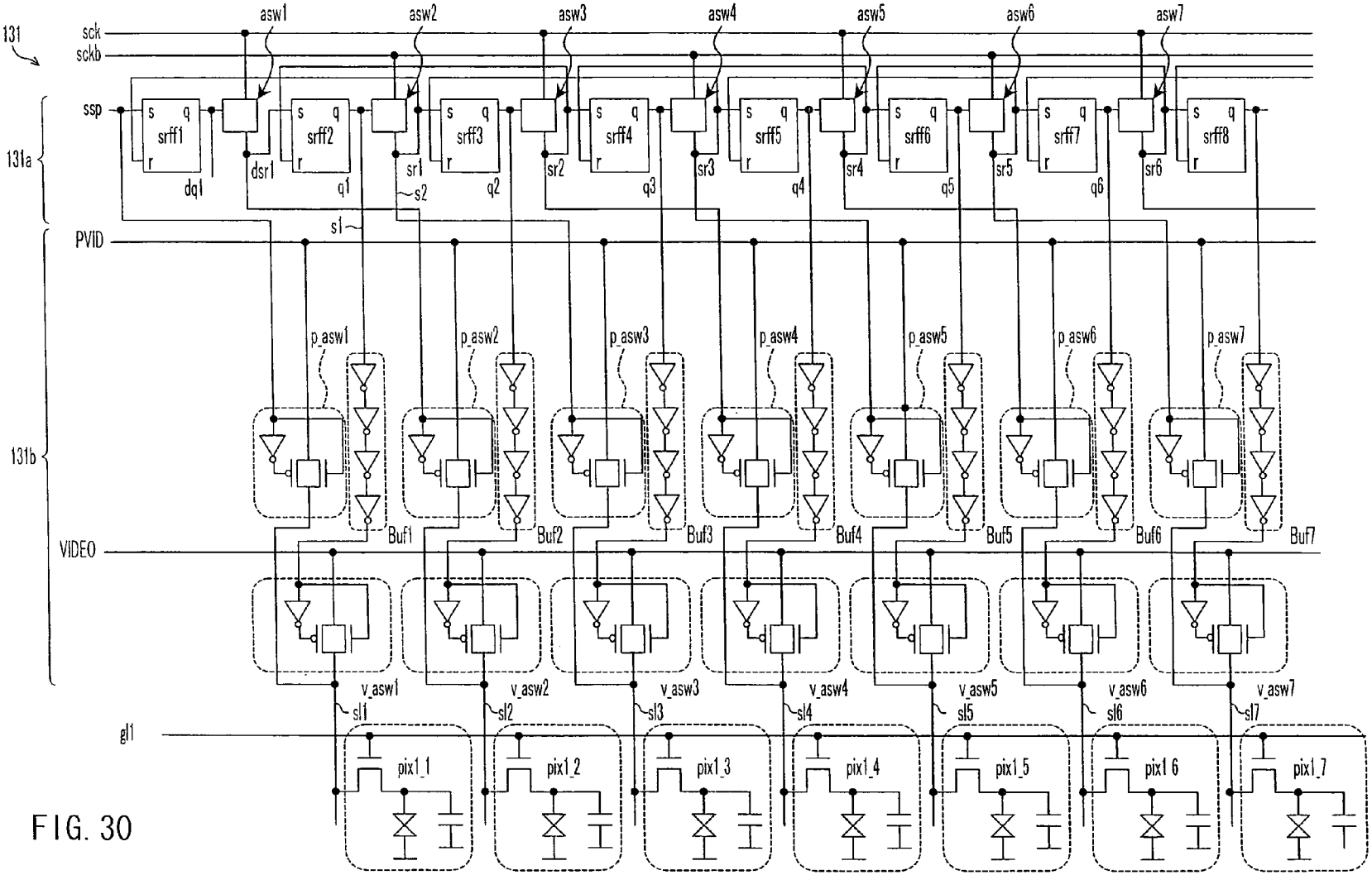
FIG. 30 is a block diagram showing a structure of a conventional data signal line driver.
Figure 31:
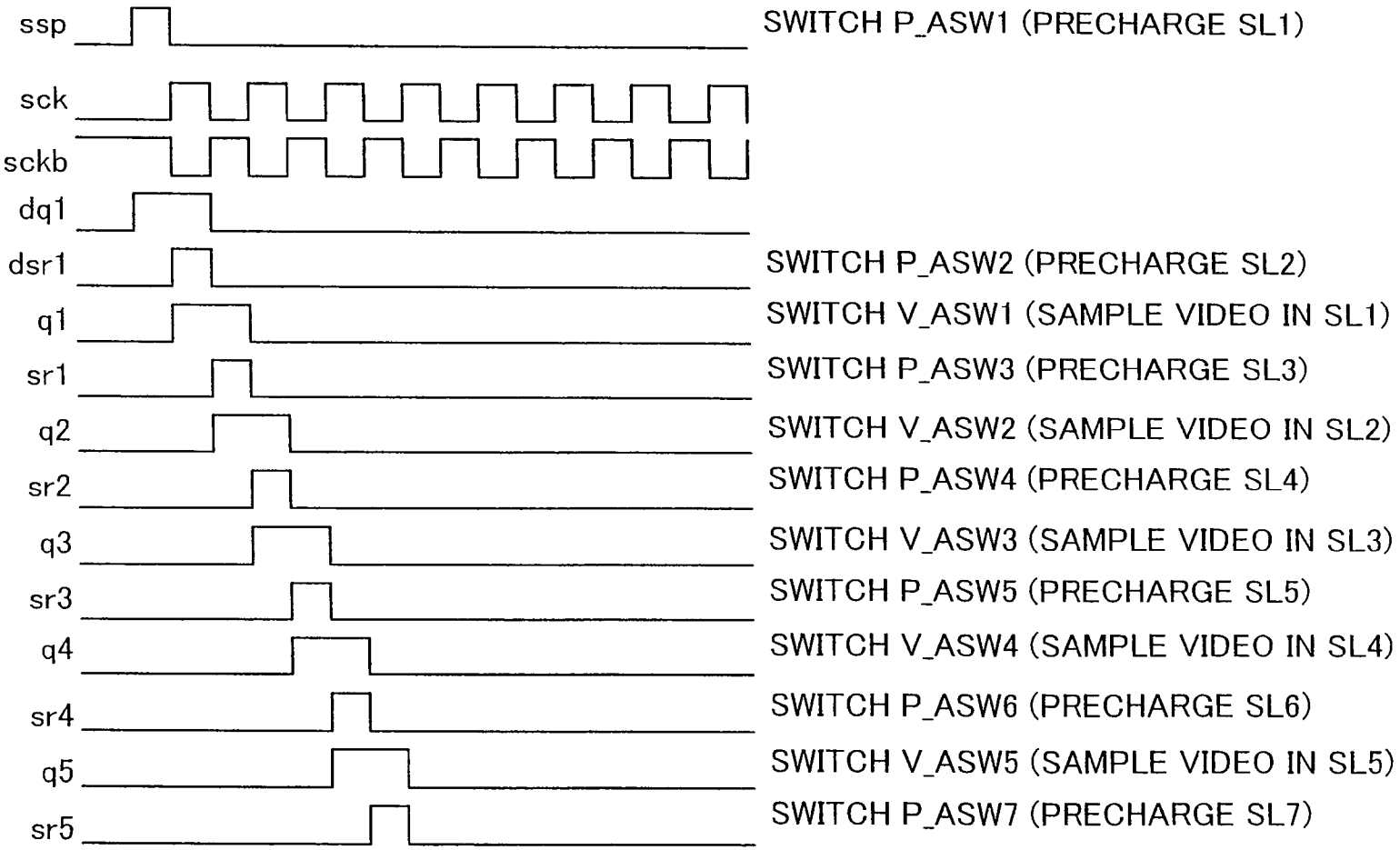
FIG. 31 is a timing chart showing signals relating to operation of the data signal line driver shown in FIG. 22.

FIG. 29 is a timing chart, obtained when the shift direction is a reverse direction (reverse scan), which concerns each of the shift register circuits SRC.

In this case, the scan switching signal SC is at a low level indicative of a reverse scan. Therefore, the selector SELb outputs, as the output signal a, the signal CINB2 inputted to the CINB2 terminal, and the selector SELb outputs, as the output signal b, the signal RB2 inputted to the RB2 terminal.

When the signal CINB2 inputted to the CINB2 terminal of the flip-flop SRFF becomes low, the output signal a of the selector SELa becomes low, so that the output signal of the control circuit CN becomes high. Therefore, the precharge signal PO outputted from the PO terminal becomes high.

Further, when the output signal of the control circuit CN becomes high, the MOS transistors PTasw and NTasw of the switch circuit ASW become conductive.

Therefore, when the clock signal SCK becomes high thereafter, the output signal ASW of the switch circuit ASW becomes high, so that the output signals of the flip-flop SR-FF become active (the signal Q at a high level; the signal QB at a low level). Here, the output signal Q of SR-FF is inputted to the input terminal IN1 of the level shifter control circuit CN. Therefore, when the output signal Q becomes high, the output signal of the level shifter control circuit CN becomes low, so that the MOS transistors PTasw and NTasw of the switch circuit ASW become nonconductive. At this time, the inverter Iasw is at a low level. Therefore, the transistor N55 is turned on, so that the output signal ASW is pulled down to a low level.

Thereafter, the signal RB2 inputted to the RB2 terminal of the shift register circuit SRC, i.e., the output signal QB of a shift register circuit SRC located two stages after the shift register circuit SRC along the shift direction (reverse scan direction) (however, the respective RB2 terminals of the shift register circuits SRCd2 and SRCd1 receive the output signal QBd1 of the shift register circuit SRCd1) becomes low, the output signal b of the selector SELb becomes low, so that the output signals Q and QB of the flip-flop SR-FF is reset to be nonactive (the signal Q at a low level; the signal QB at a high level).

Therefore, even in cases where a shift register circuit SRC shown in FIG. 27 is used, the data signal line driver 41 operates in substantially the same manner as is the case where the aforementioned flip-flop SRFF is used.

Further, the above description explains a case where the shift register circuit SRC is provided in the bidirectional shift register 41*a*. However, the present invention is not limited to this. For example, the shift register circuit SRC may be provided in the shift register 31*a* of Embodiment 1. In this case, the selector SELa is omitted, and the IN2 terminal of the level shifter control circuit CN (in this case, the level shifter control circuit CN serves not as a level shifter control circuit but as a control circuit, but has an identical circuit structure) is connected to the CINB1 terminal (CINB terminal). In addition, the selector SELb is omitted, and the input terminal of the inverter I2 is connected to the RB1 terminal (RB terminal).

Further, the display section 2, the data signal line driver 41, and the scanning signal line driver 4 may be monolithically formed, or may be formed on separate substrates.

Further, the present embodiment explains a case where the data signal line driver 41 is provided in the liquid crystal display device 1. However, the present invention is not limited to this. For example, the data signal line driver 41 may be applied to any display device, such as an organic EL display device, in which a wiring capacitor needs to be charged.

As described above, a display device driving circuit of the present invention is a display device driving circuit, including: a write circuit, including first switches respectively corresponding to a plurality of signal supply lines provided in a display device, which writes a write signal in each of the signal supply lines when a first switch corresponding to the signal supply line is conductive; a shift register, including a plurality of pulse generating means for generating timing pulses for causing the first switches to be conductive, which sequentially outputs the timing pulses to the signal supply lines, respectively; and a precharge circuit, including second switches respectively corresponding to the signal supply lines, which precharges each of the signal supply lines when a second switch corresponding to the signal supply line is conductive, each of the pulse generating means receiving a timing pulse outputted from previous pulse generating means, in a period between (i) a point of time where the timing pulse is changed to an active level at which a first switch corresponding to the previous pulse generating means is made conductive and (ii) a point of time where the each of the pulse generating means outputs a timing pulse that is at an active level, the each of the timing pulse generating means outputting a precharge pulse for causing a second switch to be conductive, which second switch corresponds to a signal supply line in which the write signal is to be written in accordance with the timing pulse outputted by the each of the timing pulse generating means, and for thereby causing the signal supply line to be precharged.

According to the foregoing arrangement, each of the pulse generating means outputs a precharge pulse for causing a second switch to be conductive, which second switch corresponds to a signal supply lines in which the write signal is to be written in accordance with a timing pulse outputted by the pulse generating means, and for thereby causing the signal supply line to be precharged. This makes it unnecessary to provide a dummy circuit, needed conventionally, for outputting a precharge pulse for causing a signal supply line to be precharged, in which signal supply line the write signal is to be written in accordance with (i) a timing pulse outputted by the first pulse generating means or (ii) timing pulses respectively outputted by the first and second pulse generating means. This makes it possible to reduce the amount of space for a display device driving circuit including a precharge circuit and the amount of space, surrounding the driving circuit, in which wires are provided.

Further, the display device driving circuit may be arranged so as to further include: overlap preventing means respectively corresponding to output lines via which the timing pulses are outputted, wherein each of the overlap preventing means eliminates a portion of a period during which a timing pulse to be supplied to an output line is at an active level, which portion overlaps a period during which a precharge pulse for causing a signal supply line to be precharged is at an active level, in which signal supply line the write signal is to be written in accordance with the timing pulse, and at which active level a second switch corresponding to the signal supply line is made conductive.

According to the foregoing arrangement, the overlap preventing means provided in each of the output lines via which the timing pulses are outputted eliminates a portion of a period during which a timing pulse to be supplied to an output line is at an active level, which portion overlaps a period during which a precharge pulse for causing a signal supply line to be precharged is at an active level, in which signal supply line the write signal is to be written in accordance with the timing pulse. Therefore, for example, even if such a flip-flop output is used that a back end of the active period of the precharge pulse and a front end of the active period of the timing pulse are synchronized with each other, the active period of the precharge pulse and the active period of the timing pulse do not overlap each other, so that it is possible to surely prevent a pair of a first switch for sampling and a second switch for precharge, which pair is provided in each signal supply line, from becoming conductive simultaneously. This makes it possible to surely prevent a rite signal and a precharge signal from colliding with each other on a data signal line.

Further, the display device driving circuit may be arranged so as to further include: delay means for delaying a precharge pulse outputted from the each of the pulse generating means, and for outputting the precharge pulse to a second switch and overlap preventing means each corresponding to the each of the pulse generating means, wherein the overlap preventing means eliminates a portion of a period during which the timing pulse is at an active level, which portion overlaps a period during which the precharge pulse outputted by the delay means is at an active level.

According to the foregoing arrangement, the overlap preventing means eliminates that portion of the active period of the timing pulse which overlaps the active period of the precharge pulse outputted by the delay means. Therefore, the front end of the active period of the timing pulse is deleted by a larger amount, so that the timing pulses can be prevented from overlapping each other. Overlap between timing pulses causes oscillations in the potential of a video signal line. This causes display quality to deteriorate, for example, due to a decrease in display uniformity. However, by thus preventing timing pulses from overlapping each other, a decrease in display uniformity can be prevented.

Further, the display device driving circuit may be arranged such that: when a timing pulse outputted by subsequent pulse generating means located a predetermined number of stages after the each of the pulse generating means becomes active, the timing pulse outputted by the each of the pulse generating means is changed to a nonactive level at which a first switch corresponding to the each of the pulse generating means is made nonconductive; and the precharge pulse is delayed by the delay means by an amount of time longer than a period between (i) a point of time where the timing pulse outputted by the subsequent pulse generating means becomes active and (ii) a point of time where the timing pulse outputted by the each of the pulse generating means becomes nonactive.

The foregoing arrangement makes it possible to surely eliminate a portion of a period during which a timing pulse outputted by the each of the pulse generating means is active, which portion overlaps a period during which a timing pulse outputted by pulse generating means located a predetermined number of stages after the each of the pulse generating means is active. Therefore, a decrease in display quality can be surely prevented.

Further, the display device driving circuit may be arranged such that: the each of the pulse generating means includes (i) a set-reset flip-flop for outputting the timing pulse and (ii) control means for controlling a set signal of the flip-flop; and when a timing pulse outputted by pulse generating means located right in front of the pulse generating means in which the control means is provided is active and when a timing pulse outputted by the pulse generating means in which the control means is provided is nonactive, the control means causes a clock signal or a signal, obtained by transforming the clock signal, to be the set signal of the flip-flop; and the flip-flop causes a timing pulse to be a reset signal, which timing pulse is outputted by pulse generating means located a predetermined number of stages after the pulse generating means in which the flip-flop is provided.

According to the foregoing arrangement, when a timing pulse outputted by signal line selecting means located right in front of the pulse generating means in which the control means is provided is active and when a timing pulse outputted by the pulse generating means in which the control means is provided is nonactive, the control means causes a clock signal or a signal, obtained by transforming the clock signal, to be the set signal of the flip-flop. Therefore, a signal supply line corresponding to the each of the pulse generating means is appropriately precharged while the write signal is written in a signal supply line corresponding to the pulse generating means located right in front of the each of the pulse generating means and before the write signal starts to be written in the signal supply line corresponding to the each of the pulse generating means.

Further, the display device driving circuit may be arranged such that: in an odd-numbered one of the pulse generating means, either of a clock signal or an inversion clock signal is used as the clock signal; and in an even-numbered one of the pulse generating means, the other one of the clock signal or the inversion clock signal is used as the clock signal.

According to the foregoing arrangement, even if the clock signal has low amplitude, a clock signal and an inversion clock signal can be used in cases where a level shift is needed. This makes it possible to carry out a stable level shift.

Further, the display device driving circuit may be arranged such that: the shift register is a bidirectional shift register allowing a switching of a shift direction in which the plurality of pulse generating means sequentially output the timing pulses; and the each of the pulse generating means includes (i) first selector means for selecting a timing pulse outputted by pulse generating means located right in front of the each of the pulse generating means along the shift direction, and for outputting the timing pulse to the control means and (ii) second selector means for selecting a timing pulse outputted by pulse generating means located a predetermined number of stages after the each of the pulse generating means along the shift direction, and for inputting the timing pulse to the flip-flop as a reset signal.

The foregoing arrangement makes it unnecessary that a precharge signal switching circuit, such as that provided in an electro-optic device driving circuit of Patent Document 3, for selecting a signal line to be precharged be provided in a display device driving circuit, including a bidirectional shift register, which allows a switching of a direction in which the write signal is sequentially written in the signal lines. Therefore, the size of a display device driving circuit can be reduced.

Further, the display device driving circuit may be arranged such that: the number of the output lines via which the timing pulses are outputted, the number of output lines via which the precharge pulses are outputted, and the number of the signal supply lines correspond to one another; and the second switches are made conductive one after another; and the first switches are made conductive one after another so that there is no overlap between (i) a period during which each of the first switches is conductive and (ii) a period during which a second switch is conductive, which second switch corresponds to a signal supply line in which the write signal is to be written when the each of the first switches is conductive.

The foregoing arrangement makes it unnecessary to provide a dummy circuit, needed conventionally, for outputting a precharge pulse for causing a signal supply line to be precharged, in which signal supply line the write signal is to be written in accordance with (i) a timing pulse outputted by the first pulse generating means or (ii) timing pulses respectively outputted by the first and second pulse generating means. This makes it possible to reduce the amount of space a display device driving circuit including a precharge circuit occupies and the amount of space, surrounding the driving circuit, in which wires are provided.

Further, the display device driving circuit may be arranged such that: the number of the output lines via which the timing pulses are outputted, the number of output lines via which the precharge pulses are outputted, and the number of groups each including a predetermined number of the signal supply lines correspond to one another; second switches constituting each of the groups are made conductive simultaneously and the groups of second switches are made conductive one after another; and first switches constituting each of the groups are made conductive simultaneously and the groups of first switches are made conductive one after another so that there is no overlap between (i) a period during which the first switches are conductive and (ii) a period during which second switches are conductive, which second switches correspond to signal supply lines in which the write signal is to be written when the first switches are conductive.

The foregoing arrangement makes it unnecessary that a dummy circuit for outputting a precharge pulse for causing a signal supply line to be precharged, in which signal supply line the write signal is to be written in accordance with (i) a timing pulse outputted by the first pulse generating means or (ii) timing pulses respectively outputted by the first and second pulse generating means, be provided in a so-called multipoint simultaneous driving method driving circuit or phase expansion method driving circuit, in which the write signal is sequentially written in groups of signal supply lines in accordance with a timing pulse outputted by each of the pulse generating means. Therefore, the size of the driving circuit can be reduced. In a multipoint simultaneous driving method driving circuit or phase expansion method driving circuit, the number of wires to be provided around the driving circuit is large. Therefore, by reducing the size of the driving circuit, the amount of space that a non-display region occupies in a display device in which the driving circuit is provided can be effectively reduced.

Further, a display device of the present invention is a display device, including: a plurality of pixels; data signal lines, provided so as to correspond to the pixels, which serves as a plurality of signal supply lines; scanning signal lines, provided so as to correspond to the pixels, which serve as a plurality of signal supply lines; a data signal line driver for writing, in the data signal lines and the pixel, a video signal serving as a write signal; and a scanning signal line driver for writing, in the scanning signal lines, a scanning signal serving as a write signal, so as to select a pixel in which the video signal is to be written, the display device including a display device driving circuit of any one of the foregoing arrangements as the data signal line driver.

According to the foregoing arrangement, the size of a display device driving circuit can be reduced. Therefore, a display device having a wide display area can be realized by reducing the amount of space that a frame occupies in a display section, i.e., the amount of space that a non-display region occupies in a display section.

The present invention is not limited to the description of the embodiments above, but may be altered by a skilled person within the scope of the claims. An embodiment based on a proper combination of technical means disclosed in different embodiments is encompassed in the technical scope of the present invention. That is, the embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention can be suitably used, for example, for a data signal line driving circuit provided in a display device such as an image display device.

The invention claimed is:

1. A display device driving circuit, comprising:

a write circuit, including first switches respectively corresponding to a plurality of signal supply lines provided in a display device, which writes a write signal in each of the signal supply lines when a first switch corresponding to the signal supply line is conductive;

a shift register, including a plurality of pulse generating means for generating timing pulses for causing the first switches to be conductive, which sequentially outputs the timing pulses to the signal supply lines, respectively;

a precharge circuit, including second switches respectively corresponding to the signal supply lines, which precharges each of the signal supply lines when a second switch corresponding to the signal supply line is conductive, each of the pulse generating means receiving a timing pulse outputted from previous pulse generating means in a period between (i) a point of time where the timing pulse is changed to an active level at which a first switch corresponding to the previous pulse generating means is made conductive and (ii) a point of time where said each of the pulse generating means outputs a timing pulse that is at an active level, said each of the timing pulse generating means outputting a precharge pulse for causing a second switch to be conductive, which second switch corresponds to a signal supply line in which the write signal is to be written in accordance with the timing pulse outputted by said each of the timing pulse generating means, and for thereby causing the signal supply line to be precharged;

overlap preventing means respectively corresponding to output lines via which the timing pulses are outputted, wherein each of the overlap preventing means eliminates a portion of a period during which a timing pulse to be supplied to an output line is at an active level, which portion overlaps a period during which a precharge pulse for causing a signal supply line to be precharged is at an active level, in which signal supply line the write signal is to be written in accordance with the timing pulse, and at which active level a second switch corresponding to the signal supply line is made conductive; and delay means for delaying a precharge pulse outputted from said each of the pulse generating means, and for outputting the precharge pulse to a second switch and overlap preventing means each corresponding to said each of the pulse generating means, wherein the overlap preventing means eliminates a portion of a period during which the timing pulse is at an active level, which portion overlaps a period during which the precharge pulse outputted by the delay means is at an active level, when a timing pulse outputted by subsequent pulse generating means located a predetermined number of stages after said each of the pulse generating means becomes active, the timing pulse outputted by said each of the pulse generating means is changed to a nonactive level at which a first switch corresponding to said each of the pulse generating means is made nonconductive, and the precharge pulse is delayed by the delay means by an amount of time longer than a period between (i) a point of time where the timing pulse outputted by the subsequent pulse generating means becomes active and (ii) a point of time where the timing pulse outputted by said each of the pulse generating means becomes nonactive.

2. The display device driving circuit as set forth in claim 1, wherein:

the number of the output lines via which the timing pulses are outputted, the number of output lines via which the precharge pulses are outputted, and the number of the signal supply lines correspond to one another; and the second switches are made conductive one after another; and the first switches are made conductive one after another so that there is no overlap between (i) a period during which each of the first switches is conductive and (ii) a period during which a second switch is conductive, which second switch corresponds to a signal supply line in which the write signal is to be written when said each of the first switches is conductive.

3. The display device driving circuit as set forth in claim 1, wherein:

the number of the output lines via which the timing pulses are outputted, the number of output lines via which the precharge pulses are outputted, and the number of groups each including a predetermined number of the signal supply lines correspond to one another;

second switches constituting each of the groups are made conductive simultaneously and the groups of second switches are made conductive one after another; and first switches constituting each of the groups are made conductive simultaneously and the groups of first switches are made conductive one after another so that there is no overlap between (i) a period during which the first switches are conductive and (ii) a period during which second switches are conductive, which second switches correspond to signal supply lines in which the write signal is to be written when said first switches are conductive.

4. A display device driving circuit, comprising:

a write circuit, including first switches respectively corresponding to a plurality of signal supply lines provided in a display device, which writes a write signal in each of the signal supply lines when a first switch corresponding to the signal supply line is conductive;

a shift register, including a plurality of pulse generating means for generating timing pulses for causing the first switches to be conductive, which sequentially outputs the timing pulses to the signal supply lines, respectively; and a precharge circuit, including second switches respectively corresponding to the signal supply lines, which precharges each of the signal supply lines when a second switch corresponding to the signal supply line is conductive, each of the pulse generating means receiving a timing pulse outputted from previous pulse generating means in a period between (i) a point of time where the timing pulse is changed to an active level at which a first switch corresponding to the previous pulse generating means is made conductive and (ii) a point of time where said each of the pulse generating means outputs a timing pulse that is at an active level, said each of the timing pulse generating means outputting a precharge pulse for causing a second switch to be conductive, which second switch corresponds to a signal supply line in which the write signal is to be written in accordance with the timing pulse outputted by said each of the timing pulse generating means, and for thereby causing the signal supply line to be precharged; wherein said each of the pulse generating means includes (i) a set-reset flip-flop for outputting the timing pulse and (ii) control means for controlling a set signal of the flip-flop, when a timing pulse outputted by pulse generating means located right in front of the pulse generating means in which the control means is provided is active and when a timing pulse outputted by the pulse generating means in which the control means is provided is nonactive, the control means causes a clock signal or a signal, obtained by transforming the clock signal, to be the set signal of the flip-flop, and the flip-flop causes a timing pulse to be a reset signal, which timing pulse is outputted by pulse generating means located a predetermined number of stages after the pulse generating means in which the flip-flop is provided.

5. The display device driving circuit as set forth in claim 4, wherein:

in an odd-numbered one of the pulse generating means, either of a clock signal or an inversion clock signal is used as the clock signal; and in an even-numbered one of the pulse generating means, the other one of the clock signal or the inversion clock signal is used as the clock signal.

6. The display device driving circuit as set forth in claim 4, wherein:

the shift register is a bidirectional shift register allowing a switching of a shift direction in which the plurality of pulse generating means sequentially output the timing pulses; and said each of the pulse generating means includes (i) first selector means for selecting a timing pulse outputted by pulse generating means located right in front of said each of the pulse generating means along the shift direction, and for outputting the timing pulse to the control means and (ii) second selector means for selecting a timing pulse outputted by pulse generating means located a predetermined number of stages after said each of the pulse generating means along the shift direction, and for inputting the timing pulse to the flip-flop as a reset signal.

7. A display device, comprising:

a plurality of pixels;

data signal lines, provided so as to correspond to the pixels, which serves as a plurality of signal supply lines;

scanning signal lines, provided so as to correspond to the pixels, which serve as a plurality of signal supply lines;

a data signal line driver for writing, in the data signal lines and the pixel, a video signal serving as a write signal;

and a scanning signal line driver for writing, in the scanning signal lines, a scanning signal serving as a write signal, so as to select a pixel in which the video signal is to be written, the display device including, as the data signal line driver, a display device driving circuit, the display device driving circuit including, a write circuit, including first switches respectively corresponding to the plurality of signal supply lines provided in the display device, which writes a write signal in each of the signal supply lines when a first switch corresponding to the signal supply line is conductive, a shift register, including a plurality of pulse generating means for generating timing pulses for causing the first switches to be conductive, which sequentially outputs the timing pulses to the signal supply lines, respectively, a precharge circuit, including second switches respectively corresponding to the signal supply lines, which precharges each of the signal supply lines when a second switch corresponding to the signal supply line is conductive, each of the pulse generating means receiving a timing pulse outputted from previous pulse generating means, in a period between (i) a point of time where the timing pulse is changed to an active level at which a first switch corresponding to the previous pulse generating means is made conductive and (ii) a point of time where said each of the pulse generating means outputs a timing pulse that is at an active level, said each of the timing pulse generating means outputting a precharge pulse for causing a second switch to be conductive, which second switch corresponds to a signal supply line in which the write signal is to be written in accordance with the timing pulse outputted by said each of the timing pulse generating means, and for thereby causing the signal supply line to be precharged, overlap preventing means respectively corresponding to output lines via which the timing pulses are outputted, wherein each of the overlap preventing means eliminates a portion of a period during which a timing pulse to be supplied to an output line is at an active level, which portion overlaps a period during which a precharge pulse for causing a signal supply line to be precharged is at an active level, in which signal supply line the write signal is to be written in accordance with the timing pulse, and at which active level a second switch corresponding to the signal supply line is made conductive, and delay means for delaying a precharge pulse outputted from said each of the pulse generating means, and for outputting the precharge pulse to a second switch and overlap preventing means each corresponding to said each of the pulse generating means, wherein the overlap preventing means eliminates a portion of a period during which the timing pulse is at an active level, which portion overlaps a period during which the precharge pulse outputted by the delay means is at an active level, when a timing pulse outputted by subsequent pulse generating means located a predetermined number of stages after said each of the pulse generating means becomes active, the timing pulse outputted by said each of the pulse generating means is changed to a nonactive level at which a first switch corresponding to said each of the pulse generating means is made nonconductive, and the precharge pulse is delayed by the delay means by an amount of time loner than a period between (i) a point of time where the timing pulse outputted by the subsequent pulse generating means becomes active and (ii) a point of time where the timing pulse outputted by said each of the pulse generating means becomes nonactive.

8. A display device, comprising:

a plurality of pixels;

data signal lines, provided so as to correspond to the pixels, which serves as a plurality of signal supply lines;

scanning signal lines, provided so as to correspond to the pixels, which serve as a plurality of signal supply lines;

a data signal line driver for writing, in the data signal lines and the pixel, a video signal serving as a write signal;

and a scanning signal line driver for writing, in the scanning signal lines, a scanning signal serving as a write signal, so as to select a pixel in which the video signal is to be written, the display device including, as the data signal line driver, a display device driving circuit, the display device driving circuit including, a write circuit, including first switches respectively corresponding to a plurality of signal supply lines provided in a display device, which writes a write signal in each of the signal supply lines when a first switch corresponding to the signal supply line is conductive, a shift register, including a plurality of pulse generating means for generating timing pulses for causing the first switches to be conductive, which sequentially outputs the timing pulses to the signal supply lines, respectively, and a precharge circuit, including second switches respectively corresponding to the signal supply lines, which precharges each of the signal supply lines when a second switch corresponding to the signal supply line is conductive, each of the pulse generating means receiving a timing pulse outputted from previous pulse generating means in a period between (i) a point of time where the timing pulse is changed to an active level at which a first switch corresponding to the previous pulse generating means is made conductive and (ii) a point of time where said each of the pulse generating means outputs a timing pulse that is at an active level, said each of the timing pulse generating means outputting a precharge pulse for causing a second switch to be conductive, which second switch corresponds to a signal supply line in which the write signal is to be written in accordance with the timing pulse outputted by said each of the timing pulse generating means, and for thereby causing the signal supply line to be precharged; wherein said each of the pulse generating means includes (i) a set-reset flip-flop for outputting the timing pulse and (ii) control means for controlling a set signal of the flip-flop, when a timing pulse outputted by pulse generating means located right in front of the pulse generating means in which the control means is provided is active and when a timing pulse outputted by the pulse generating means in which the control means is provided is nonactive, the control means causes a clock signal or a signal, obtained by transforming the clock signal, to be the set signal of the flip-flop, and the flip-flop causes a timing pulse to be a reset signal, which timing pulse is outputted by pulse generating means located a predetermined number of stages after the pulse generating means in which the flip-flop is provided.

* * * * *

UNITED STATES PATENT AND TRADEMARK OFFICE

CERTIFICATE OF CORRECTION

PATENT NO. : 8,098,225 B2
APPLICATION NO. : 11/665206
DATED : January 17, 2012
INVENTOR(S) : Yuhichiroh Murakami et al.

It is certified that error appears in the above-identified patent and that said Letters Patent is hereby corrected as shown below:

Title Page, should read;

(22) PCT Filed: October 5, 2005

Signed and Sealed this
Twenty-seventh Day of March, 2012

David J. Kappos

David J. Kappos
*Director of the United States Patent and Trademark Office*